US007062823B2

(12) United States Patent
Copen et al.

(10) Patent No.: US 7,062,823 B2
(45) Date of Patent: Jun. 20, 2006

(54) THEFT DETERRENT DEVICE

(75) Inventors: Frank H. Copen, Shreve, OH (US); David K. Huehner, Cuyahoga Falls, OH (US); Richard E. Corney, Akron, OH (US)

(73) Assignee: Alpha Security Products, Inc., Charlotte, NC (US)

( * ) Notice: Subject to any disclaimer, the term of this patent is extended or adjusted under 35 U.S.C. 154(b) by 4 days.

(21) Appl. No.: 10/785,760

(22) Filed: Feb. 24, 2004
(Under 37 CFR 1.47)

(65) Prior Publication Data

US 2004/0237267 A1 Dec. 2, 2004

Related U.S. Application Data

(63) Continuation-in-part of application No. 10/072,291, filed on Feb. 7, 2002, now abandoned, which is a continuation-in-part of application No. 10/007,278, filed on Oct. 26, 2001, now Pat. No. 6,754,939.

(60) Provisional application No. 60/294,469, filed on May 30, 2001, provisional application No. 60/243,557, filed on Oct. 26, 2000.

(51) Int. Cl.
*E05B 65/00* (2006.01)

(52) U.S. Cl. ..... 24/704.1

(58) Field of Classification Search ..... 24/487, 24/704.1, 532, 542, 543, 545, 570; 70/57.1, 70/63, 277; 292/307 R, 317, 319, 320; 340/568.1, 340/571, 572.1, 572.2, 572.3, 572.8, 572.9, 340/573.4

See application file for complete search history.

(56) References Cited

U.S. PATENT DOCUMENTS

| | | | | |
|---|---|---|---|---|
| 3,645,023 | A * | 2/1972 | Larson | 40/633 |
| 3,656,247 | A * | 4/1972 | Bushnell et al. | 40/633 |
| 3,914,829 | A | 10/1975 | Paskert | |
| 3,942,829 | A | 3/1976 | Humble et al. | |
| 3,947,930 | A | 4/1976 | Martens et al. | |
| 4,070,879 | A | 1/1978 | Thompson | |
| 4,104,622 | A | 8/1978 | Van Niel | |
| 4,285,146 | A * | 8/1981 | Charles et al. | 40/665 |
| 4,380,097 | A | 4/1983 | Keifer | |
| RE31,706 | E * | 10/1984 | De Lima Castro Neto | 292/307 R |
| 4,474,116 | A * | 10/1984 | Castenada et al. | 70/63 |
| 4,483,049 | A | 11/1984 | Gustavsson et al. | |
| D284,176 | S * | 6/1986 | Battersby | D11/87 |
| 4,611,368 | A * | 9/1986 | Battersby | 24/116 R |
| 4,649,397 | A | 3/1987 | Heaton et al. | |
| 4,827,577 | A | 5/1989 | Vaux | |
| 5,421,177 | A * | 6/1995 | Sieber et al. | 70/57.1 |
| 5,426,419 | A | 6/1995 | Nguyen et al. | |
| 5,437,172 | A | 8/1995 | Lamy et al. | |

(Continued)

FOREIGN PATENT DOCUMENTS

| | | |
|---|---|---|
| DE | 200 14 860 | 10/2000 |

(Continued)

*Primary Examiner*—Robert J. Sandy
*Assistant Examiner*—Ruth C. Rodriguez
(74) *Attorney, Agent, or Firm*—Sand & Sebolt

(57) ABSTRACT

A theft deterrent device adapted to be connected to an item of merchandise to discourage shoplifting includes a flexible lanyard. In one embodiment, the first end of the lanyard is removably anchored to the holder with the second end of the lanyard being lockable to the holder. The lanyard may thus be replaced if severed by a shoplifter so that the holder may be reused. The invention also provides a lanyard having first and second ends with a latch that holds that ends together so that the ends may be inserted as a unit into the holder before being locked to the holder.

24 Claims, 53 Drawing Sheets

U.S. PATENT DOCUMENTS 5,524,463 A 6/1996 Schenkel et al.
5,568,951 A 10/1996 Morgan
5,577,395 A * 11/1996 Kuykendall ..... 24/543
5,615,504 A * 4/1997 Peterson et al. ..... 40/633
5,788,294 A * 8/1998 Leon et al. ..... 292/307 R
5,945,909 A * 8/1999 Kolton ..... 340/572.1
6,052,876 A 4/2000 Hogan et al.
6,092,401 A * 7/2000 Sankey et al. ..... 70/57.1
6,535,130 B1 3/2003 Nguyen et al.
6,701,583 B1 * 3/2004 McCullough ..... 24/116 R
2002/0154014 A1 * 10/2002 Elston ..... 340/572.8

FOREIGN PATENT DOCUMENTS

EP 0 947 650 10/1999

* cited by examiner

THEFT DETERRENT DEVICE

CROSS REFERENCE TO RELATED APPLICATIONS

This application is a continuation-in-part application claiming priority from U.S. application Ser. No. 10/072,291, filed on Feb. 07, 2002 now abandoned which is a continuation-in-part of U.S. application Ser. No. 10/007,278 filed Oct. 26, 2001, now U.S. Pat. No. 6,754,939 which claims priority from U.S. Provisional Patent Application No. 60/243,557 filed Oct. 26, 2000, and from U.S. Provisional Patent Application No. 60/294,469 filed May 30, 2001; the disclosures of each are incorporated herein by reference.

BACKGROUND OF THE INVENTION

1. Technical Field

The present invention generally relates to theft deterrent devices and, more particularly, to anti-shoplifting security devices that hold an EAS tag to an item of merchandise.

2. Background Information

Merchandise lost to shoplifting is a well known problem faced by retail establishments. One anti-shoplifting system tags each article of merchandise with an electronic article surveillance (EAS) tag that activates an alarm when the EAS tag passes near a sensor that is typically positioned at the exit to the retail establishment.

Some items of merchandise are relatively small and are ill-suited for receiving a relatively large EAS tag holder. Another problem is that it is difficult to attach an EAS tag holder to other items of merchandise. Retail establishments desire theft deterrent devices and EAS tag holders designed for these situations. One example is the jewelry portion of the retail market wherein necklaces and earrings cannot readily hold a large EAS tag holder. Other items of merchandise cannot be pierced with the attachment pin used by some EAS tag holders. Lanyards have been developed for these products. A drawback with existing lanyards is that they may be severed to remove the tag holder from the item of merchandise. Once severed, the tag holder is destroyed and must be replaced. Some existing lanyards are difficult to assemble and require both ends of the lanyard to be held in alignment while the sharp tack of the holder is threaded through the ends of the lanyard.

SUMMARY OF THE INVENTION

The invention provides a theft deterrent device adapted to be connected to an item of merchandise to discourage shoplifting. The device includes a first member; a second member; a hinge connecting the first member to the second member and allowing the members to move from an unlocked position to a locked position; a lock adapted to lock the first member to the second member in the locked position; and the members defining at least first and second openings adapted to receive the item of merchandise such that the device is connected to the item of merchandise.

The invention also provides a theft deterrent device adapted to be connected to an item of merchandise to discourage shoplifting. This embodiment of the device includes a first member; a second member; a hinge connecting the first member to the second member and allowing the members to move from an unlocked position to a locked position; a lock adapted to lock the first member to the second member in the locked position; the second member defining a slot adapted to receive a portion of the item of merchandise; the first member carrying a tooth that is adapted to pass through the item of merchandise disposed in the slot of the second member when the first member is in the locked position.

Another embodiment of the invention provides a theft deterrent device that includes a first member; a second member; a hinge connecting the first member to the second member and allowing the members to move from an unlocked position to a locked position; a lock adapted to lock the first member to the second member in the locked position; the second member defining a slot adapted to receive a portion of the item of merchandise; a lanyard having first and second ends; each of the ends defining an opening; a portion of the lanyard being disposed in the slot defined by the second member such that the first and second ends are disposed adjacent the second member; and the first member carrying a tooth that is adapted to pass through the openings of the ends when the first member is in the locked position.

The invention also provides an embodiment of a holder and lanyard wherein the first and second ends of the lanyard are removably connected to the holder. At least one of the lanyard ends is anchored in a location where the tooth does not pass through the end to anchor it in position.

BRIEF DESCRIPTION OF THE SEVERAL VIEWS OF THE DRAWINGS

Similar numbers refer to similar parts throughout the specification.

DETAILED DESCRIPTION OF THE INVENTION

Figure 1:
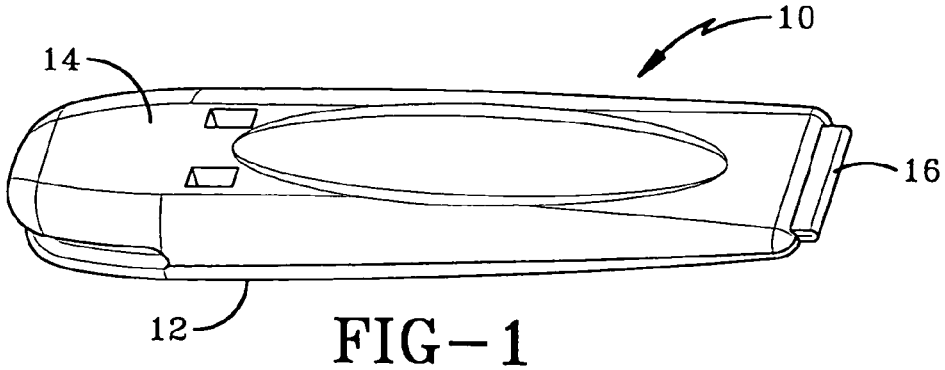
FIG. 1 is a perspective view of the first embodiment of the disposable EAS tag holder of the present invention.
Figure 2:
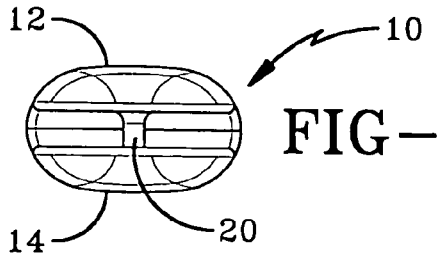
FIG. 2 is an end view of the holder of FIG. 1.
Figure 3:
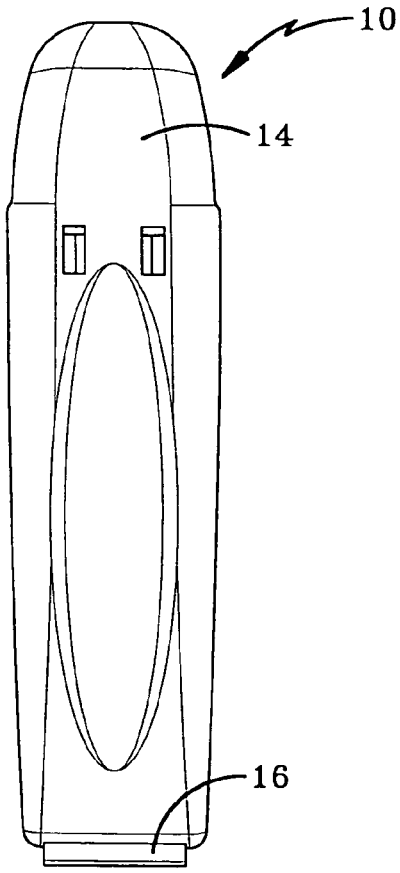
FIG. 3 is a top view of FIG. 1.
Figure 4:
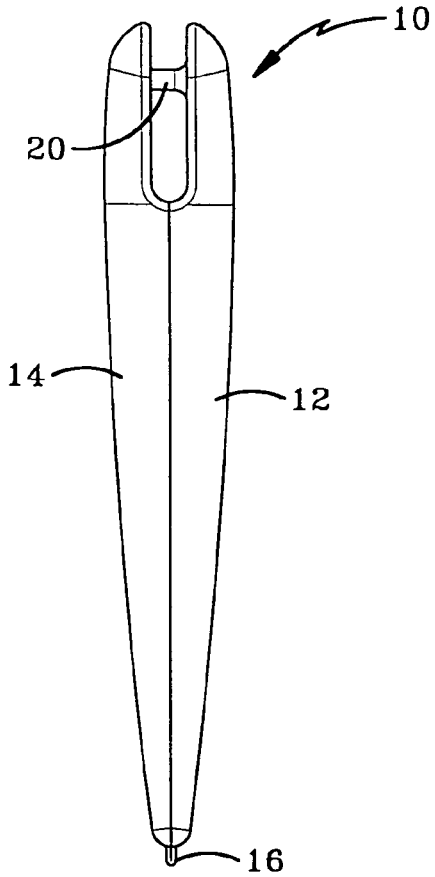
FIG. 4 is a side view of FIG. 1.
Figure 5:
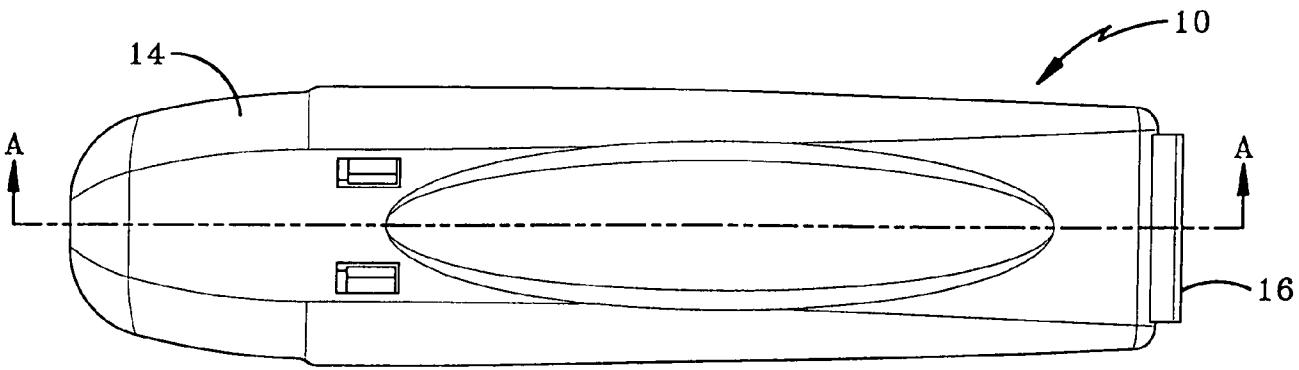
FIG. 5 is an enlarged top view of FIG. 1.
Figure 6:
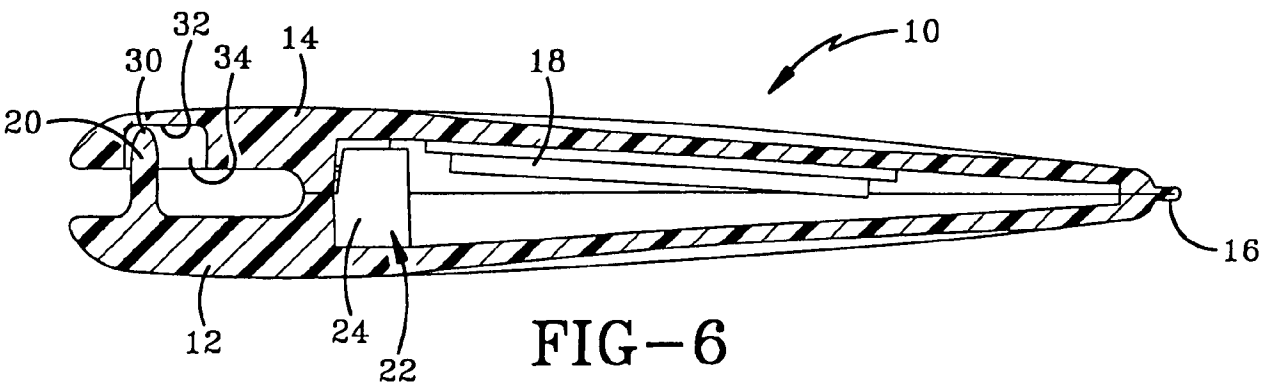
FIG. 6 is a section view taken along line A—A of FIG. 5.
Figure 7:
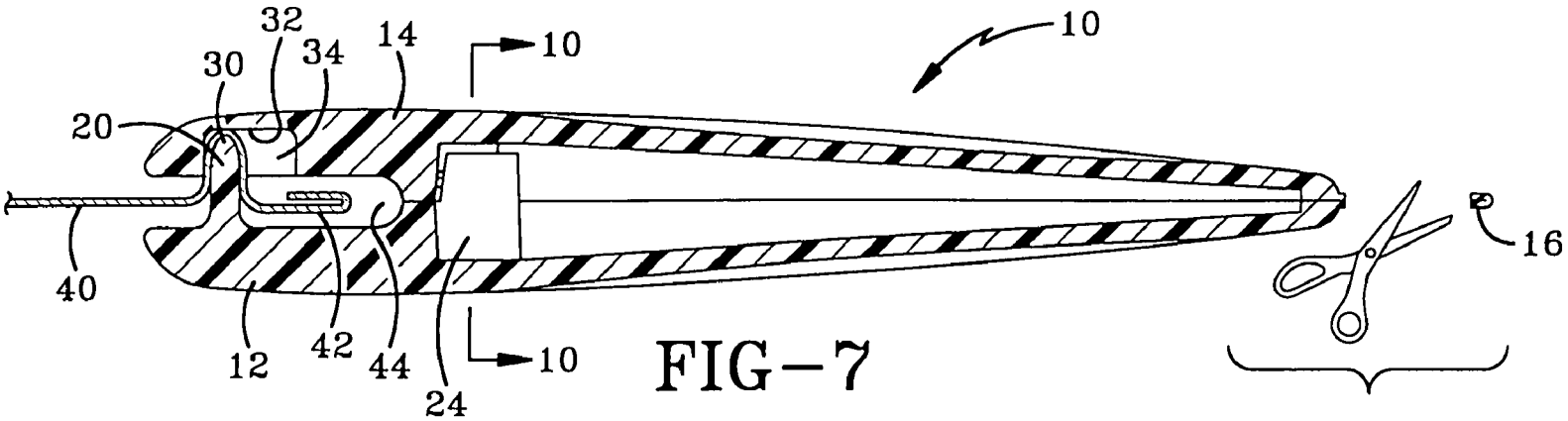
FIG. 7 is a section view similar to FIG. 6 showing the hinge of the holder being removed with a pair of scissors.
Figure 8:
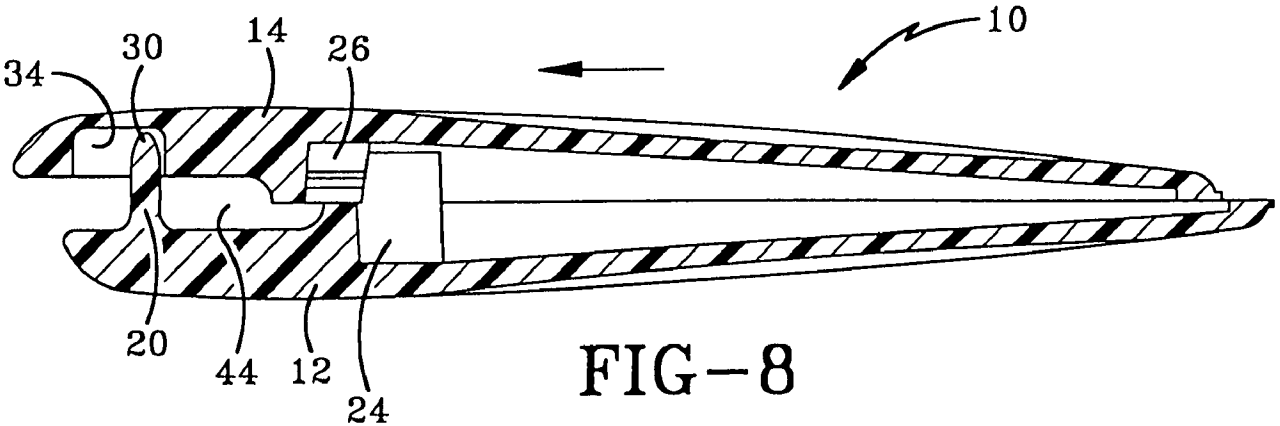
FIG. 8 is a section view similar to FIG. 6 showing the second member of the holder being moved relative to the first member of the holder.
Figure 9:
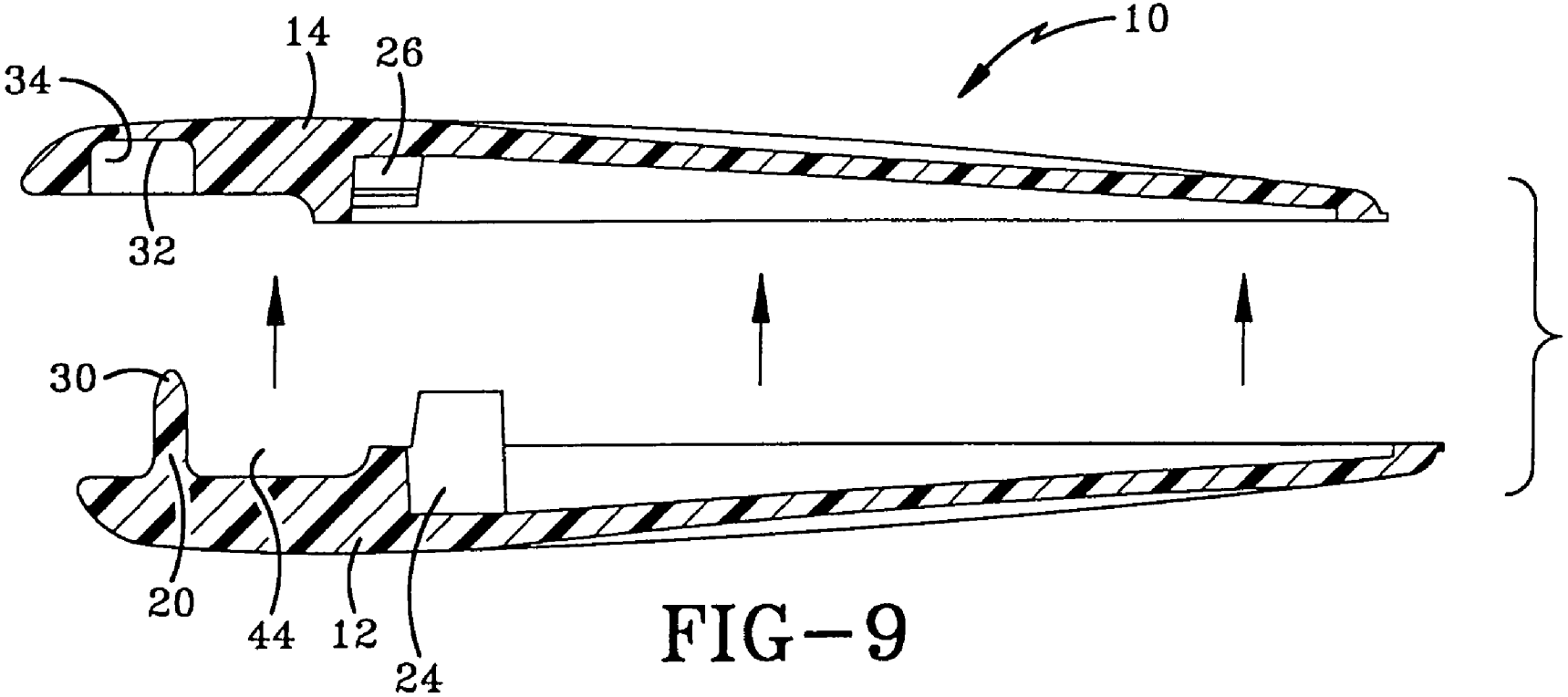
FIG. 9 is a section view similar to FIG. 6 showing the first and second members of the holder being separated.
Figure 11:
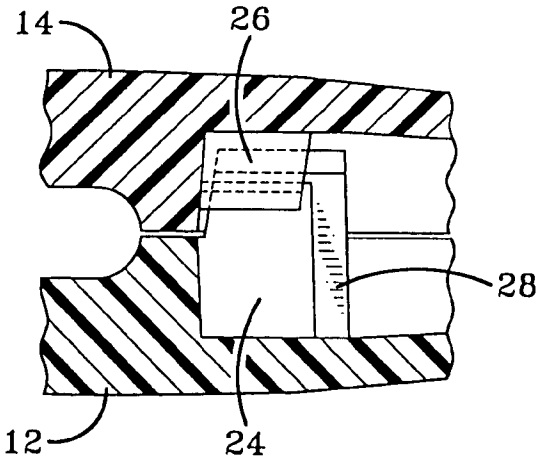
FIG. 11 is a section view taken along line 11—11 of FIG. 10.
Figure 10:
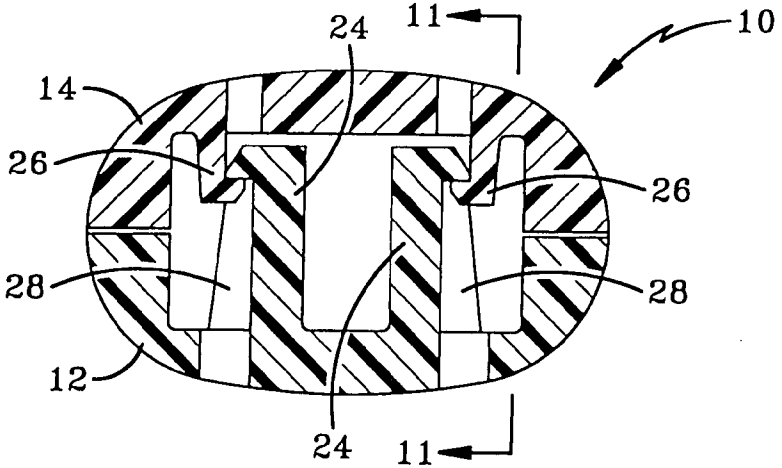
FIG. 10 is a section view taken along line 10—10 of FIG. 7.

The first embodiment of the EAS tag holder of the present invention is indicated generally by the numeral 10 in FIGS. 1–11. EAS tag holder 10 generally includes first and second members 12 and 14 connected together by a hinge 16. Hinge 16 is preferably a living hinge that hingedly connects members 12 and 14 between an opened, unlocked position and a closed, locked position. EAS tag holder 10 functions by securely holding an EAS tag 18 between members 12 and 14 where it cannot be accessed when members 12 and 14 are in the locked position. EAS tag holder 10 includes a tooth 20 that secures EAS tag holder 10 to a substrate 40. Substrate 40 may be a flexible layer of material such as a layer of fabric or a section of clothing. Substrate 40 may also be any of a variety of items of merchandise that can accept tooth 20. EAS tag holder 10 may thus be locked to substrate 40 in order to secure an EAS tag to substrate 40 such that an alarm will sound if substrate 40 is passed near an alarm configured to sense EAS tag 18. EAS tag holder 10 is removed from substrate 40 by the consumer after the consumer leaves the retail establishment. EAS tag holder 10 is configured to be easily removed by the consumer by configuring hinge 16 in a manner that allows the consumer to sever hinge 16 with a pair of scissors as shown in FIG. 7. Once hinge 16 is severed, members 12 and 14 may be separated as shown in FIG. 9 and discarded.

Members 12 and 14 are locked together with a locking mechanism 22 that generally includes a pair of first locking fingers 24 and a pair of second locking fingers 26. Locking fingers 24 and 26 are configured to snap together in a one way snap fit connection when members 12 and 14 are moved from the unlocked position to the locked position. To facilitate the one way snap fit engagement, each locking finger 24 and 26 includes an angled surface. The angled surfaces are positioned to engage each other to allow fingers 24 and 26 to slide over each other. Each locking finger 24 and 26 also includes a locking surface that engages the locking surface of the corresponding locking finger to prevent the locking fingers 24 and 26 from being pulled apart once they are snapped into the locked position.

In one embodiment of the invention, locking fingers 24 include a blocking wall 28 that prevents locking fingers 26 from sliding out of engagement with locking fingers 24. Blocking walls 28 are disposed toward hinge 16. In other embodiments of the invention, blocking wall 28 may be spaced from locking fingers 24.

Tooth 20 extends from member 12 and includes an outer end 30 that is disposed immediately adjacent a wall portion of second member 14 when EAS tag holder 10 is in the locked position. The wall that lies closely adjacent outer end 30 is the bottom wall 32 of a concave depression 34 defined by second member 14. Concave depression 34 has a width larger than the thickness of tooth 20 so that tooth 20 and a portion of substrate 40 may be positioned in depression 34. The length of depression 34 is configured to allow locking fingers 24 and 26 to disengage each other when slid with respect to each other as depicted in FIG. 8. In the embodiment depicted in FIG. 8, member 14 is slid to the left with respect to member 12 such that tooth 20 moves from the left side of depression 34 to the right side of depression 34. When members 12 and 14 are slid in this manner, locking fingers 24 and 26 disengage with each other and members 12 and 14 may be pulled apart.

Holder 10 is used by placing substrate 40 over tooth 20 and then closing member 14 over tooth 20 until locking fingers 24 and 26 engage to hold members 12 and 14 together. In this position, substrate 40 is clamped between tooth 20 and member 14 in depression 34. The clamping force prevents substrate 40 from being removed from holder 10. In some situations, substrate 40 will include a bead 42 that may be disposed in an elongated opening 44. Bead 42 cannot be pulled back over tooth 20 thus further locking substrate 40 in holder 10.

The consumer who purchases substrate 40 removes EAS tag holder 10 by cutting hinge 16 with a pair of scissors or a knife. Once hinge 16 is severed, members 12 and 14 may slide relative to each other as depicted in FIG. 8. The sliding movement allows fingers 24 and 26 to disengage. Once disengaged, members 12 and 14 may be separated to release holder 10 from substrate 40.

Figure 12:
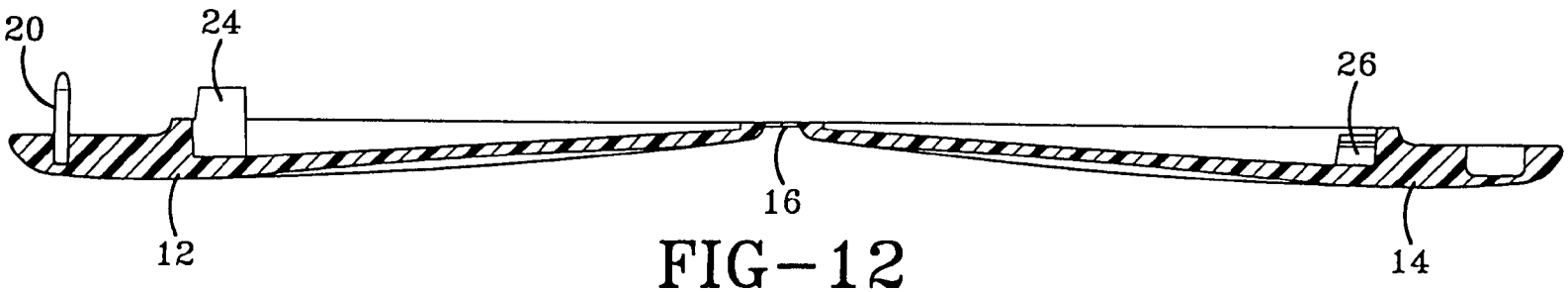
FIG. 12 is a section view similar to FIG. 6 showing a second embodiment of the EAS tag holder in an open configuration.

FIG. 12 depicts the second embodiment of the EAS tag holder of the invention wherein tooth 20 includes a sharp end. In the second embodiment, the tooth may pierce article 40 to secure holder 10 to substrate 40. Tooth 20 may be fabricated from a metal, a plastic, a ceramic, or any other material known to those skilled in the art.

Figure 13:
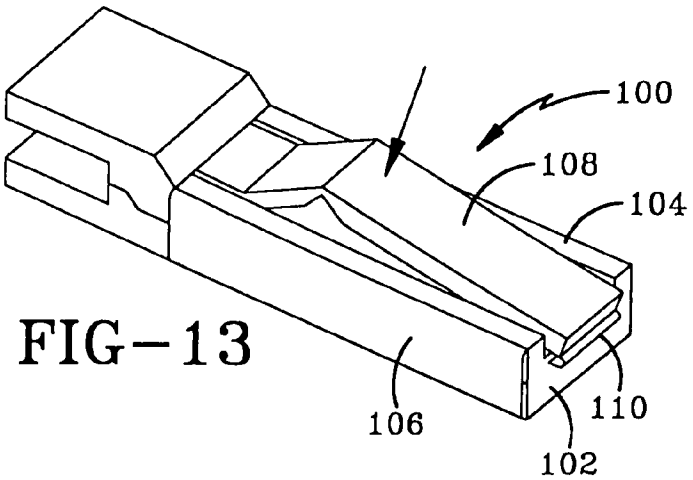
FIG. 13 is a perspective view of a third embodiment of a disposable EAS tag holder in an unlocked configuration.
Figure 14:
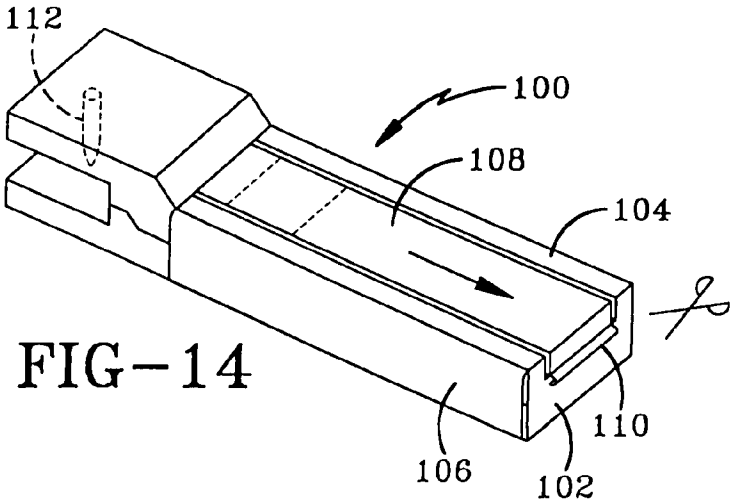
FIG. 14 is a perspective view similar to FIG. 13 showing the third embodiment of the disposable EAS tag holder in a locked configuration.
Figure 14A:
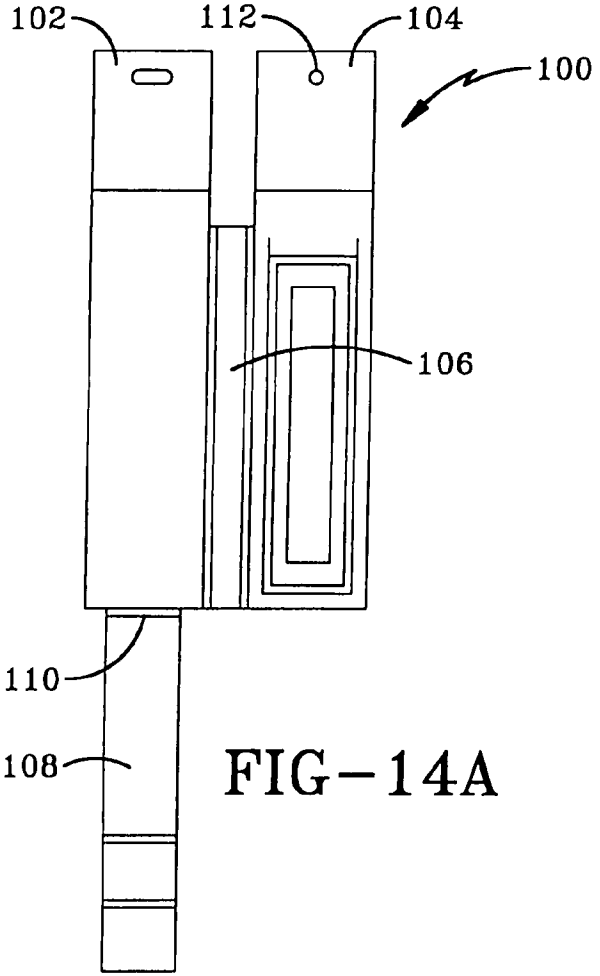
FIG. 14A is a view of the third embodiment of the EAS tag holder in an unfolded configuration.

The third embodiment of the EAS tag holder is indicated generally by the numeral 100 in FIGS. 13, 14, and 14A. EAS tag holder 100 generally includes a first member 102 and a second member 104 that are hinged together with a hinge 106. Hinge 106 may include a pair of living hinges and a hinge wall member. EAS tag holder 100 may include a slide 108 that is movable between unlocked and locked positions as depicted in FIGS. 13 and 14. Slide 108 locks members 102 and 104 together when slide 108 is in a locked position and allows members 102 and 104 to be separated when slide 108 is in the unlocked position. Slide 108 is hinged to member 102 by hinge 110.

EAS tag holder 100 clamps onto article 40 in the same manner described above with respect to the first and second embodiments of the EAS tag holder. EAS tag holder 100 may include a clamping tooth 112 or a piercing tooth 112.

Slide 108 includes a plurality of hinges that allow slide 108 to be shortened and inserted into an opening defined by member 104. The opening is at the opposite end of member 104 than hinge 110. When the end of slide 108 is inserted in the opening, the end of slide 108 engages portions of member 102 to prevent members 102 and 104 from being separated. This position is the locked position and is depicted in FIG. 14.

Members 102 and/or 104 include locking fingers that engage corresponding locking fingers on slide 108 to hold slide 108 in the locked position depicted in FIG. 14. When the user desires to remove EAS tag holder 100 from article 40, the user cuts hinge 110 and disengages the locking fingers allowing slide 108 to be removed from the opening thus allowing members 102 and 104 to be moved apart.

Figure 15:
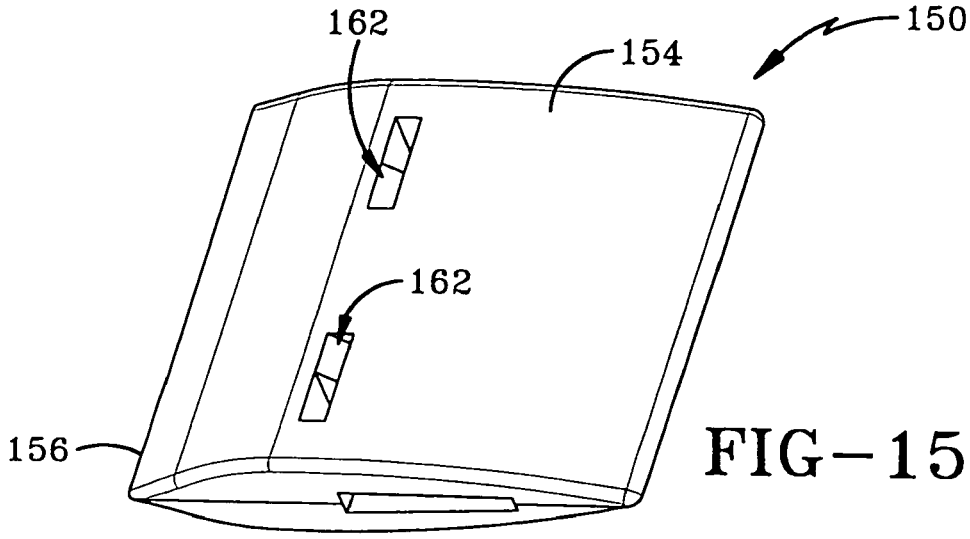
FIG. 15 is a perspective view of a fourth embodiment of a disposable EAS tag holder.
Figure 16:
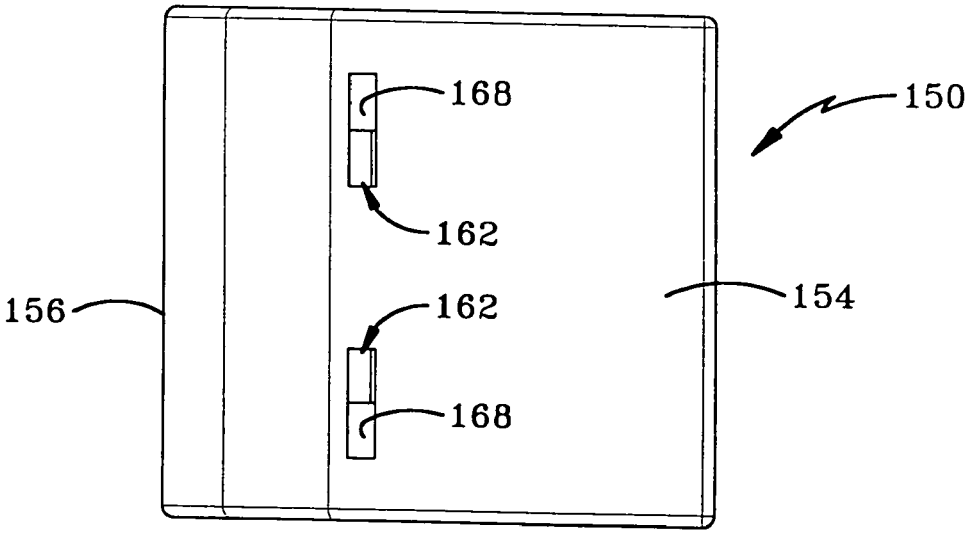
FIG. 16 is a top plan view of FIG. 15.
Figure 17:
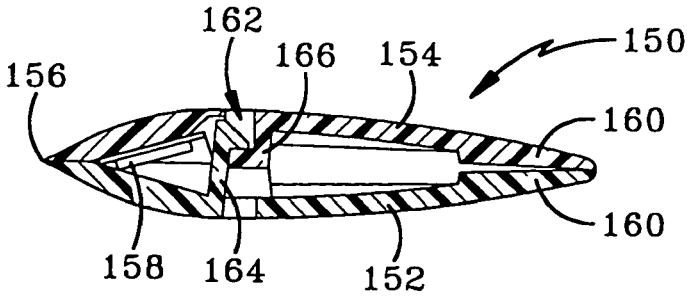
FIG. 17 is a section view taken along line A—A of FIG. 16.

The fourth embodiment of the EAS tag holder of the present invention is indicated generally by the numeral 150 in FIGS. 15, 16 and 17. EAS tag holder 150 includes a first member 152 and a second member 154 that are connected together by a hinge 156. Members 152 and 154 are configured to hold an EAS tag 158 in a location where EAS tag 158 cannot be readily accessed by the potential shoplifter. Members 152 and 154 are configured to clamp onto a flexible substrate and include gripping jaws 160 for frictionally holding the substrate once clamped on the substrate.

Members 152 and 154 are held in the clamped position by a locking mechanism 162 that includes cooperating locking fingers 164 and 166. Members 152 and 154 define openings 168 adjacent each finger 164 and 166 so that a user may insert a pry bar such as a flathead screwdriver into openings 168 to break fingers 164 and 166 or disengage fingers 164 and 166 from one another so that members 152 and 154 may be separated to release the flexible substrate.

Figure 18:
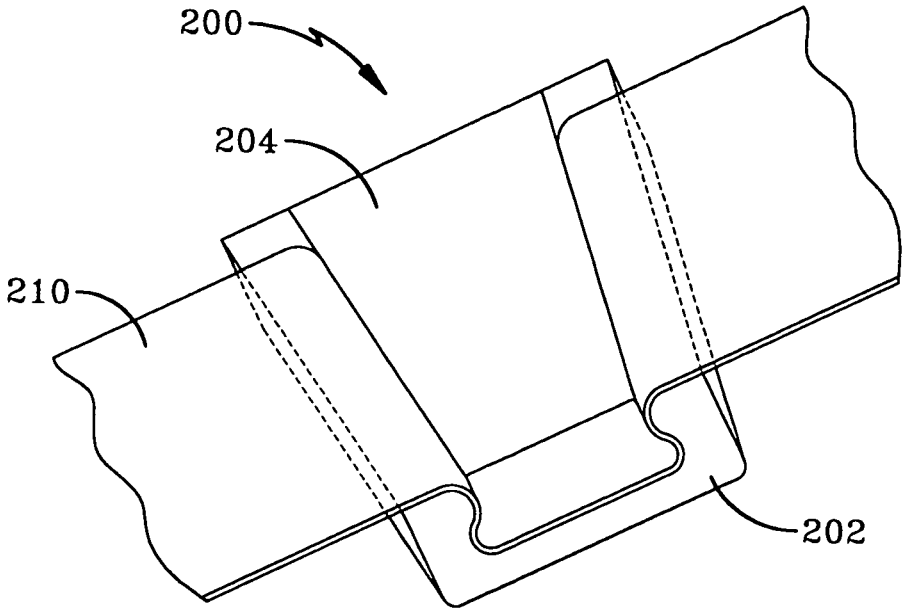
FIG. 18 is a perspective view of a fifth embodiment of the disposable EAS tag holder of the present invention.
Figure 19:
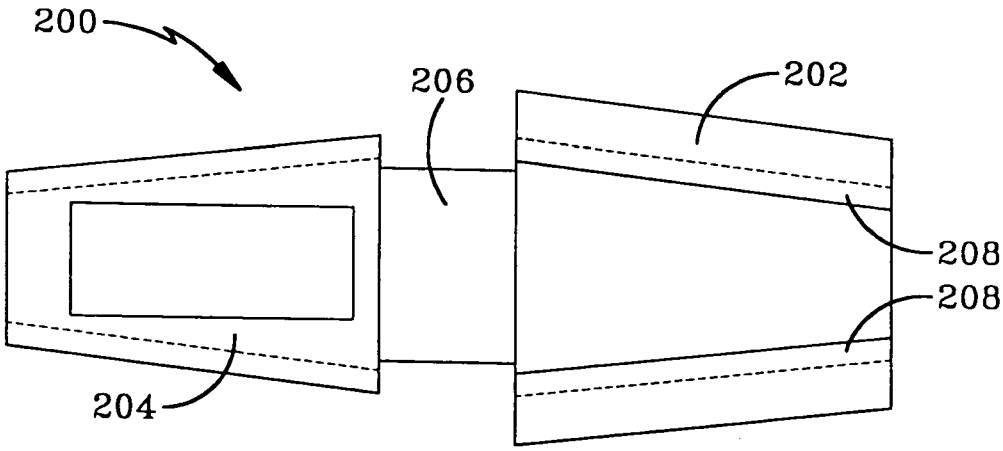
FIG. 19 is a top plan view of the disposable EAS tag holder of FIG. 18 in an open configuration.

The fifth embodiment of the EAS tag holder of the present invention is indicated generally by the numeral 200 in FIGS. 18 and 19. EAS tag holder 200 includes a base 202 and a wedge 204 that are connected together by a hinge 206. One of base 202 and wedge 204 includes a recess for holding an EAS tag. Wedge 204 is designed to slide into base 202. Base 202 includes angled sidewalls 208 that prevent wedge 204 from being lifted directly out of base 202 once wedge 204 is slid into base 202.

EAS tag holder 200 functions by placing a flexible substrate 210 on base 202 and sliding wedge 204 over substrate 210 and into base 202. Substrate 210 is thus frictionally trapped between wedge 204 and base 202. The friction between the three elements prevents wedge 204 from being removed until holder 200 is at least partially destroyed by a user. Locking fingers may also be used to hold the two elements together.

Figure 20:
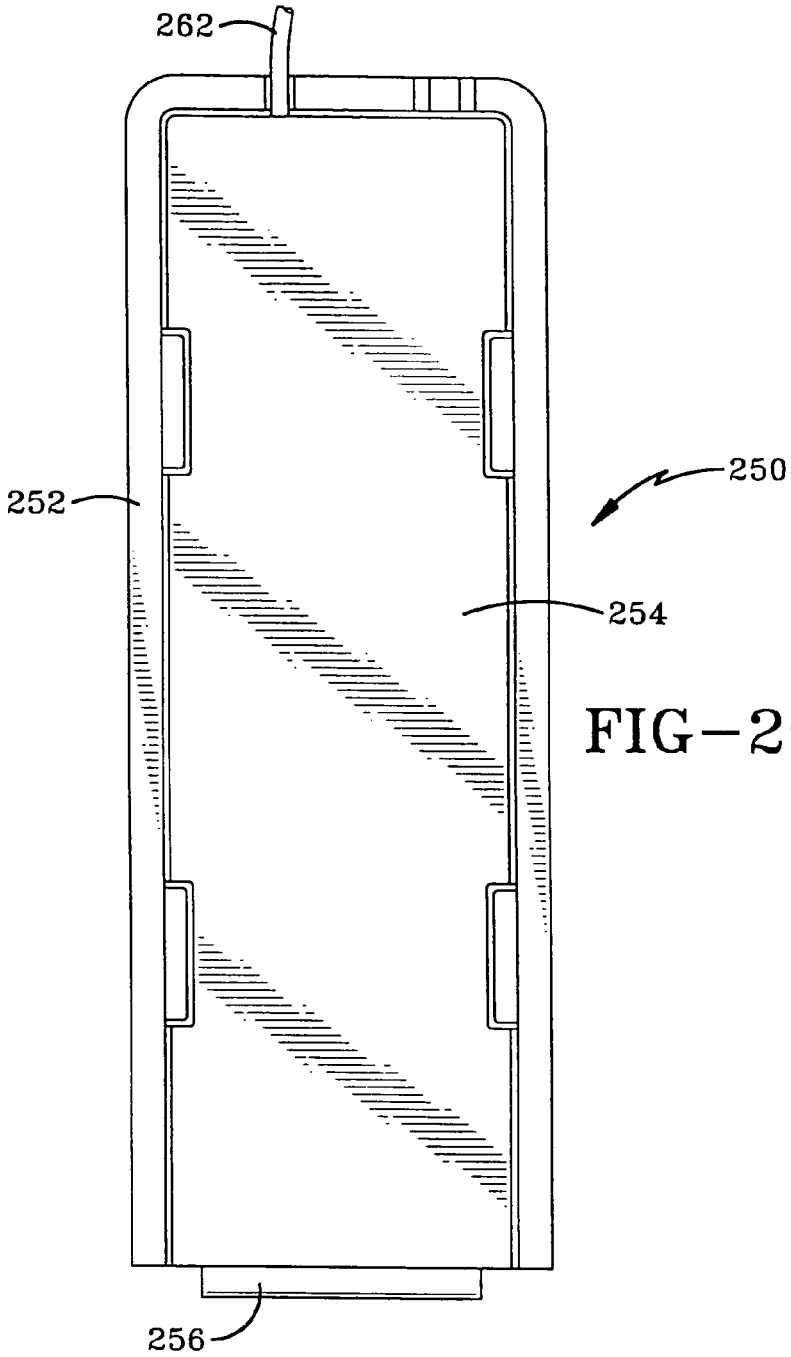
FIG. 20 is a top plan view of the sixth embodiment of the disposable EAS tag holder of the present invention.
Figure 21:
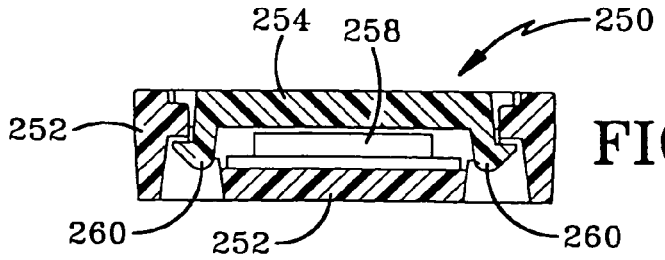
FIG. 21 is a section view taken along line A—A of FIG. 20.
Figure 22A:
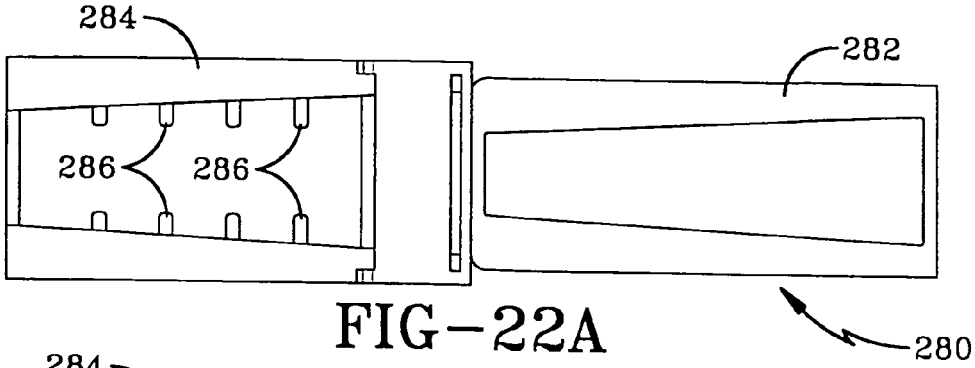
FIGS. 22A–E depicts different views of a seventh embodiment of the disposable EAS tag holder of the present invention.
Figure 22B:
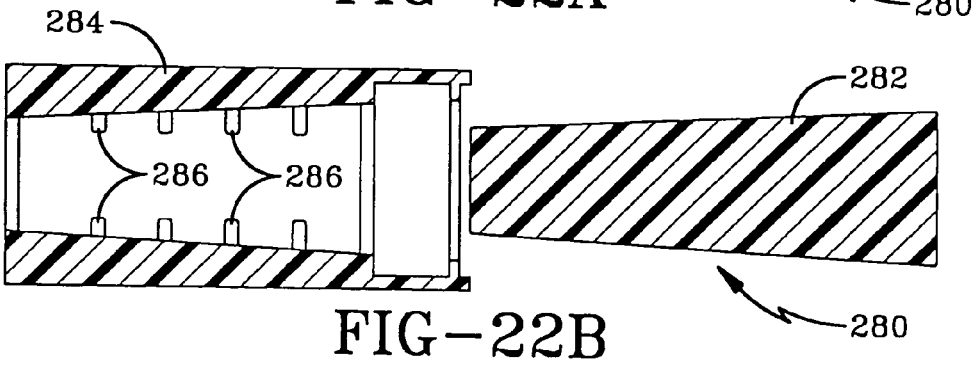
Figure 22C:
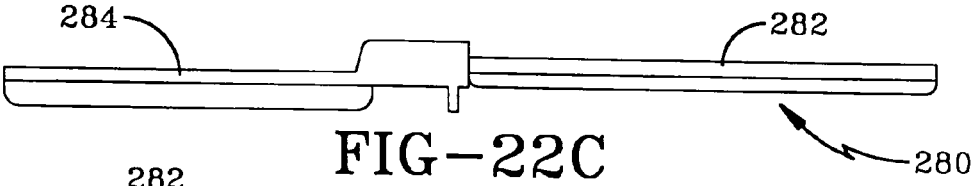
Figure 22D:
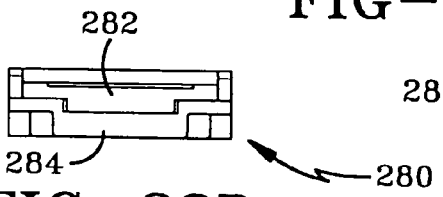
Figure 22E:
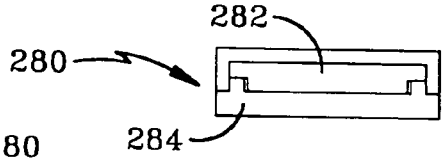
Figure 23A:
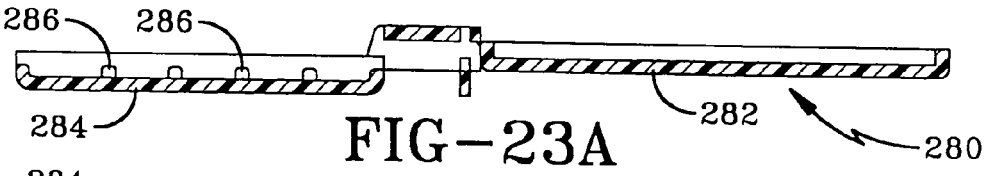
FIGS. 23A–B depicts additional views of the seventh embodiment.
Figure 23B:
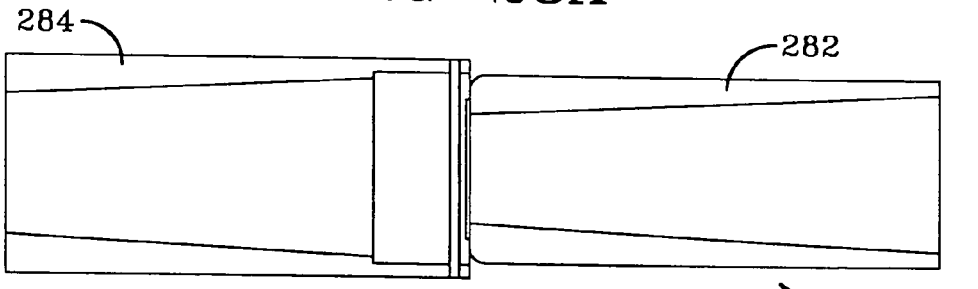
Figure 24:
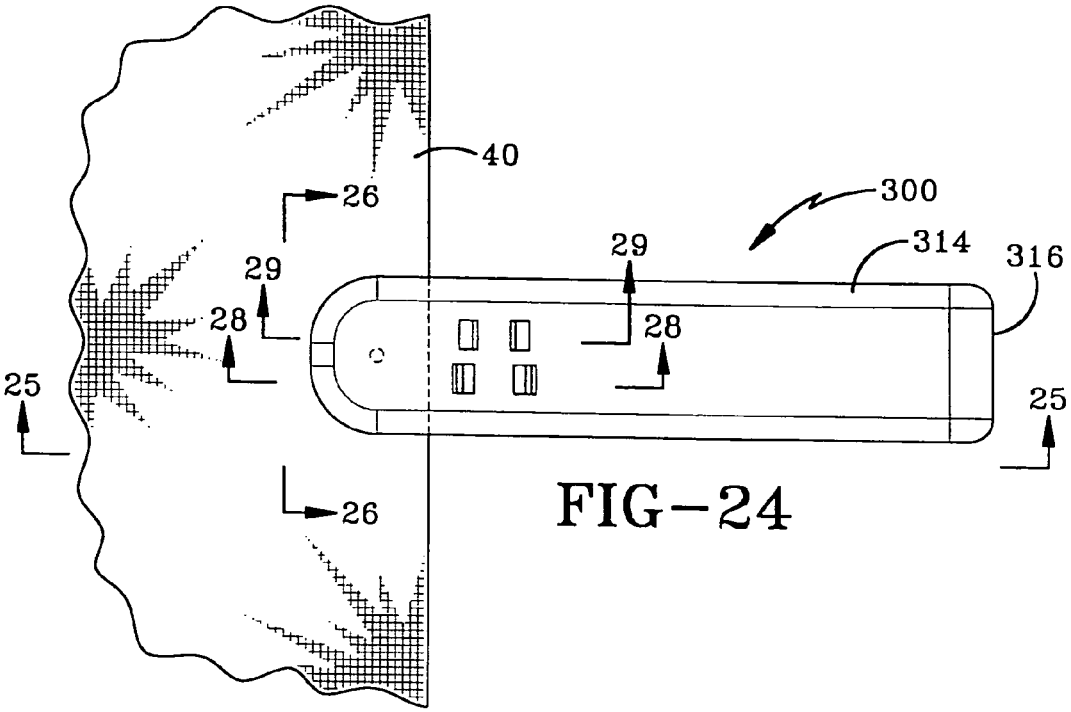
FIG. 24 is a top plan view of an eighth embodiment of the EAS tag holder of the present invention attached to a portion of an item of merchandise.
Figure 25:
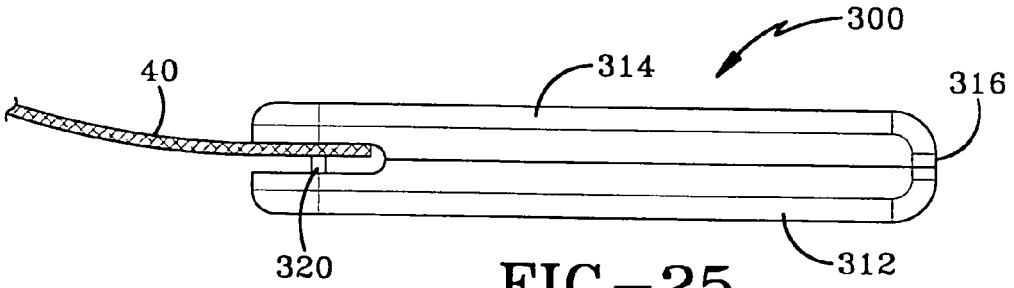
FIG. 25 is a section view taken along line 25—25 of FIG. 24.
Figure 26:
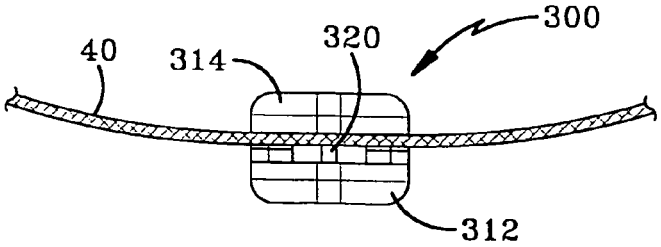
FIG. 26 is a section view taken along line 26—26 of FIG. 24.

The sixth embodiment of the EAS tag holder of the present invention is indicated generally by the numeral 250 in FIGS. 20 and 21. EAS tag holder 250 includes a base 252 and a lid 254 that are hinged together with a hinge 256. An EAS tag 258 is held between members 252 and 254. Member 254 is locked in place with a plurality of locking fingers 260.

Members 252 and 254 further hold one end of a flexible member 262 that is connected to articles of clothing in a conventional manner. Typically flexible member 262 includes a T-shaped second end that is embedded within the clothing in a manner that prevents it from being pulled out of the clothing. The structure of flexible member 262 is well known in the art and tools for inserting the T-shaped end of member 262 into clothing are also known in the art.

FIGS. 22A–23B depict different views of the seventh embodiment of the invention wherein the holder is indicated generally by the numeral 280. Holder 280 includes first 282 and second 284 members that slide relative to one another between unlocked and locked positions. Members 282 and 284 to define a compartment that holds an EAS tag. Members lock onto substrate 40 by placing a section of substrate 40 over member 284 and sliding member 282 over substrate 40 so that substrate 40 is wedged between members 282 and 284. Member 284 may include ribs 286 that help hold substrate 40 in place. A locking mechanism—such as a locking finger—may be provided between members 282 and 284 to prevent them from being slid back to the unlocked position after they are clamped in place. The locking mechanism is positioned at one of the ends of holder 280 so that the locking mechanism may be destroyed to allow members 282 and 284 to be opened.

The eighth embodiment of the EAS tag holder of the present invention is indicated generally by the numeral 300 in FIGS. 24–41. EAS tag holder 300 generally includes first and second members 312 and 314 connected together by a hinge 316. Hinge 316 may be a living hinge that hingedly connects members 312 and 314 between an open, unlocked position and a closed, locked position. Hinge 316 may also be a multi-component hinge.

EAS tag holder 300 functions by securely holding an EAS tag 318 between members 312 and 314 where it cannot be accessed when members 312 and 314 are in the locked position. EAS tag holder 300 includes a tooth 320 that secures EAS tag holder 300 to substrate 40 as described above. EAS tag holder 300 may thus be locked to substrate 40 in order to secure an EAS to substrate 40 such that an alarm will sound if substrate 40 is removed from a retail establishment having monitoring devices. EAS tag holder 300 is designed to be removed by the store clerk at the retail establishment before the retail customer leaves the retail establishment. EAS tag holder 300 may be removed with an opener 342 (FIG. 30) that allows EAS tag holder 300 to be reused or an opener 344 (FIG. 37) that breaks EAS tag holder 300. When opener 344 is used, EAS tag holder 300 is discarded after it is removed from substrate 40.

Members 312 and 314 are locked together with a locking mechanism 322 that generally includes a pair of first locking fingers 324 and a pair of second locking fingers 326 connected to each members 312 and 314. Locking fingers 324 are configured to lock with fingers 326 when members 312 and 314 are moved from the open to the closed position to close EAS tag holder 300 over item of merchandise 40. Each locking finger 324 and 326 includes a locking surface 328 that prevents fingers 324 and 326 from separating from one another once they are in the locked position depicted in FIGS. 28 and 29. Each locking surface 328 is substantially perpendicular to the longitudinal centerline of key opening 332. Each surface 328 is also substantially perpendicular to the direction that members 312 and 314 initially move when holder 300 is opened.

Each first locking finger 324 includes a first angled portion that projects outwardly away from member 312 or 314. Each first locking finger 324 also includes a second portion that projects downwardly back towards member 312 or 314 to form a V-shaped locking finger that includes an angled surface 330 that is aligned with a key opening 332 that allows a key pin 334 to enter holder 300 and engage first locking fingers 324.

Figure 27:
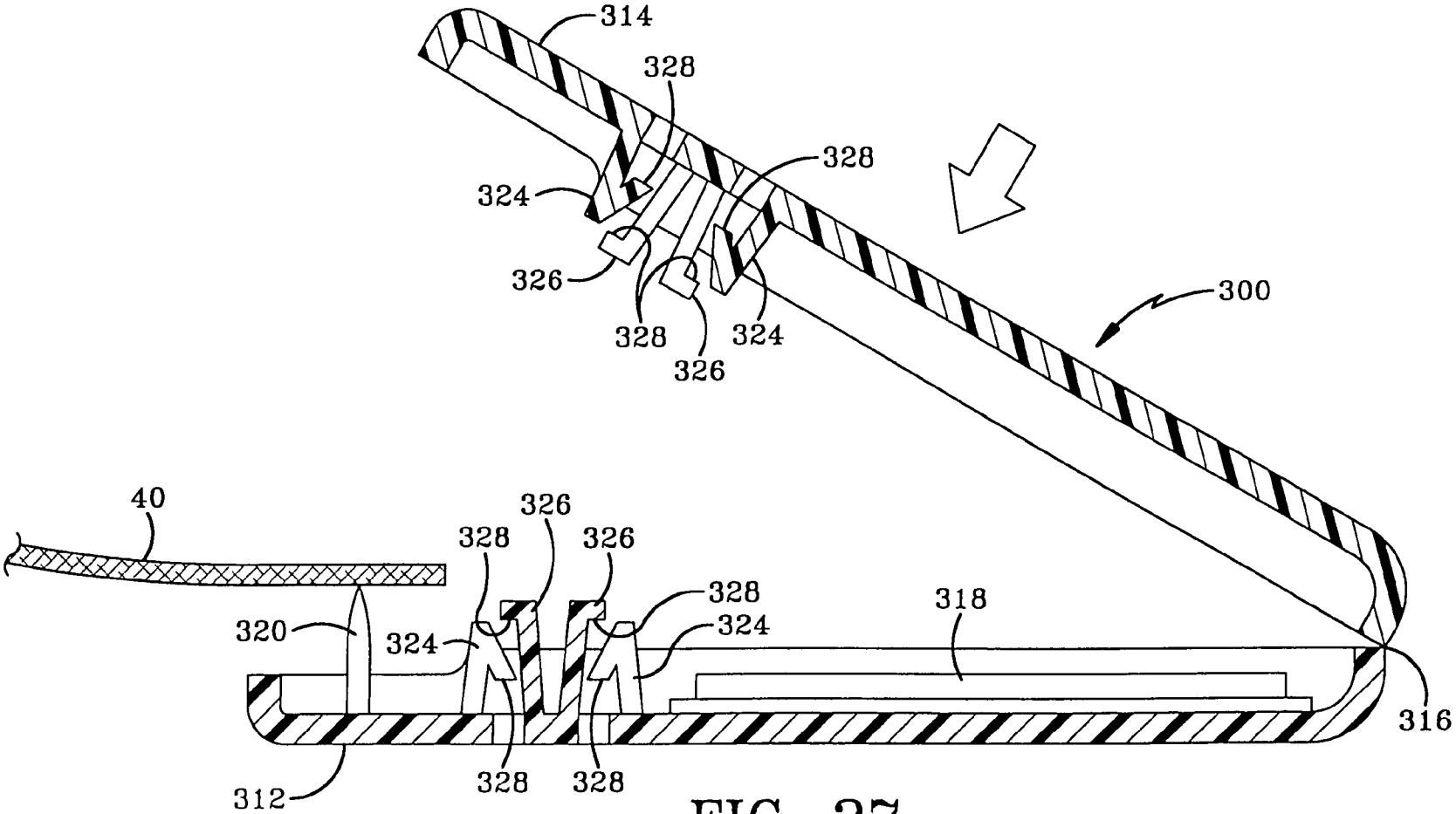
FIG. 27 is a section view taken longitudinally through the eighth embodiment of the EAS tag holder showing the holder being attached to an item of merchandise.
Figure 28:
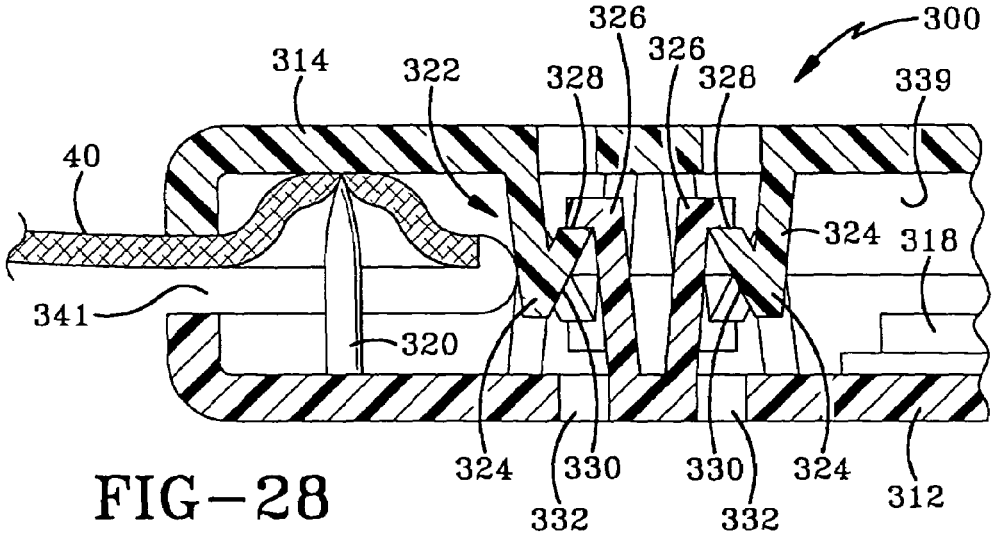
FIG. 28 is a section view taken along line 28—28 of FIG. 24.
Figure 29:
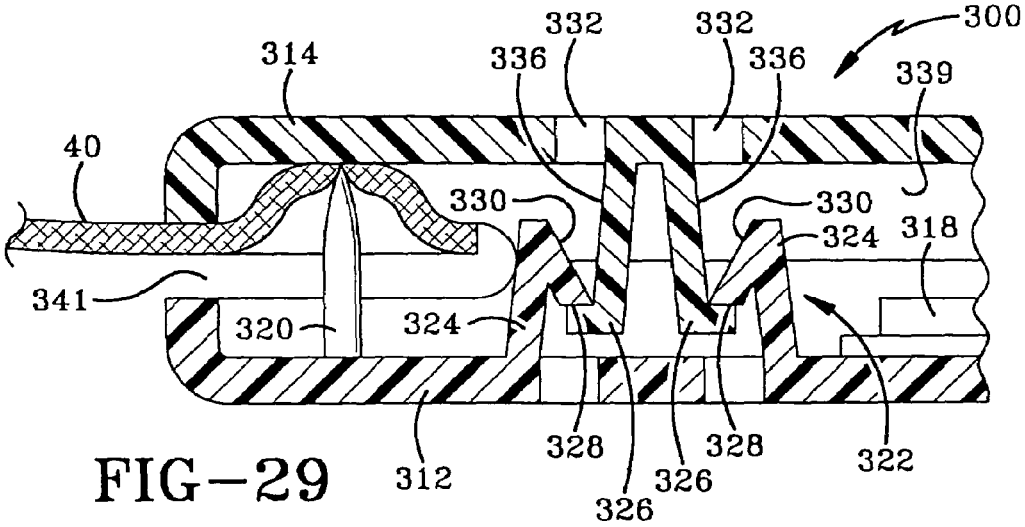
FIG. 29 is a section view taken along line 29—29 of FIG. 24.
Figure 35:
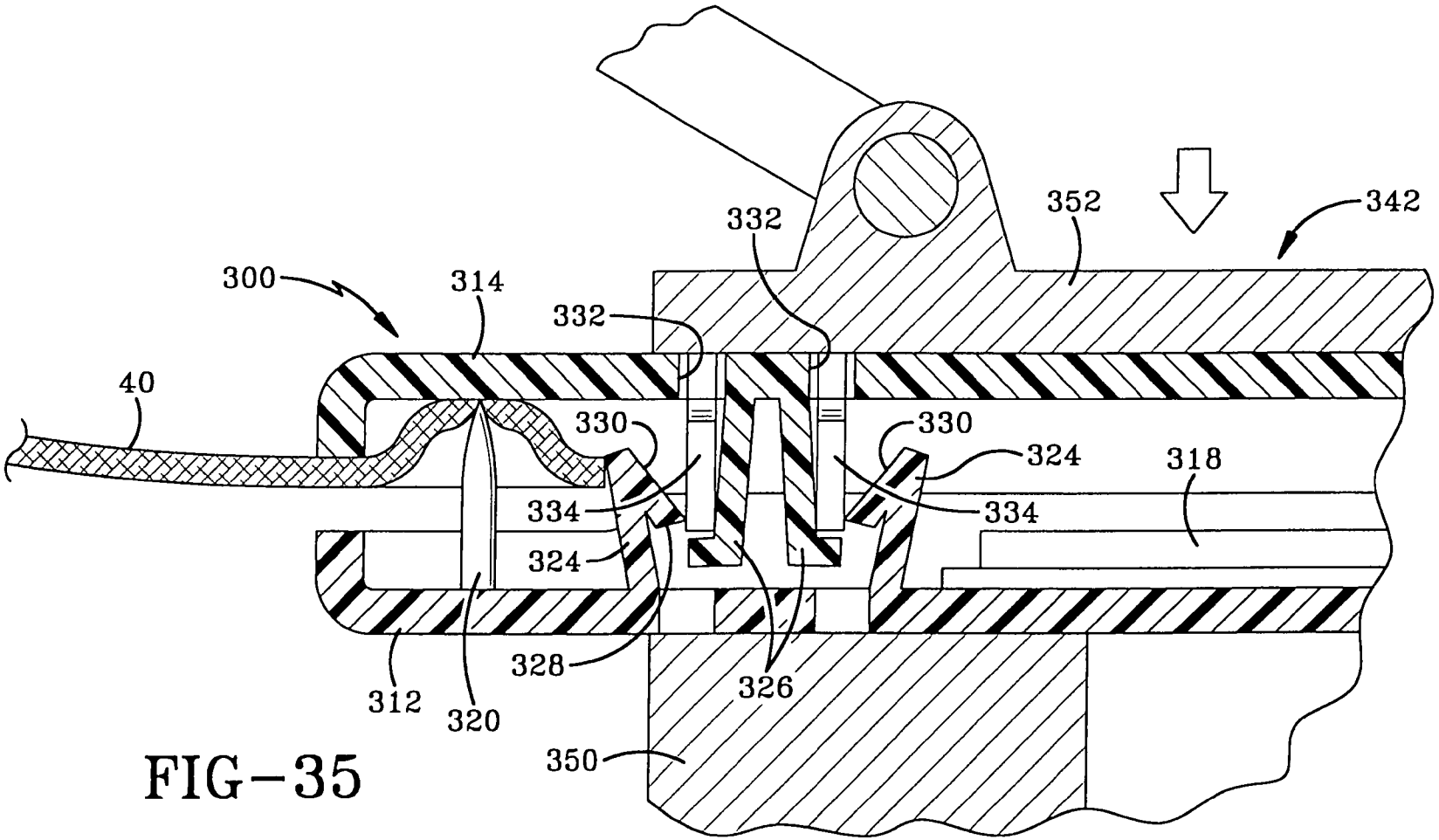
FIG. 35 is a section view taken along line 35—35 of FIG. 34.

Second locking fingers 326 also include an angled surface 336 that is aligned with openings 332. Angled surface 336 opposes angled surface 330 so that key pin 334 will be wedged between the two surfaces to force fingers 324 and 326 away from each other as depicted in FIG. 35. As best seen in FIGS. 27–29, holder 300 includes two pairs of first and second locking fingers 324, 326 disposed on opposite members 312 and 314 so that holder 300 includes a total of eight locking fingers.

First and second members 312 and 314 have cup-shaped portions that cooperate to form a compartment 339 sized to hold a variety of different types of EAS tags 318. Compartment 339 may be elongated or in the shape of a broad, flat square to hold a RF-type EAS tag. Compartment 339 is substantially inaccessible from the exterior of holder 300 so that a shoplifter cannot tamper with EAS tag 318.

First and second members 312 and 314 define a slot 341 that accepts item of merchandise or substrate 40 so that tooth 320 may engage and lock substrate 40 to holder 300 as described above with respect to the first and second embodiments of the invention. Members 312 and 314 may be integrally molded with fingers 324 and 326 to decrease the cost of manufacturing holder 300.

Figure 33:
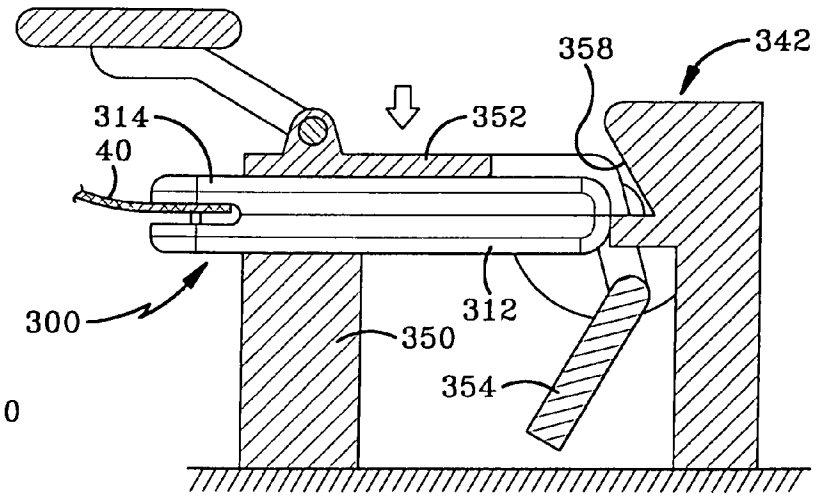
FIG. 33 is a view similar to FIG. 30 showing the opener unlocking the EAS tag holder.
Figure 30:
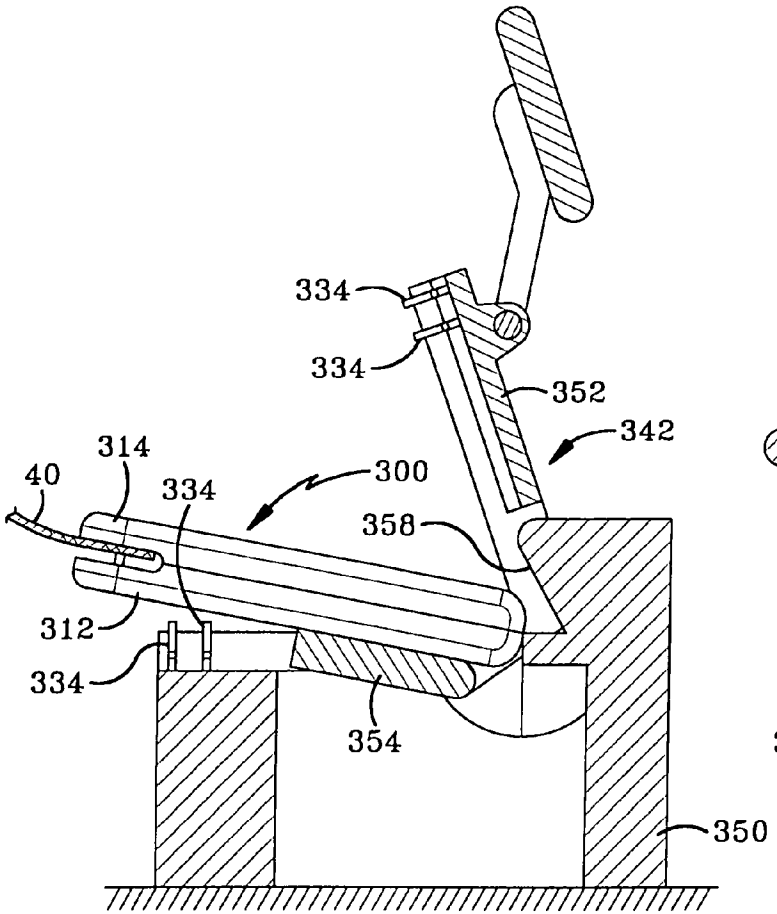
FIG. 30 is a section view of the eighth embodiment of the EAS tag holder being placed in one embodiment of an opener.
Figure 31:
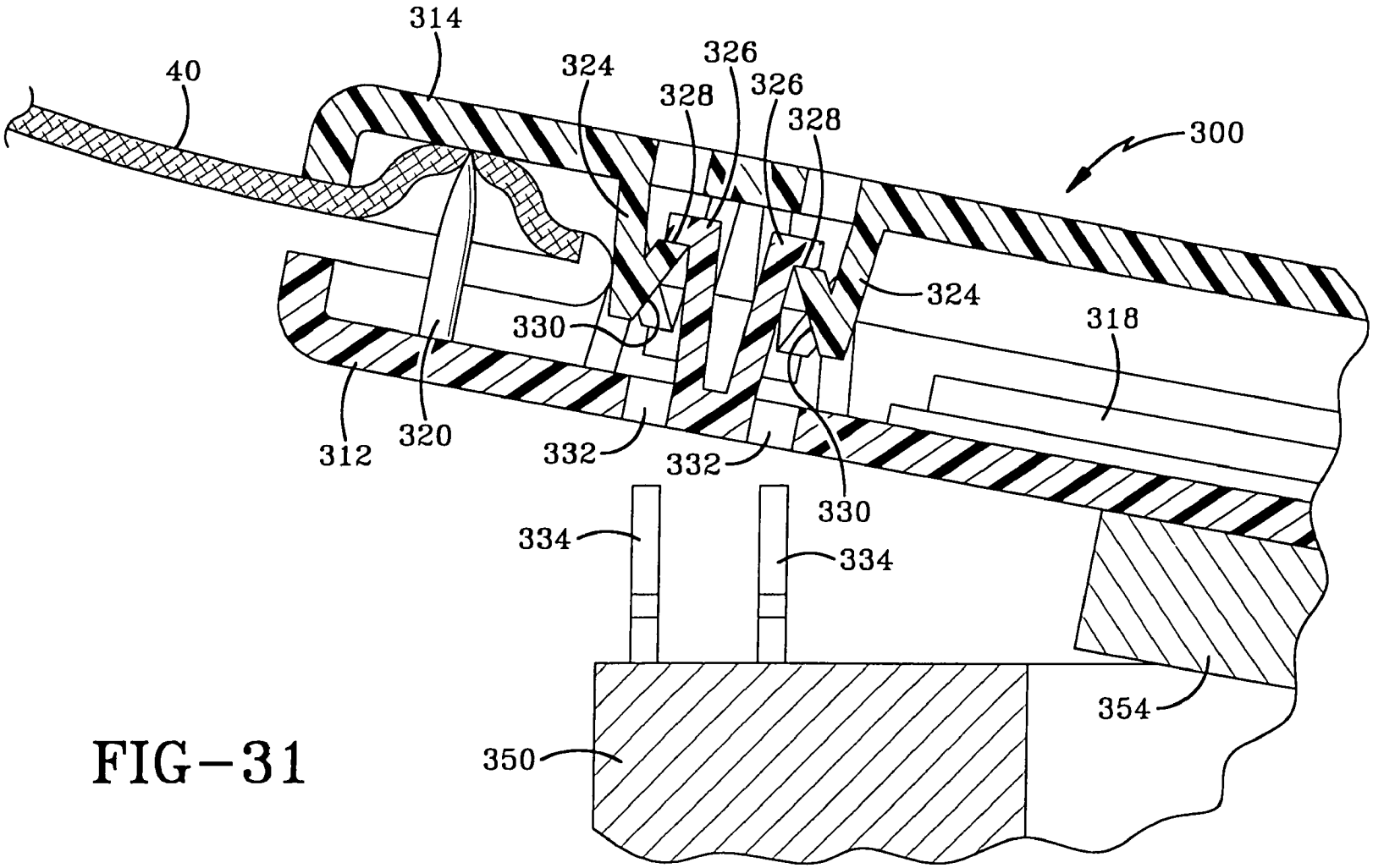
FIG. 31 is an enlarged section view of the locking fingers of the eighth embodiment being aligned with the key pins.
Figure 32:
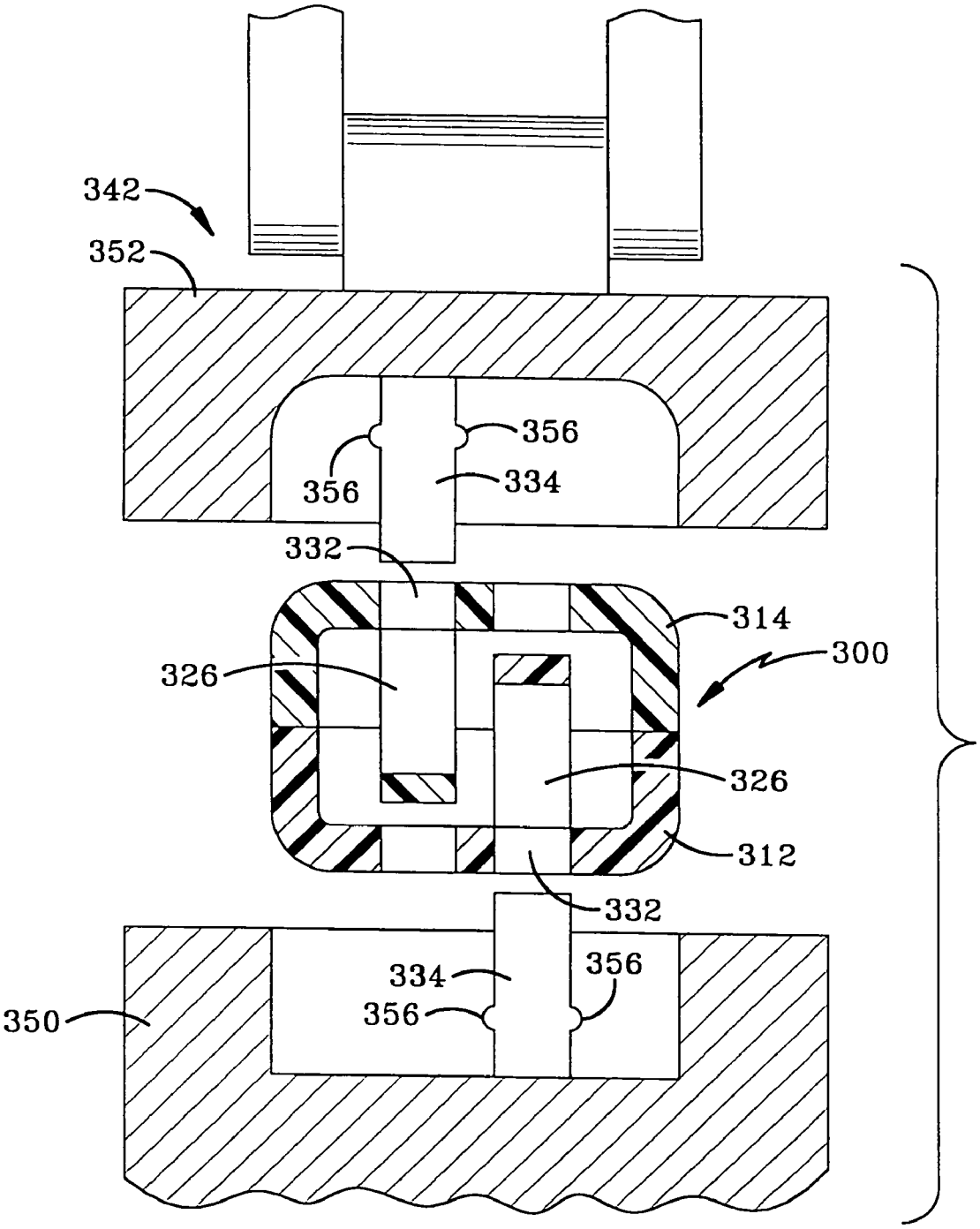
FIG. 32 is an end view of the locking fingers aligned with the key pins.
Figure 34:
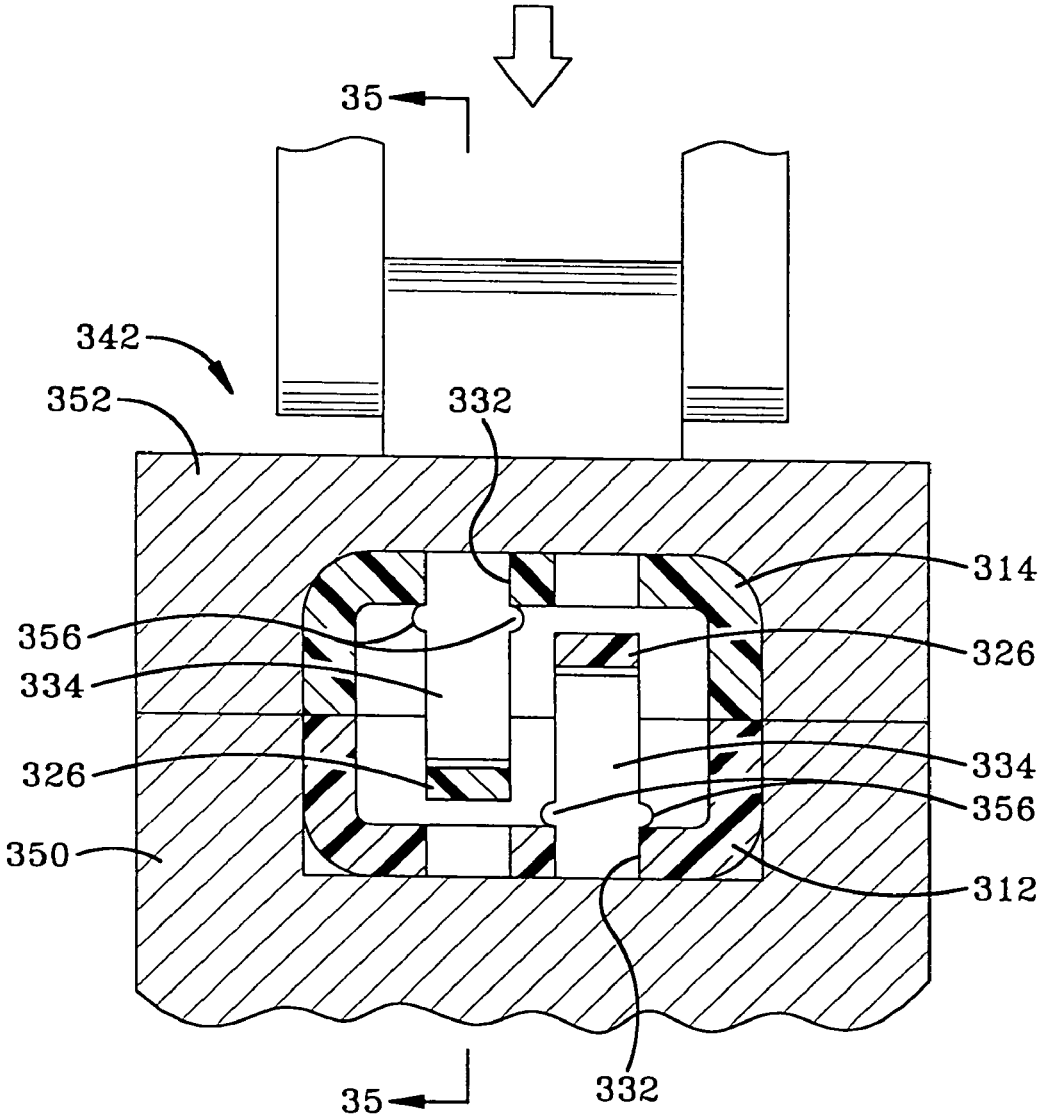
FIG. 34 is an end view similar to FIG. 32 showing the key pins interacting with the locking fingers to move the fingers to the unlocked position.

EAS tag holder 300 may be opened by inserting key pins 334 into openings 332 to unlock fingers 324 and 326 so that members 312 and 314 may be pivoted away from each other. One type of opener 342 is depicted in FIGS. 30–36. Opener 342 includes a base 350 and a pivoting member 352. A pair of key pins 334 project upwardly from base 350 and a pair of key pins 334 project downwardly from pivoting member 352. Opener 342 functions by placing holder 300 in a cradle 354 that moves with pivoting member 352. Pivoting member 352 is then pivoted downwardly towards base 350 until holder 300 is pushed down onto key pins 334 of base 350. Key pins 334 attached to pivoting member 352 are then pushed down through the top of holder 300 and cradle 354 moves downwardly out of contact with holder 300. This position is depicted in FIG. 33.

Figure 36:
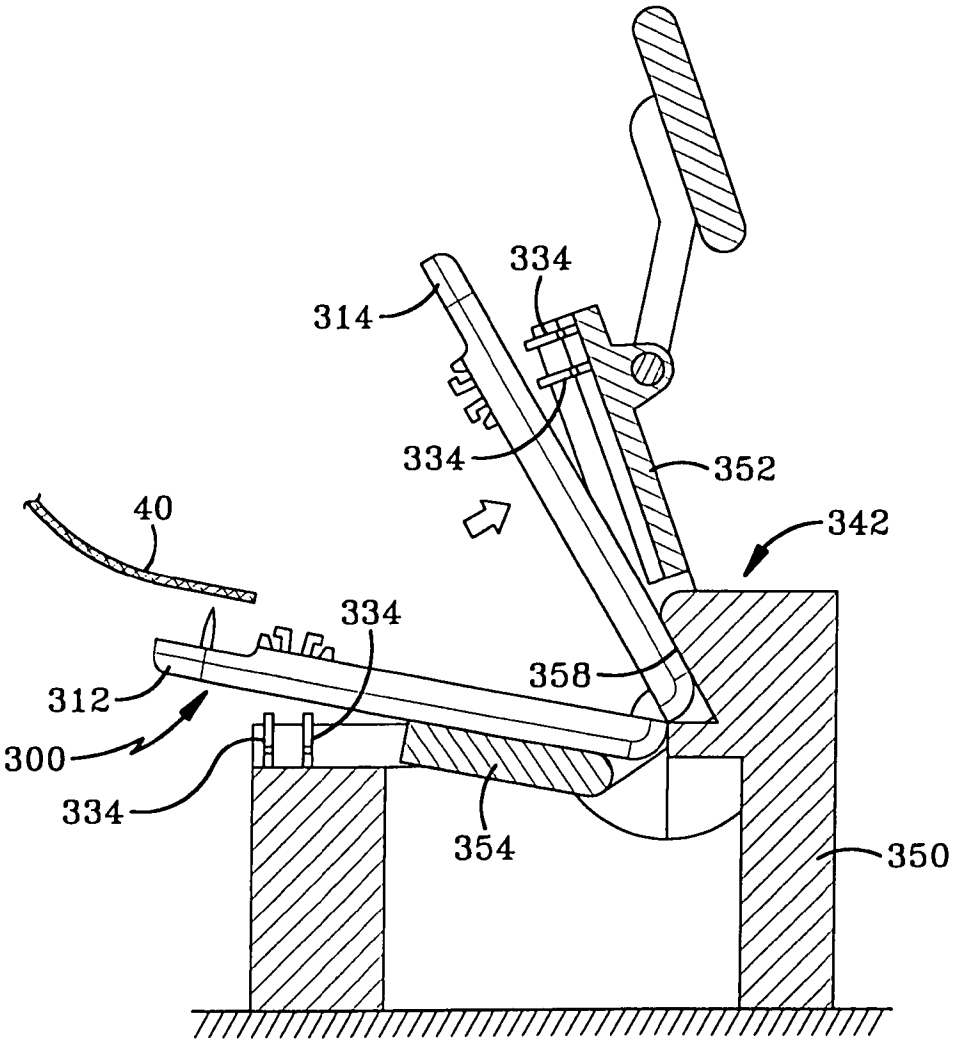
FIG. 36 is a view similar to FIG. 30 showing the eighth embodiment of the EAS tag holder in an open position with the item of merchandise being removed.

Each key pin 334 includes projections 356 that snap into holder 300 to allow h older 300 to be opened by opener 342. Once holder 300 is in the unlocked but closed position depicted in FIG. 33, the user lifts pivoting member 352 as depicted in FIG. 36 so that member 314 is pulled upwardly away from member 312 to open holder 300. Member 314 continues to pivot away from member 312 until cradle 354 engages member 312 to lift it off of key pins 334 of base 350. At approximately the same time, member 314 engages stop 358 to hold it in position while pins 334 of pivoting member 352 are pulled out of member 314 to disengage holder 300 from opener 342. Substrate 40 may then be removed from holder 300 and holder 300 may be discarded or reused if desired.

The second embodiment of the opener used with holder 300 is depicted in FIGS. 37–41. Opener 344 functions by breaking locking fingers 324 and 326 so that members 312 and 314 may be opened as described above. Once fingers 324 and 326 are broken, holder 300 must be discarded.

Figure 39:
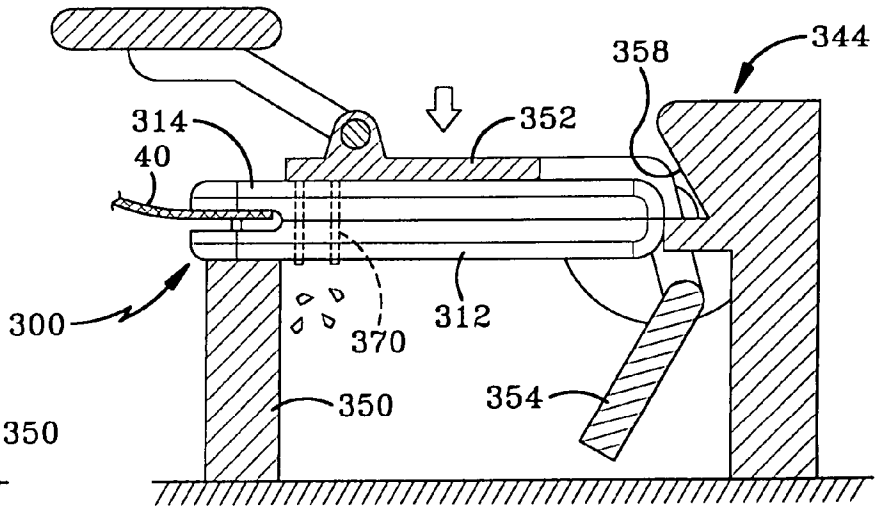
FIG. 39 is a view similar to FIG. 37 showing the opener breaking the locking fingers of the EAS tag holder.
Figure 37:
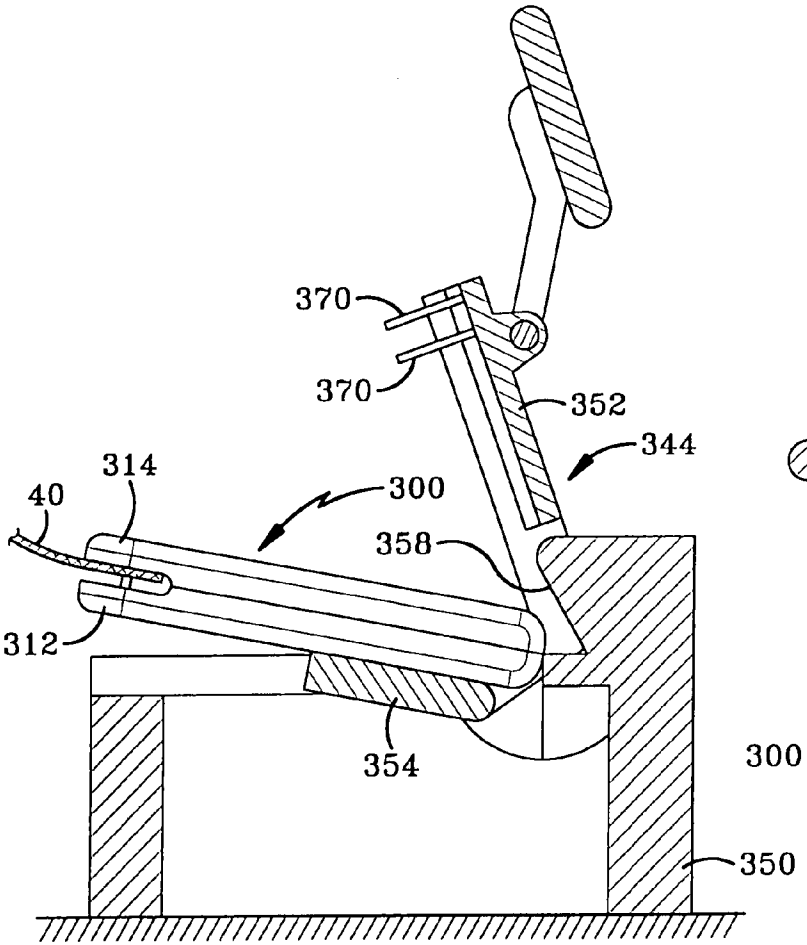
FIG. 37 is a view similar to FIG. 30 showing a second embodiment of the opener.
Figure 38:
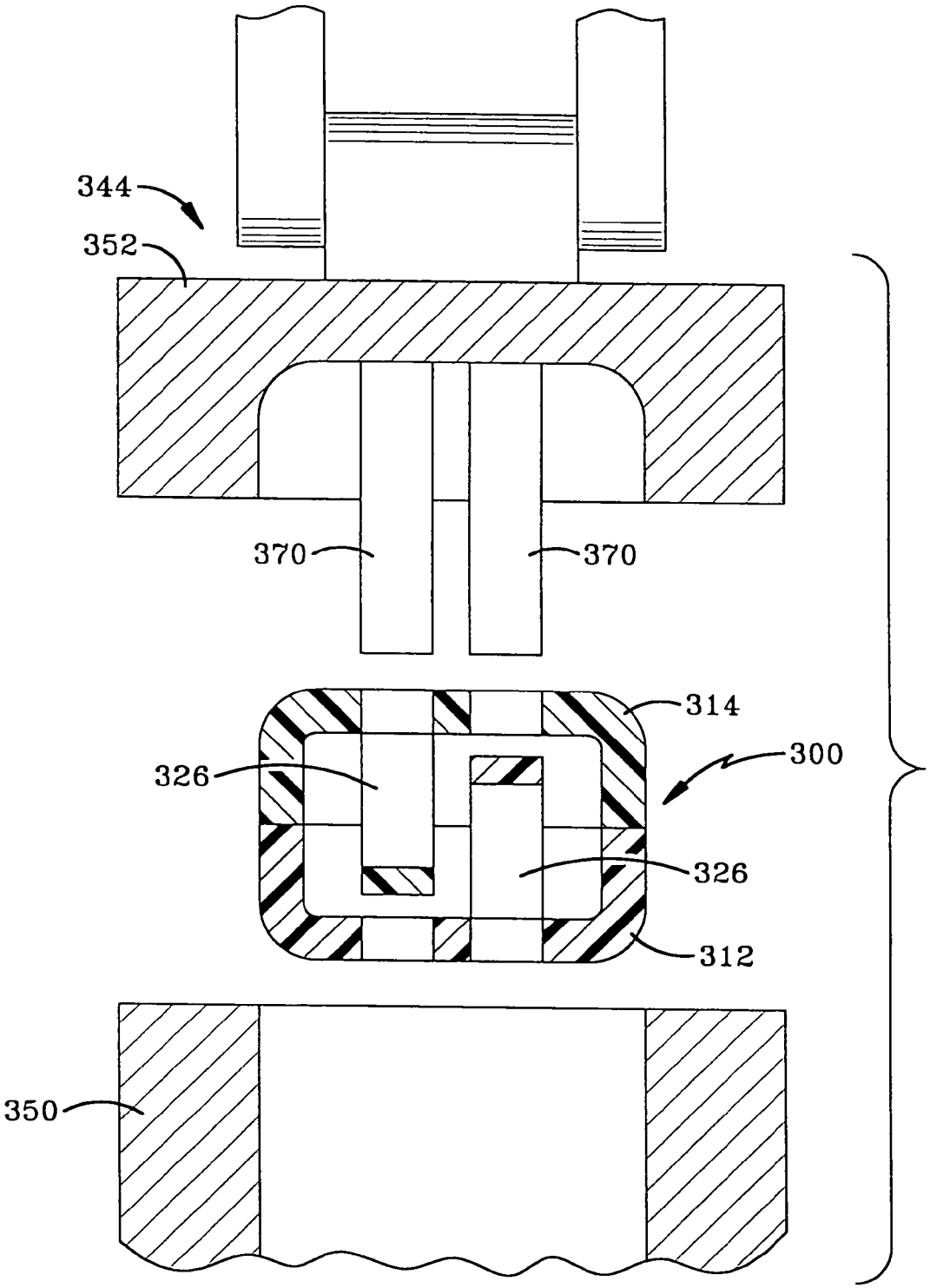
FIG. 38 is an exploded end view showing the locking fingers of the eighth embodiment of the disposable EAS tag aligned with the key pins of the opener.
Figure 40:
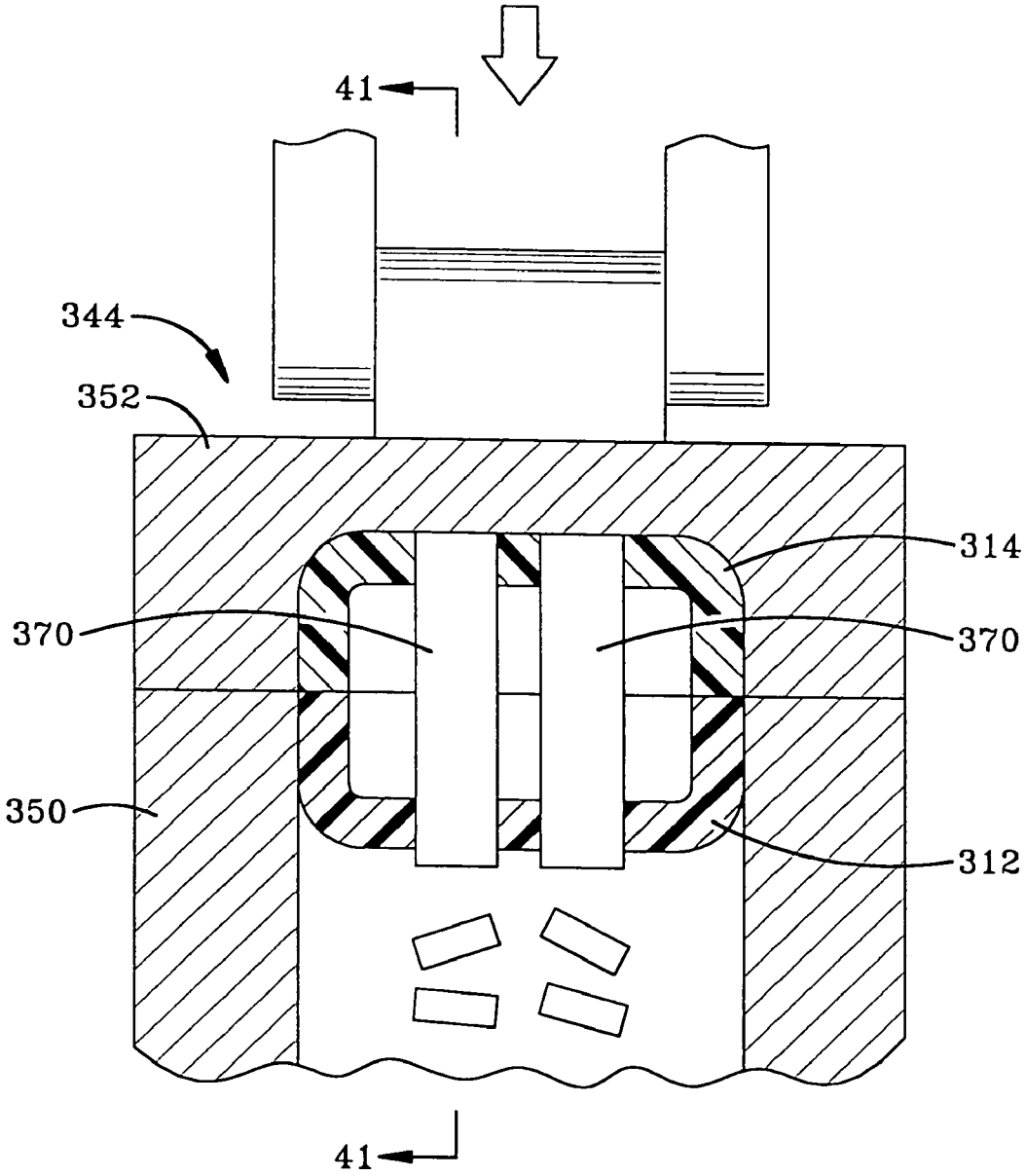
FIG. 40 is a view similar to FIG. 38 showing the opener breaking the locking fingers of the EAS tag holder.
Figure 41:
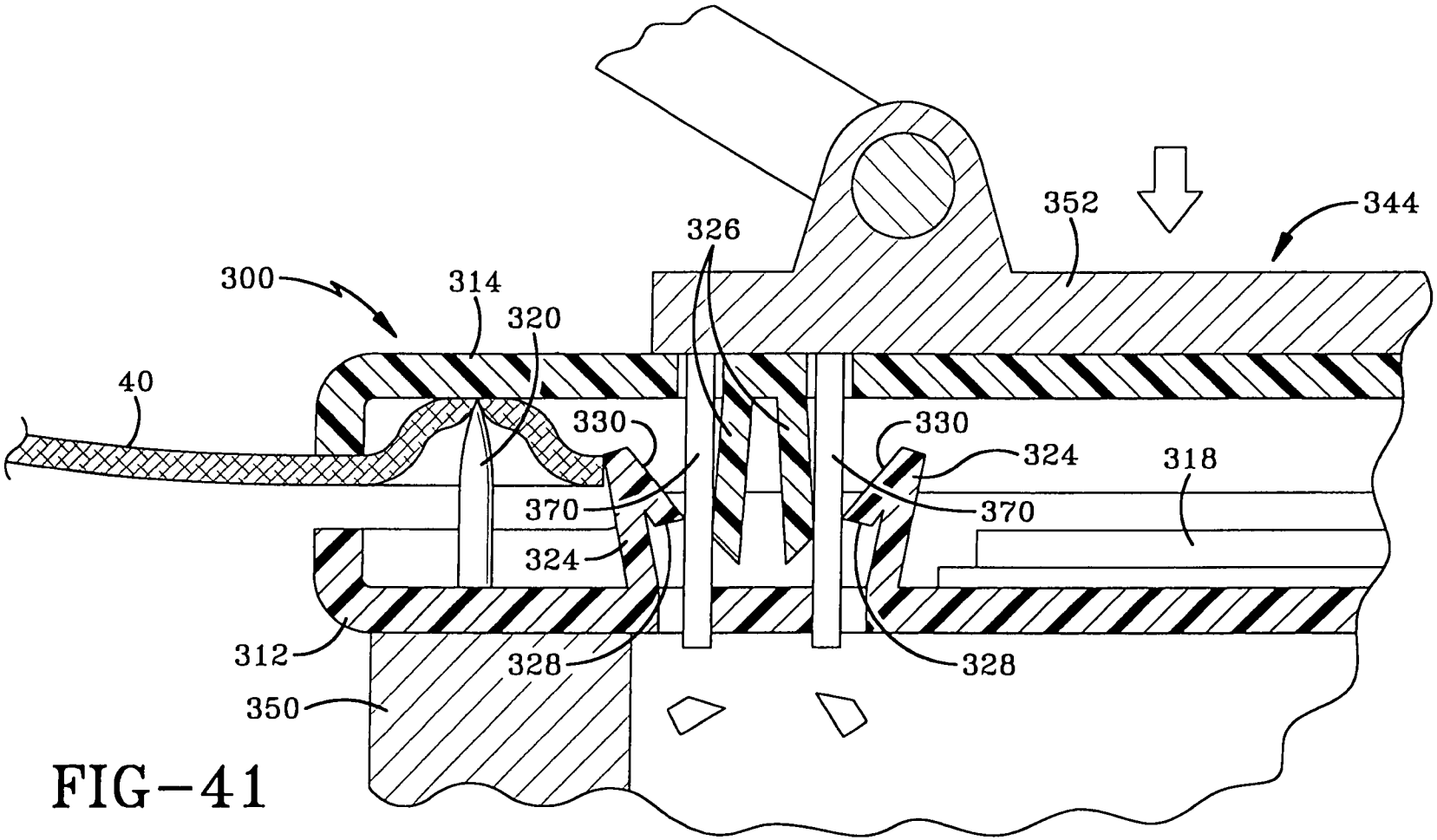
FIG. 41 is a section view taken along line 41—41 of FIG. 40.
Figure 42:
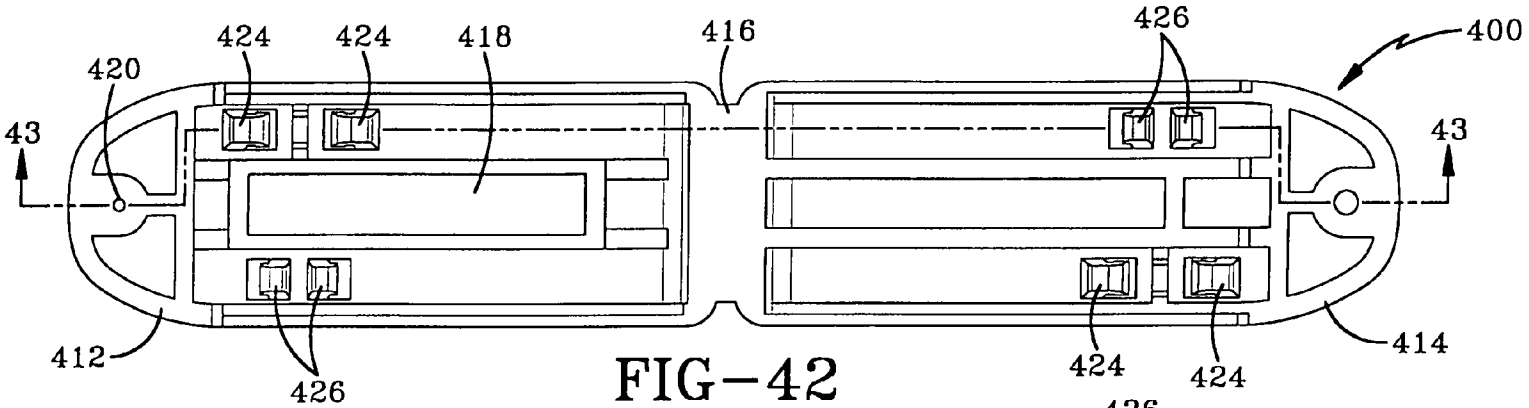
FIG. 42 is a plan view of the inside of the ninth embodiment of the EAS tag holder in an open condition.
Figure 43:
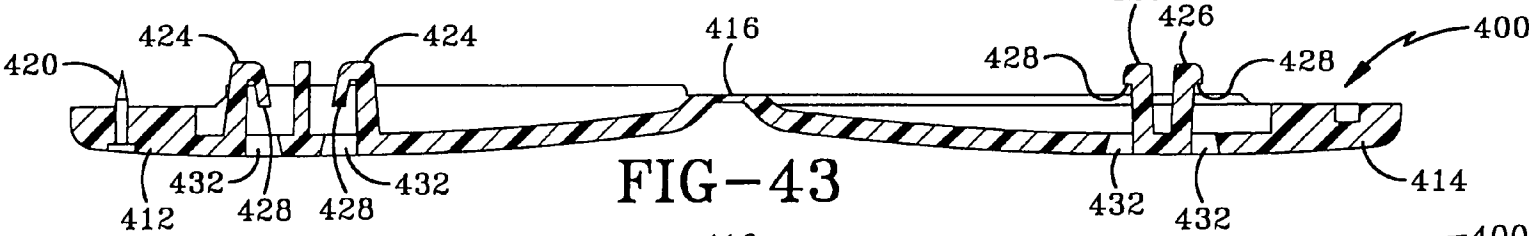
FIG. 43 is a section view taken along line 43—43 of FIG. 42.
Figure 44:
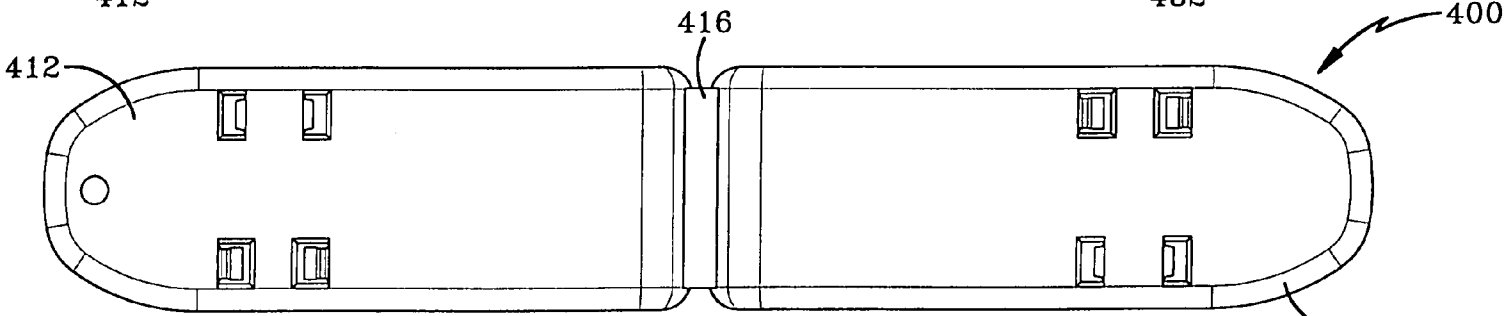
FIG. 44 is a plan view of the outside of the ninth embodiment of the invention.
Figure 45:
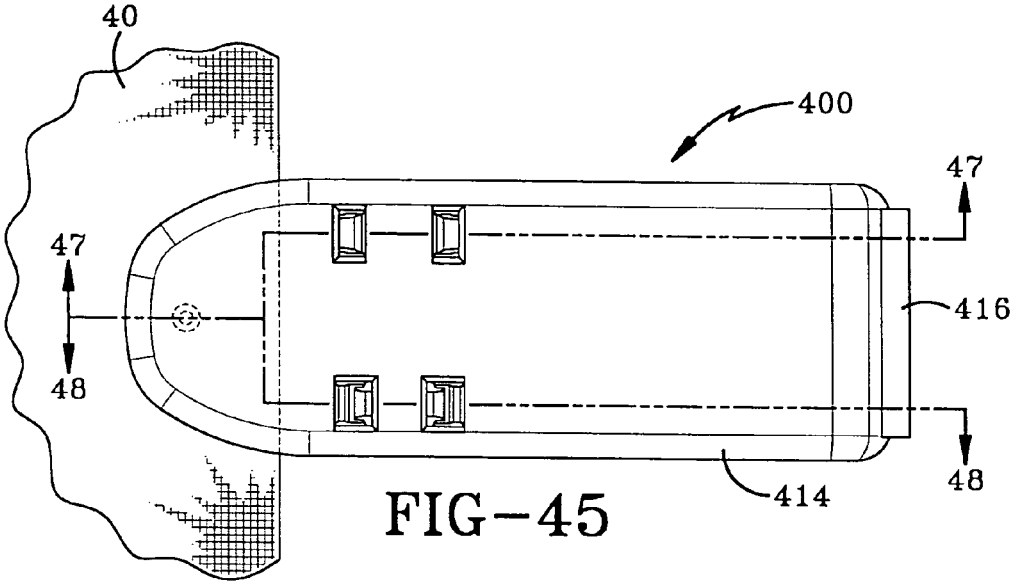
FIG. 45 is a plan view of the ninth embodiment of the EAS tag holder locked to a substrate.
Figure 46:
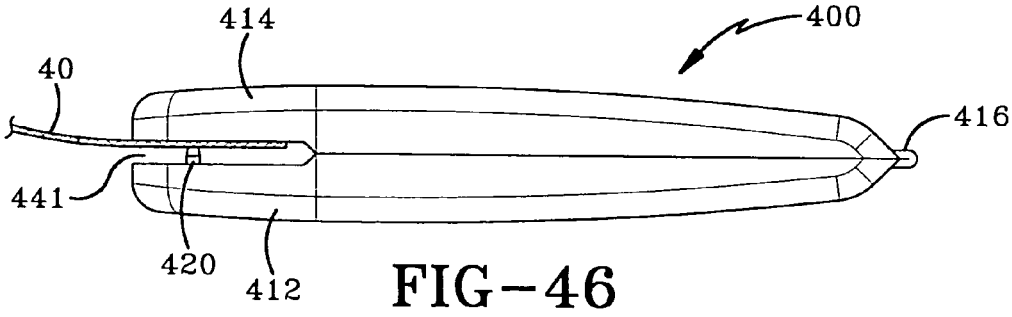
FIG. 46 is a side view of FIG. 45.
Figure 47:
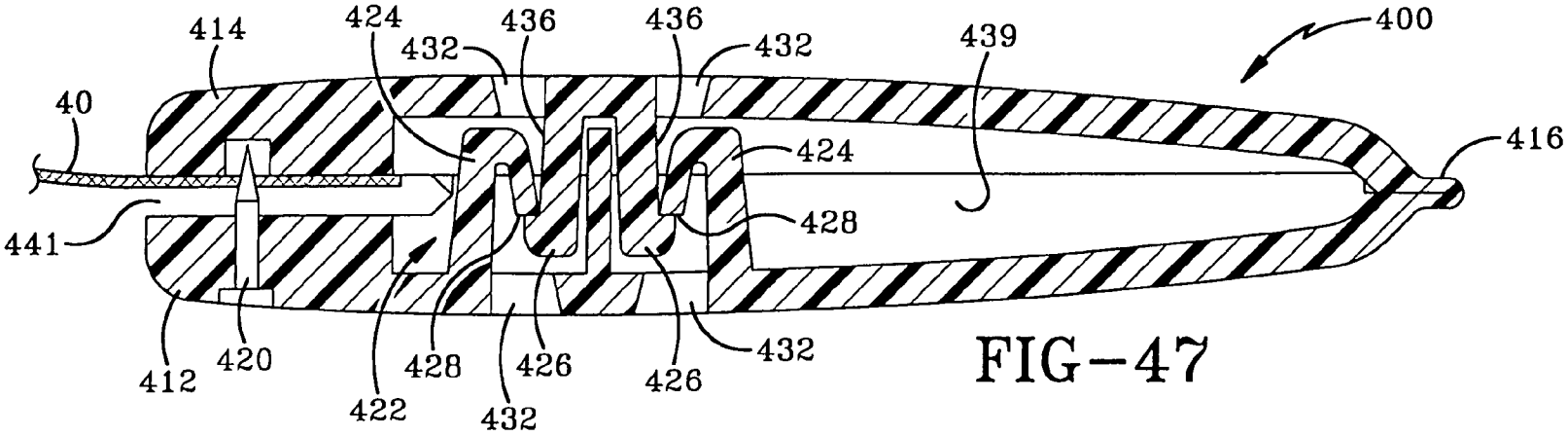
FIG. 47 is a section view taken along line 47—47 of FIG. 45.
Figure 48:
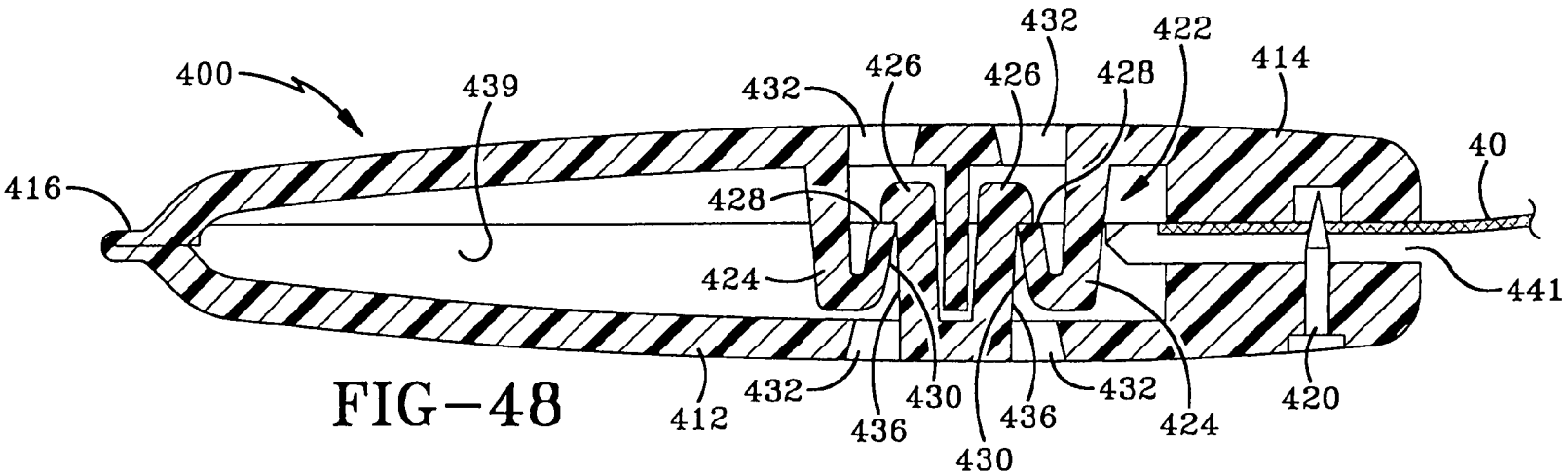
FIG. 48 is a section view taken along line 48—48 of FIG. 45.

Opener 344 may include the same elements as opener 342 described above. One change is that key pins 334 projecting from base 350 are removed and the key pins projecting down from pivoting member 352 are longer than the thickness of holder 300 as depicted in FIGS. 39, 40, and 41. The long key pins are referred to by numeral 370. Key pins 370 project down from pivoting member 352. Key pins 370 are designed to engage fingers 324 and 326 and break portions of fingers 324 and 326 so that members 312 and 314 are no longer locked together by fingers 324 and 326. The debris from the broken fingers may be held within members 312 and 314 or may be pushed out of key openings 332 as depicted in FIGS. 39 and 40.

The ninth embodiment of the EAS tag holder of the present invention is indicated generally by the numeral 400 in FIGS. 42–54. EAS tag holder 400 generally includes first and second members 412 and 414 connected together by a hinge 416. Hinge 416 may be a living hinge that hingedly connects members 412 and 414 between an open, unlocked position and a closed, locked position. Hinge 416 may also be a multi-component hinge.

EAS tag holder 400 functions by securely holding an EAS tag 418 between members 412 and 414 where it cannot be accessed when members 412 and 414 are in the locked position. EAS tag holder 400 includes a tooth 420 that secures EAS tag holder 400 to substrate 40 as described above. EAS tag holder 400 may thus be locked to substrate 40 in order to secure an EAS to substrate 40 such that an alarm will sound if substrate 40 is removed from a retail establishment having monitoring devices. EAS tag holder 400 is designed to be removed by the store clerk at the retail establishment before the retail customer leaves the retail establishment. EAS tag holder 400 may be removed with an opener similar to opener 342 (FIG. 30) that allows EAS tag holder 400 to be reused or an opener 344 (FIG. 37) that breaks EAS tag holder 400. When opener 344 is used, EAS tag holder 400 is discarded after it is removed from substrate 40.

Members 412 and 414 are locked together with a locking mechanism 422 that generally includes two sets of first 424 and second 426 locking finger pairs. Each member 412 and 414 supports a pair of first locking fingers 424 and a pair of second locking fingers 426. Locking fingers 424 on member 412 are configured to lock with fingers 426 on member 414 when members 412 and 414 are moved from the open position to the closed position to close EAS tag holder 400 over item of merchandise 40. Simultaneously, locking fingers 424 on member 414 are configured to lock with fingers 426 on member 412. Each locking finger 424 and 426 includes a locking surface 428 that prevents fingers 424 and 426 from separating from one another once they are in the locked position depicted in FIGS. 47 and 48. Each locking surface 428 is substantially perpendicular to the longitudinal centerline of key opening 432. Each surface 428 is also substantially perpendicular to the direction that members 412 and 414 initially move when holder 400 is opened.

Each first locking finger 424 includes a first angled portion that projects outwardly away from member 412 or 414. Each first locking finger 424 also includes a second portion that projects downwardly back towards member 412 or 414 to form a V-shaped locking finger that includes an angled surface 430 that is aligned with a key opening 432 that allows a key pin to enter holder 400 and engage first locking fingers 424.

Second locking fingers 426 also include an angled surface 436 that is aligned with openings 432. Angled surface 436 opposes angled surface 430 so that the key pin will be wedged between the two surfaces to force fingers 424 and 426 away from each other.

On each member 412 and 414, fingers 424 and 426 are disposed on opposite sides of the compartment that holds EAS tag 418. EAS tag 418 is thus positioned between the locked fingers 424 and 426 and the overall length of holder 400 may be designed to be larger than the length of EAS tag 418 by the length of hinge 416 and the length of the jaws of holder 400.

First and second members 412 and 414 have portions that cooperate to form a compartment 439 sized to hold a variety of different types of EAS tags 418. Compartment 439 may be elongated or in the shape of a broad, flat square to hold a RF-type EAS tag. Compartment 439 is substantially inaccessible from the exterior of holder 400 so that a shoplifter cannot tamper with EAS tag 418.

The jaws of first and second members 412 and 414 define a slot 441 that accepts item of merchandise or substrate 40 so that tooth 420 may engage and lock substrate 40 to holder 400 as described above with respect to the first and second embodiments of the invention. Members 412 and 414 may be integrally molded with fingers 424 and 426 to decrease the cost of manufacturing holder 400.

Figure 49:
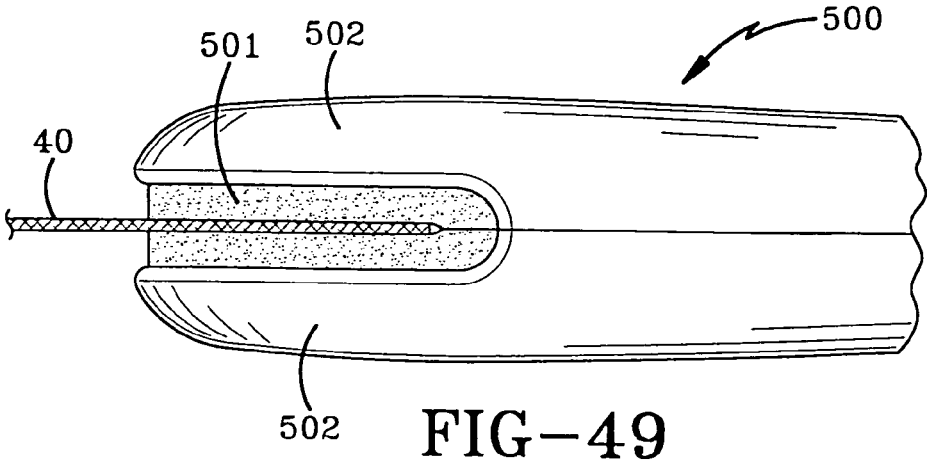
FIG. 49 is a side view of a tenth alternative embodiment of the EAS tag holder.

FIG. 49 depicts a tenth embodiment of the invention wherein a soft, compressible filler material 501 is used between the jaws 520 of the holder 500. Filler material 501 may be a foam or a cloth that protects that section of substrate 40 when holder 500 is installed. In the tenth embodiment of the invention, the tooth is used in conjunction with filler 501. Filler 501 simply clamps the section of substrate 40 adjacent the tooth so that the tooth does not tear substrate 40.

Figure 50:
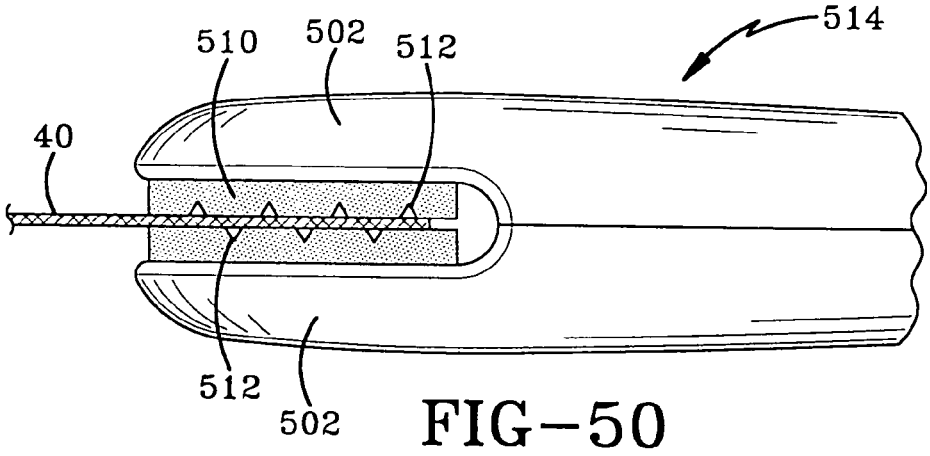
FIG. 50 is a side view of a eleventh alternative embodiment of the EAS tag holder.

In the eleventh embodiment of the invention depicted in FIG. 50, filler 510 is a hard, somewhat resilient material that clamps substrate 40 so that substrate 40 cannot be removed from jaws 502 without damaging substrate 40 or jaws 502. Filler 510 may be a hard rubber or plastic material than grips and clamps substrate 40. Numerous materials known to those skilled in the art may be used for filler 510. Filler 510 may define a series of notches 512 that define teeth edges that help filler 510 grip substrate 40. In other embodiments, a plurality of raised teeth, ribs, fingers, or small pins may extends from filler 510 to help filler 510 grip on substrate 40. In the eleventh embodiment of the invention, the holder 514 does not include the tooth that extends through substrate 40. Holder 514 is only held to substrate 40 by the frictional force between filler 510 and substrate 40.

Figure 51:
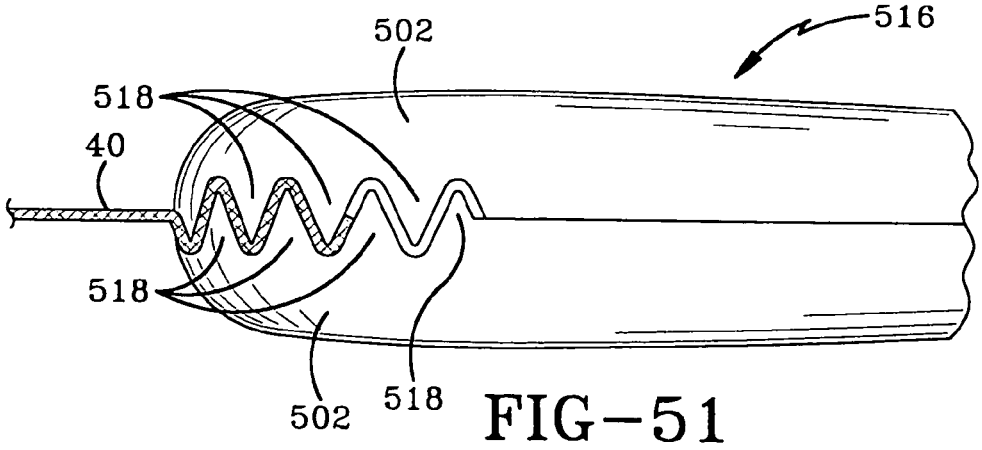
FIG. 51 is a side view of a twelve alternative embodiment of the EAS tag holder.

The twelfth embodiment of the holder is indicated by the numeral 516 in FIG. 51. In this embodiment, holder 516 lacks both the tooth and the filler. Instead, the gripping force is created by configured the opposing surfaces of jaws 502 as teeth 518 that grip substrate 40. Teeth 518 interlock to create a strong gripping force on substrate 40. Teeth 518 are fabricated from the same material as the body of holder 516. This material may be any of a variety of plastics or metals known in the art. Suitable plastics may be polycarbonate or fiber-filled polypropylene.

Figure 52:
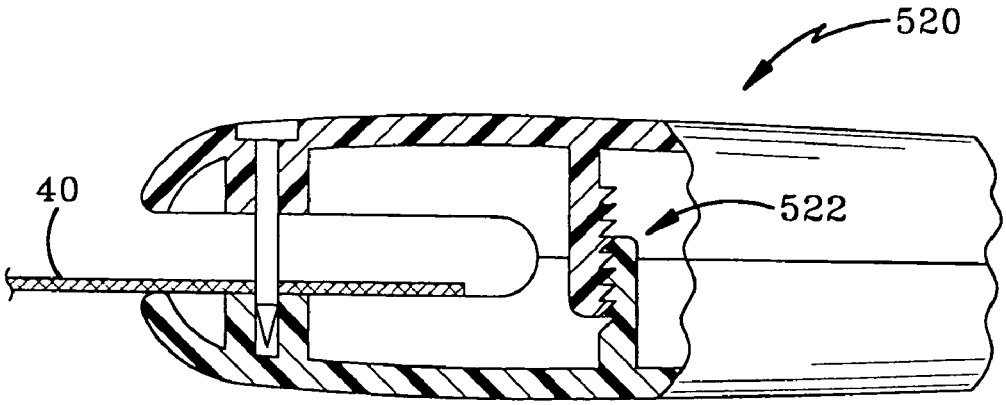
FIG. 52 is a side view, partially in section, of a thirteenth alternative embodiment of the EAS tag holder.

The thirteenth embodiment of the invention is indicated generally by the numeral 520 in FIG. 52. This embodiment of the holder includes a ratchet mechanism 522 that allows holder 520 to be used with substrates 40 having different thicknesses. Ratchet mechanism 522 includes a plurality of teeth disposed adjacent to each other to allow the different members of holder 520 to lock together in a variety of different positions. Ratchet mechanism 522 may be used in cooperation with any of the locking fingers described above including the locking fingers that may be unlocked and the locking fingers that lock until a portion of holder 520 is destroyed. Ratchet mechanism 522 may also be used in embodiments with or without the tooth that is connected to substrate 40.

Figure 53:
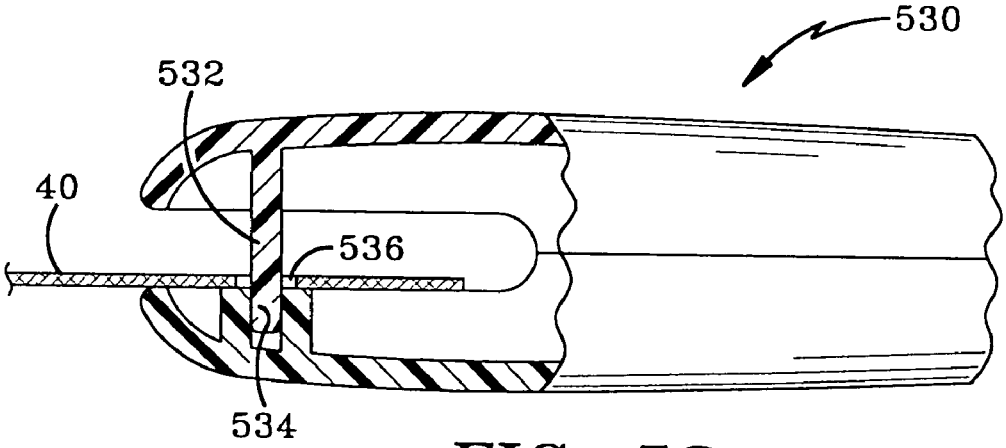
FIG. 53 is a side view, partially in section, of a fourteenth alternative embodiment of the EAS tag holder.

The fourteenth embodiment of the invention is indicated generally by the numeral 530 in FIG. 53. In this embodiment, tooth 532 has a rounded end 534 that cannot be pushed through tightly-woven substrates without tearing or stretching substrate 40. Tooth 532 may thus be used by retail establishments that wish to tag their merchandise without piercing a portion of the merchandise. In this embodiment, tooth 532 is disposed in an opening 536 that already exists in substrate 40.

The fifteenth embodiment of the EAS tag holder is indicated generally by the numeral 600 in FIGS. 54 to 64. EAS tag holder 600 generally includes first 612 and second 614 members that are connected together with a hinge 616. First 612 and second 614 are movable between the open, unlocked position of FIGS. 54–56 and the closed, locked position of FIGS. 57–59. Holder 600 may thus be attached to substrate 40 in the manner described above where the tooth 620 is used to attach holder 600 to substrate 40. Members 612 and 614 define a compartment 639 sized to receive an EAS tag 618.

Figure 55:
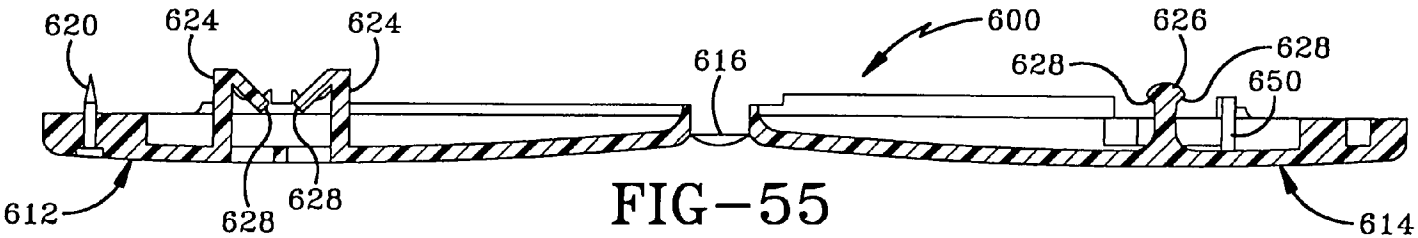
FIG. 55 is a section view taken along line 43—43 of FIG. 42.
Figure 60:
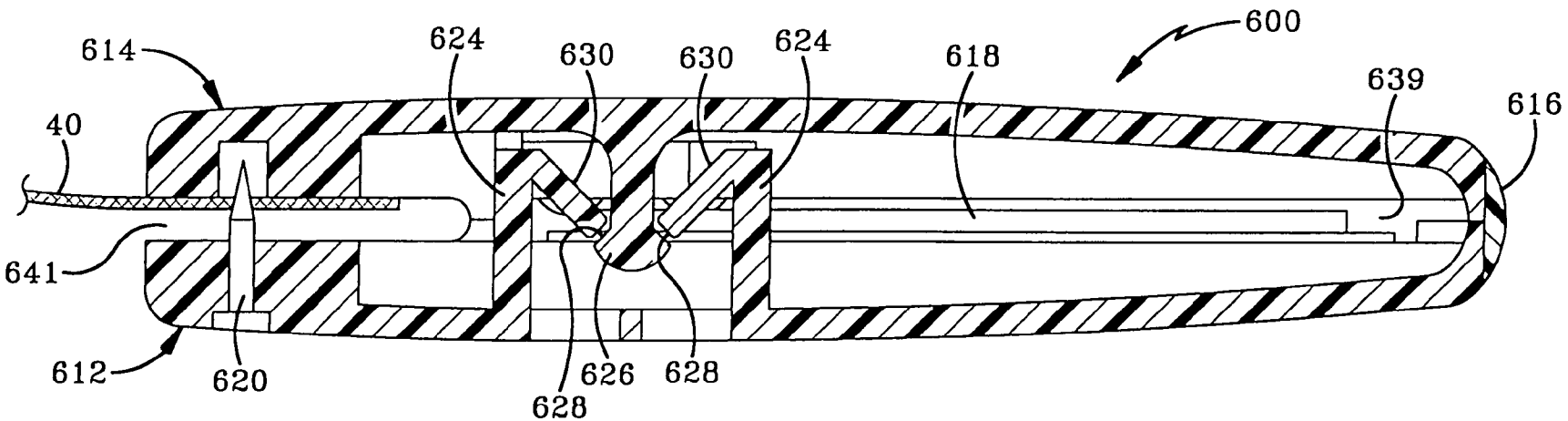
FIG. 60 is a section view taken along line 60—60 of FIG. 57.
Figure 61:
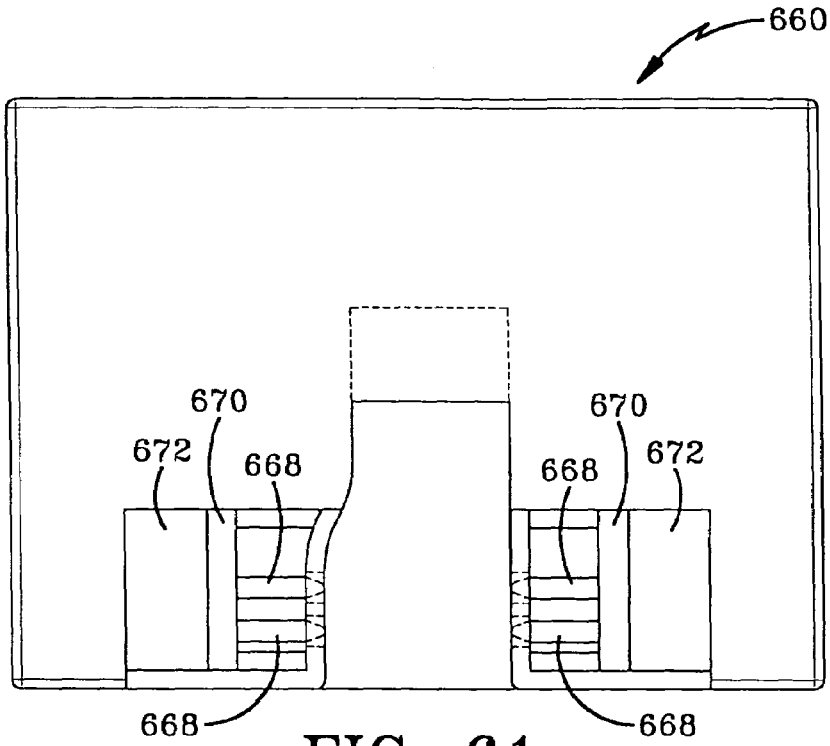
FIG. 61 is a top view of a key that is used to open the fifteenth embodiment of the EAS tag holder.

First locking fingers 624 are attached to member 612 and are configured to cooperate with second locking fingers 626 that are attached to member 614. In the exemplary embodiment of the invention depicted in the drawings, two pairs of locking fingers 624 are attached to first member 612 and a single pair of second locking fingers 626 are attached to second member 614. Each pair of first locking fingers 624 includes two individual first locking fingers 624 that include a first leg that extends away from member 612. In the exemplary embodiment, the first leg is perpendicular to first member 612 as shown in FIG. 55. Each first locking finger 624 also includes a second leg that extends from the first leg. In the exemplary embodiment, the second leg extends from the outer end of the first leg. The second leg extends back toward first member 612 as shown in FIG. 55. The outer end of the second leg forms a locking surface 628 that engages or is positioned immediately adjacent a locking surface 628 on second locking finger 626 when members 612 and 614 are in the closed and locked position as shown in FIG. 60. As also shown in FIG. 60, second locking finger 626 defines two locking surfaces 628 disposed on opposite sides of locking finger 626. First locking fingers 624 thus lock against opposite sides of second locking finger 626 so that second locking finger 626 cannot be moved in either direction (toward either locking finger 624) until both first locking fingers 624 are displaced to an unlocked condition.

In order to allow first locking fingers 624 to be moved to the unlocked position, each first locking finger 624 defines an angled surface 630 that is aligned with a key opening 632. Members 612 and 614 thus define four openings 632. In the exemplary embodiment, openings 632 are disposed at the edges of members 612 and 614 such that a portion of each opening is defined by each member 612 and 614. In other embodiments of the invention, each opening 632 may be entirely defined by one of members 612 or 614.

Each angled surface 630 is configured to cooperate with a key pin 668. When key pin 668 engages surface 630, first locking finger 624 is moved to the unlocked position and locking surfaces 628 disengage from each other to unlock holder 600. The arrangement of locking fingers 624 and 626 require two key pins 668 to be inserted simultaneously to unlock the pair of first locking fingers 624. With the two pairs of locking fingers 624 shown in the drawings, four key pins must be inserted simultaneously to unlock holder 600. Holder 600 is thus difficult for a shoplifter to "pick" because four locking fingers 624 must be moved to the unlocked position in order to open holder 600. Holder 600 thus remains locked when a shoplifter moves one or two locking fingers 624 to the unlocked position. Each finger 624 is sufficiently resilient to return to the locked position once key pin 668 is removed. Locking fingers 624 thus return to the locked condition when key pins 668 are removed. Unless all fingers 624 are in the unlocked condition at the same time (simultaneously in the unlocked position) holder 600 cannot be opened.

Another feature that increases the security of holder 600 is that key openings 632 are disposed on opposite sides of holder 600. The position of key openings 632 and locking fingers 624 require key pins 668 to move perpendicular to the longitudinal direction of holder 600. In this embodiment, key pins 668 must be disposed parallel to the hinge axis of holder 600. The hinge axis is the axis about which the first and second members 612 and 614 pivot with respect to each other. The position of openings 632 also requires key pins 668 to be forced inwardly toward each other in order to unlock holder 600. This configuration makes it difficult for a shoplift to "pick" holder 600 because the shoplifter must manipulate four key pins 668 in different directions from different sides of holder 600.

Hinge 616 is an elongated hinge that connects members 612 and 614 with a pair of spaced living hinges. The living hinges are parallel to each other and define two parallel hinge axes. In other embodiments, a hinge having a single axis may be used. Holder 600 also includes a blocking wall 650 that helps close compartment 639 when members 612 and 614 are locked.

Members 612 and 614 of holder 600 have a non-symmetric outer shape. The shape helps position holder 600 in a key 660. The shape only allows holder 600 to be inserted correctly into key 660. In the exemplary embodiment of the invention, holder 600 is non-symmetric about its longitudinal axis. In other embodiments, holder 600 may be non-symmetric along other axes.

Figure 54:
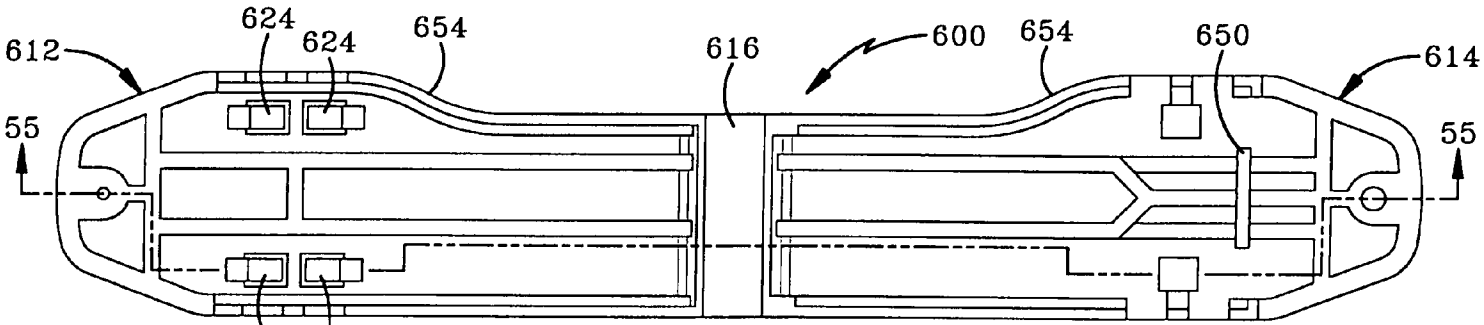
FIG. 54 is a plan view of the inside of the fifteenth embodiment of the EAS tag holder in an open condition.
Figure 56:
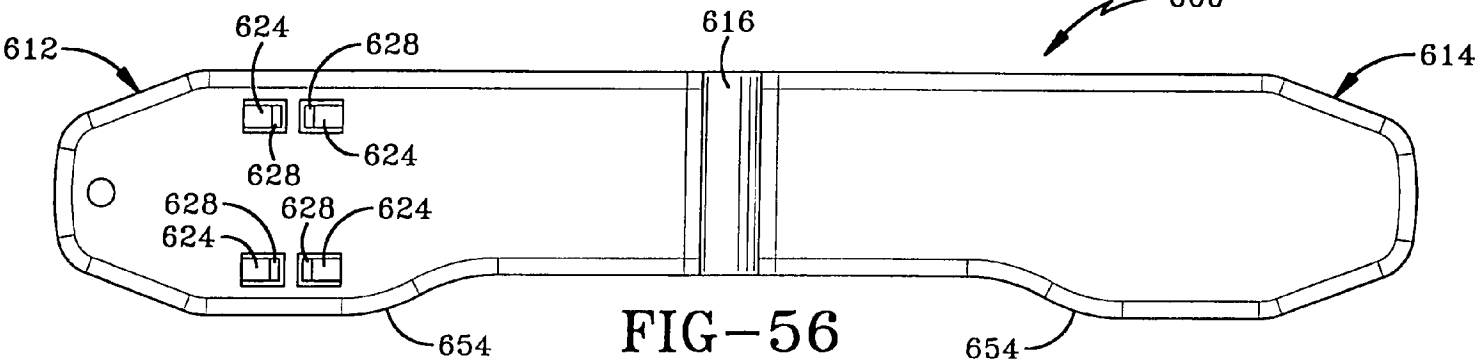
FIG. 56 is a plan view of the outside of the fifteenth embodiment of the invention.
Figure 57:
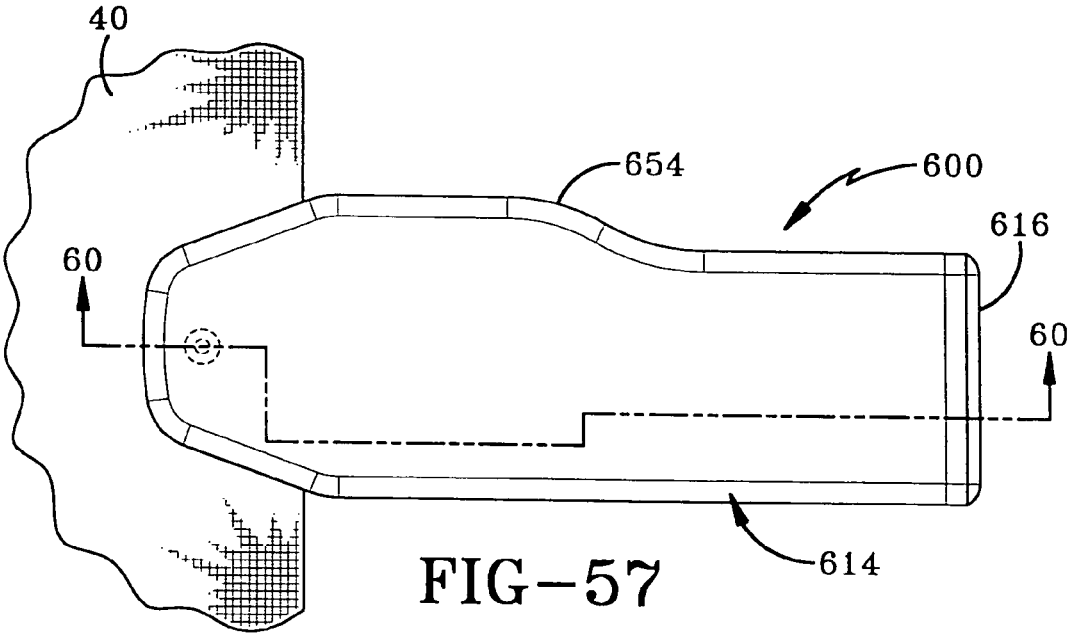
FIG. 57 is a top view of the EAS tag holder of FIG. 54 in a position locked to an item of merchandise.
Figure 58:
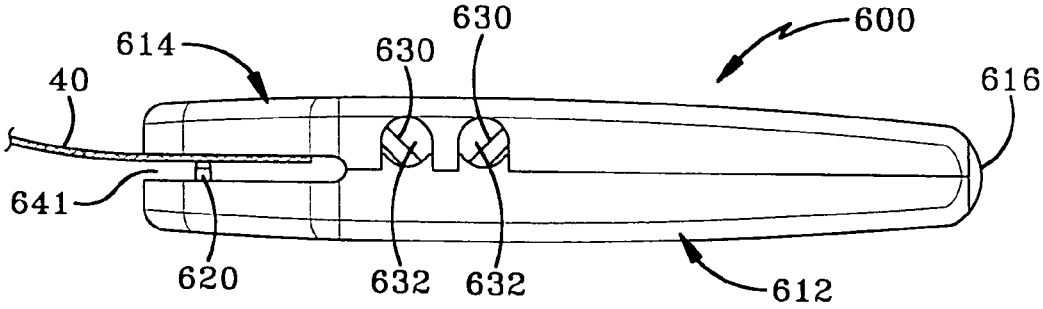
FIG. 58 is a side view of FIG. 57.
Figure 59:
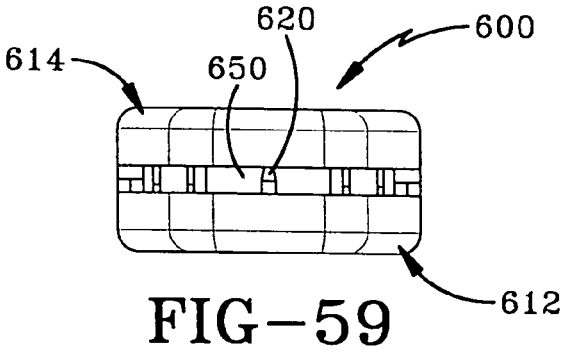
FIG. 59 is a front view of the EAS tag holder with the item of merchandise removed to show the blocking wall of the holder.

Each member 612 and 614 defines a projection 654 that makes members 612 and 614 non-symmetric. In the exemplary embodiment of the invention, projections 654 extend from the side of holder 600 as shown in FIGS. 54 and 56.

Figure 62:
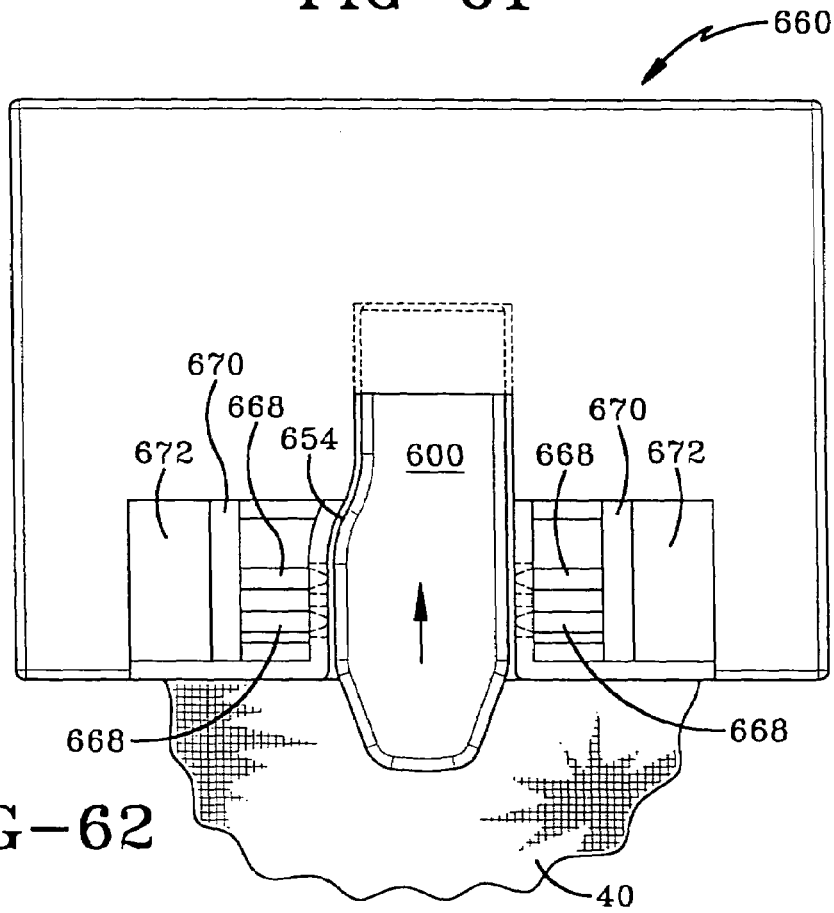
FIG. 62 is a view similar to FIG. 61 with the EAS tag holder inserted into a position where it can be unlocked.
Figure 63:
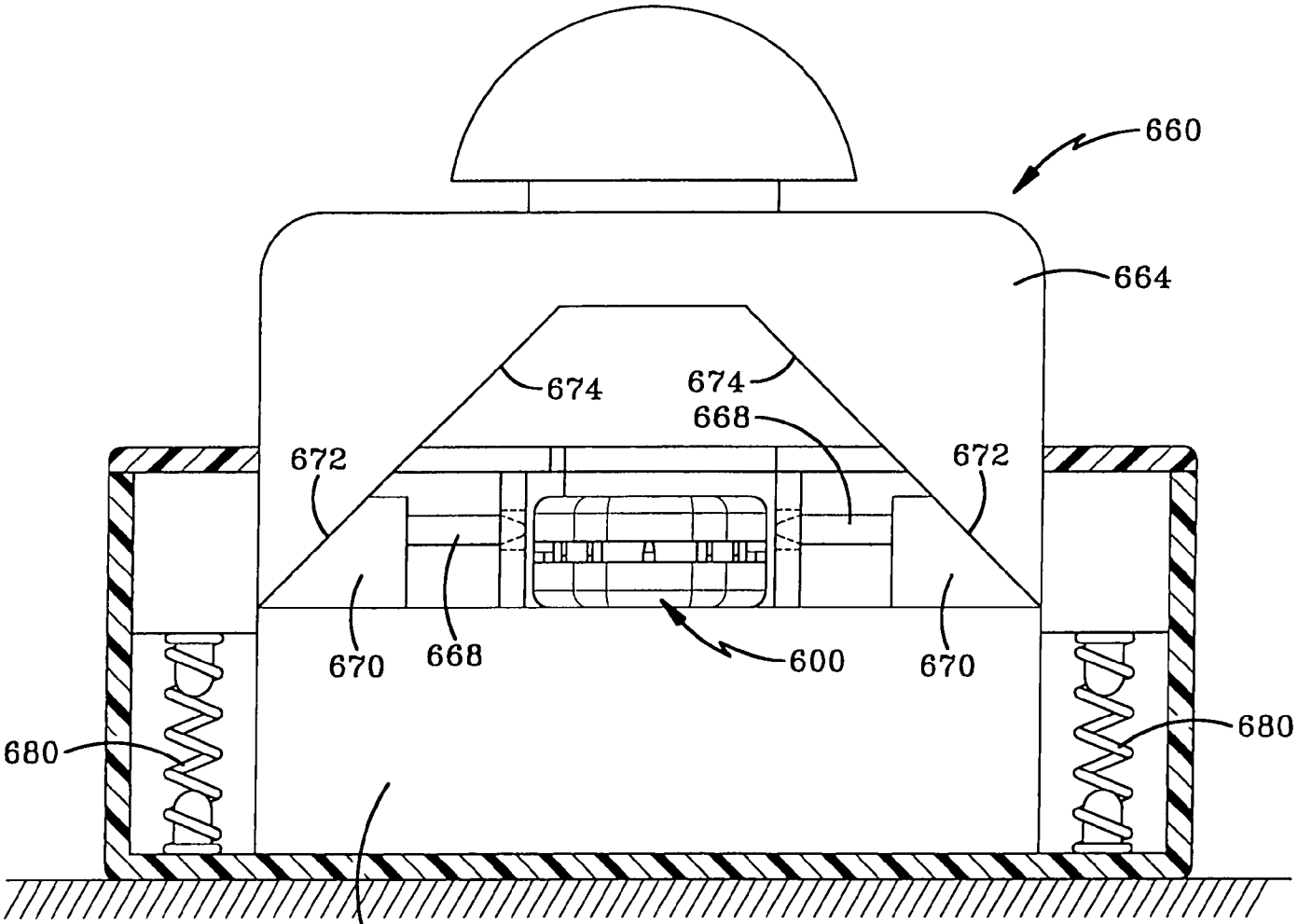
FIG. 63 is a front view, partially in section, of the key with the EAS tag holder inserted into a position where it can be unlocked.
Figure 64:
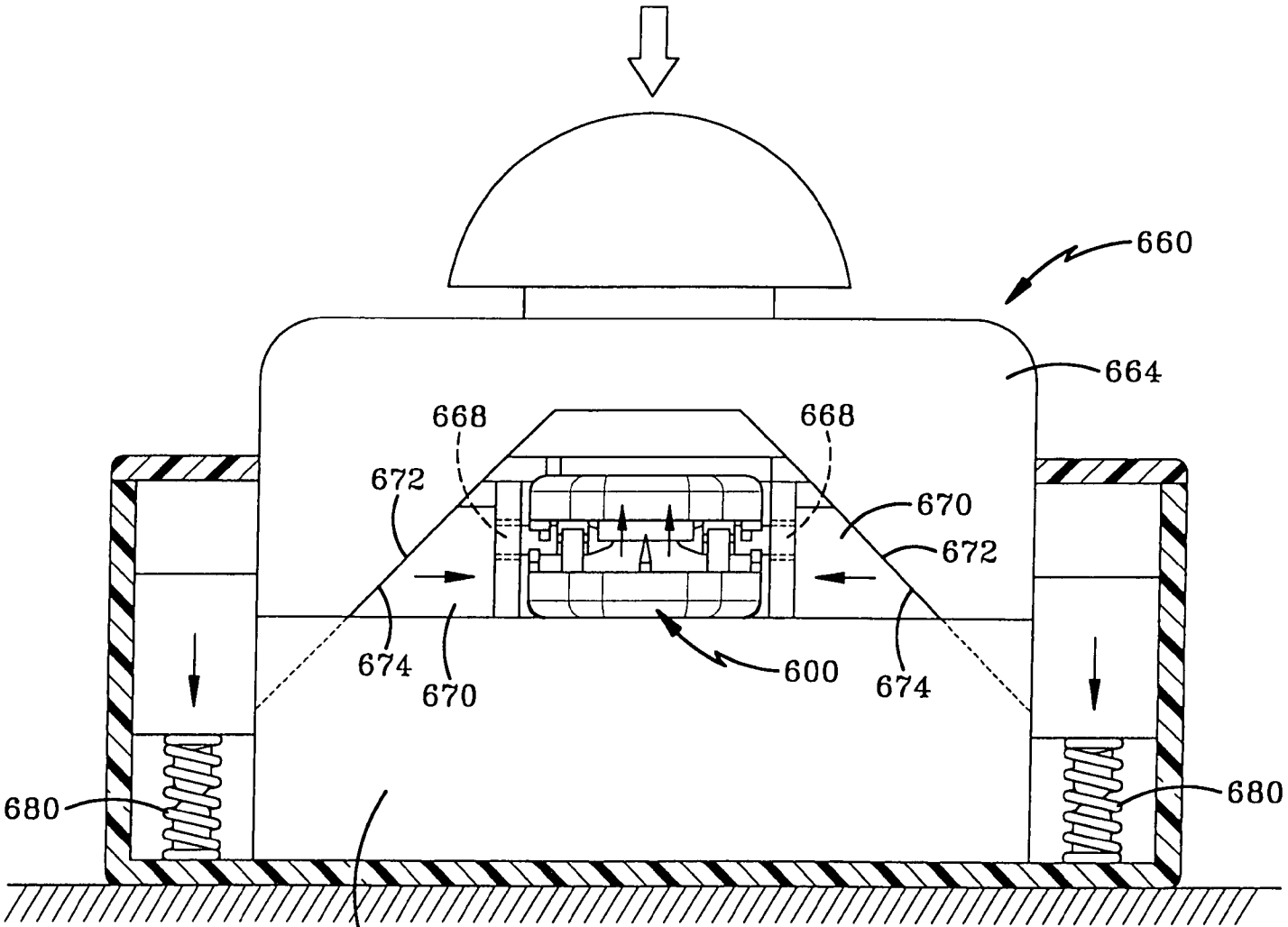
FIG. 64 is a front view, partially in section, of the key depressed to insert the key pins into the EAS tag holder to unlock the EAS tag holder.
Figure 65:
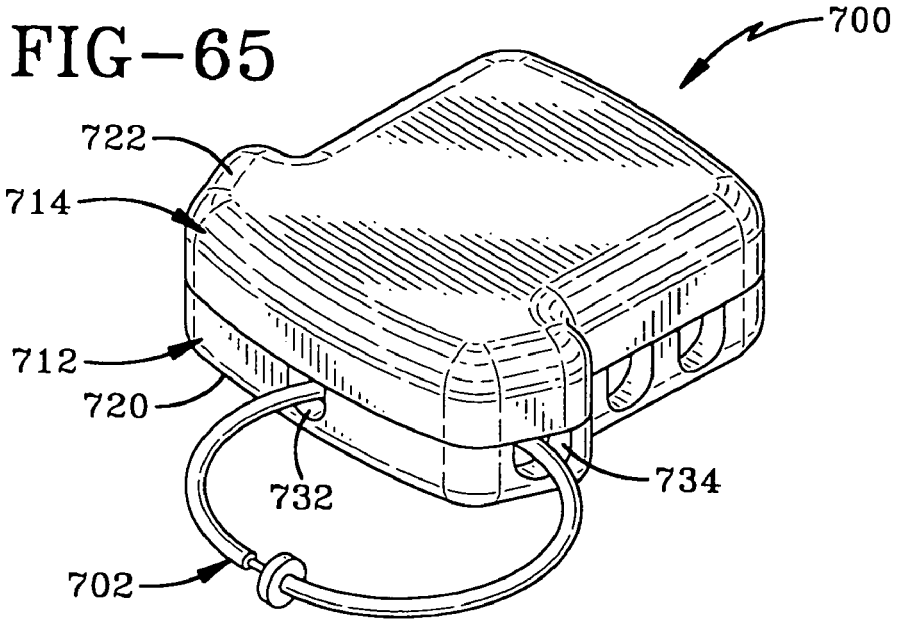
FIG. 65 is a perspective view of a sixteenth embodiment of the EAS tag holder that may also be used without an EAS tag to deter theft.

Key 660 includes an opening that is configured to receive holder 600 in a position where each opening 632 is aligned with one key pin 668. FIG. 62 shows how holder 600 is inserted into key 660 with openings 632 aligned with key pins 668.

Key 660 includes a base 662 and a plunger 664 that is adapted to be moved from a resting position (FIG. 63) to an unlocking position (FIG. 64) when the user wishes to unlock holder 600. Key pins 668 are carried by blocks 670 that are adapted to slide back and forth with respect to base 662. The upper surface 672 of each block 670 is angled and is positioned to engage an angled surface 674 of plunger 664. When plunger 664 is pushed down, the angled surfaces cooperate and force blocks 670 inwardly toward holder 600. Springs 680 are provided to return plunger 664 to the resting position. Blocks 670 may be connected to plunger 664 such that blocks 670 return to their resting position when plunger 664 returns to its resting position.

The user inserts holder 600 into key as shown in FIG. 62. The shape of holder 600 and key 660 only allows holder 600 to be inserted in the proper orientation for unlocking. After holder 600 is inserted, the user depresses plunger 664 to move pins 668 inwardly to engage and unlock locking fingers 624 allowing holder 600 to be removed from substrate 40. The user then releases plunger 664 and springs 680 return plunger 664 to its resting position where it is ready to open another holder.

The sixteenth embodiment of the invention is indicated generally by the numeral 700 in FIGS. 65–69. Holder 700 is designed to be snapped onto items of merchandise without piercing. Holder 700 is particularly designed for use with different items of jewelry such as the earring 702 depicted in FIG. 65 and the necklace 704 depicted in FIG. 66. Holder 700 snaps over items 702 and 704 to prevent items 702 and 704 from being removed from a retail establishment without triggering an alarm. In some embodiments, the overall size of holder 700 may be reduced such that an EAS tag cannot be carried inside of holder 700. In these embodiments, holder 700 acts as a theft deterrent device by being difficult to remove from the merchandise and by simply providing a visual deterrent to potential shoplifters.

Holder 700 generally includes first 712 and second 714 members that are connected together with a hinge 716. First 712 and second 714 members are movable between the open, unlocked position depicted in FIG. 67 and the closed, locked position depicted in FIG. 68. Holder 700 may thus be attached to merchandise 702 or 704 by positioning merchandise 702 or 704 within first member 712 and then closing second member 714 over merchandise 702 or 704 so that holder 700 is secured to the merchandise. Members 712 and 714 may be configured to define a compartment size to receive an EAS tag if this configuration is desired.

Holder 700 may use any of the locking mechanisms described above and preferably uses locking fingers that are similar to locking fingers 624 and 626 described above with respect to EAS tag holder 600.

Figure 66:
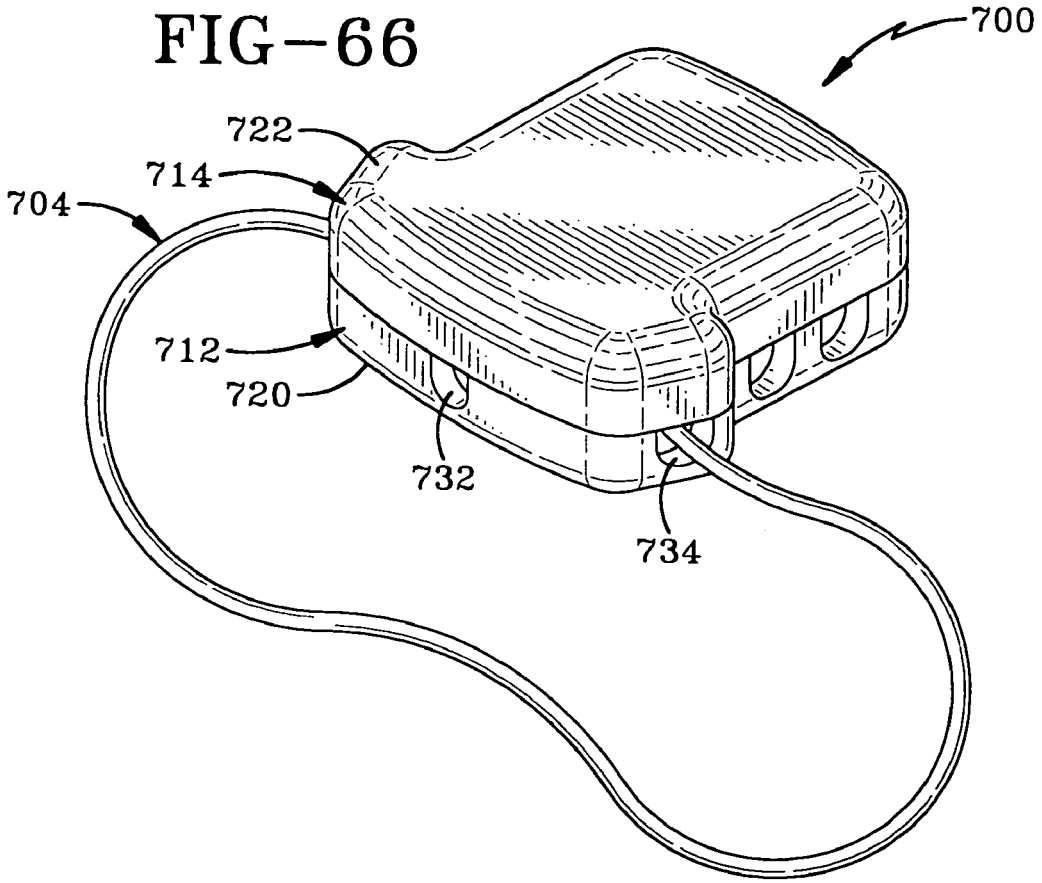
FIG. 66 is a view similar to FIG. 65 showing the sixteenth embodiment secured on a necklace.

The forward portions of members 612 and 614 define jaws 720 and 722 that close around the merchandise. In the exemplary embodiment depicted in the drawings, lower jaw 720 associated with first member 712 defines at least two openings that allow holder 700 to close around the merchandise. In the exemplary embodiment, lower jaw 720 defines three openings 730, 732, and 734. Openings 730 and 734 are aligned and coaxial so that a straight item of merchandise may be disposed through openings 730 and 734. Necklace 704 in FIG. 66 is disposed in this configuration. Opening 732 is disposed substantially perpendicular to each opening 730 and 734 so that holder 700 may be used on items of merchandise such as earrings 702. Openings 730, 732, and 734 are entirely defined by lower jaw 720 in the exemplary embodiment. In other embodiments, openings 730, 732 and 734 may be defined by upper jaw 722 or a combination of jaws 720 and 722.

Figure 67:
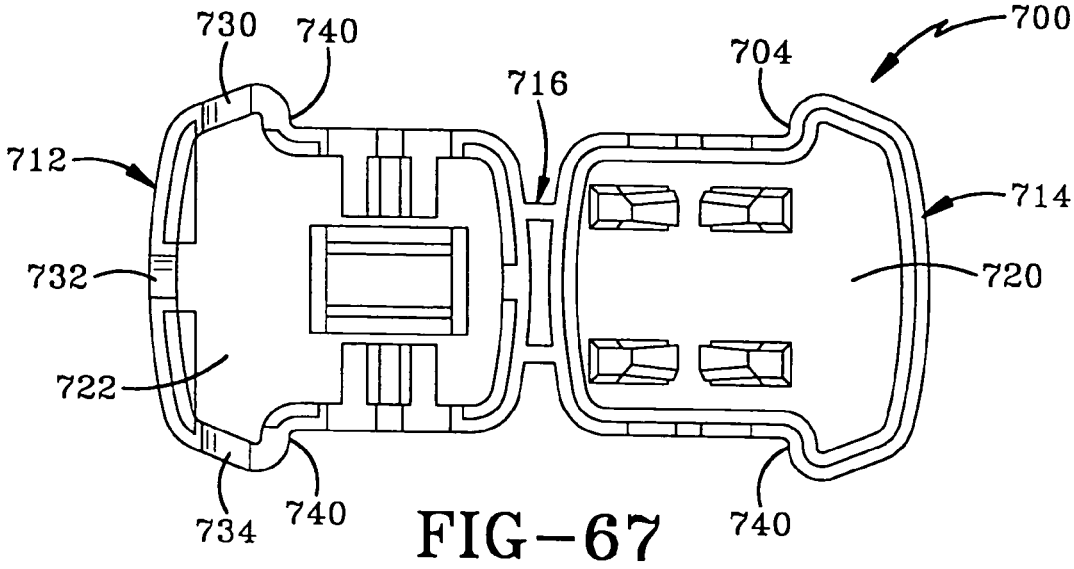
FIG. 67 is a top plan view of the sixteenth embodiment in an open position showing the locking fingers.
Figure 68:
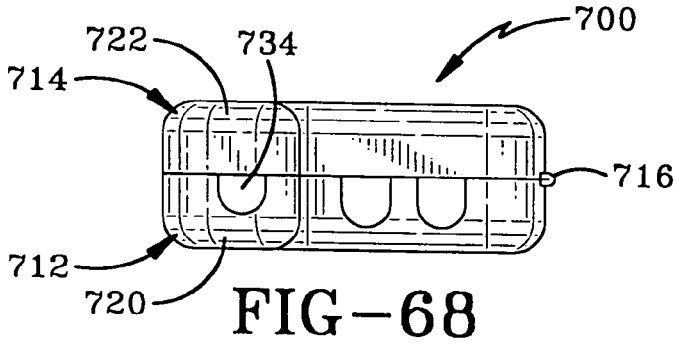
FIG. 68 is a right side elevation view of FIG. 65 with the earring removed.
Figure 69:
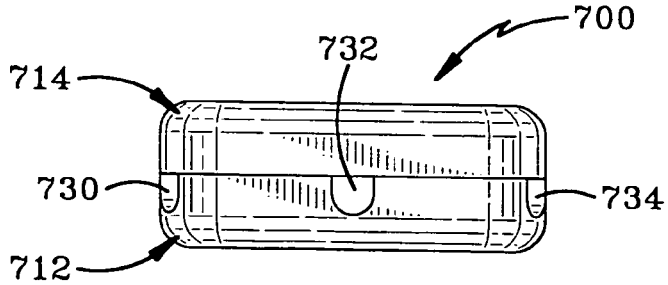
FIG. 69 is a front elevation view of FIG. 65 with the earring removed.
Figure 70:
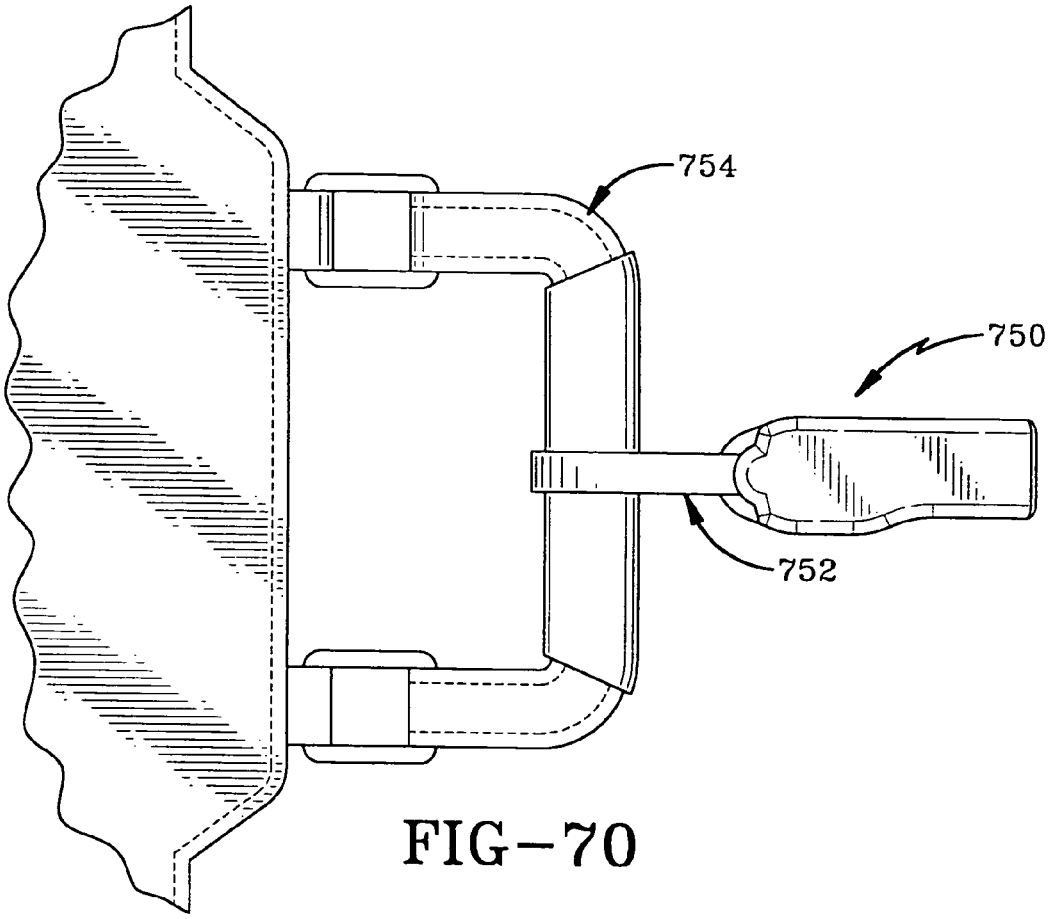
FIG. 70 is an elevation view of a first embodiment of a slotted EAS tag holder with a first embodiment of a lanyard that is used to connect the holder to an item of merchandise.
Figure 71:
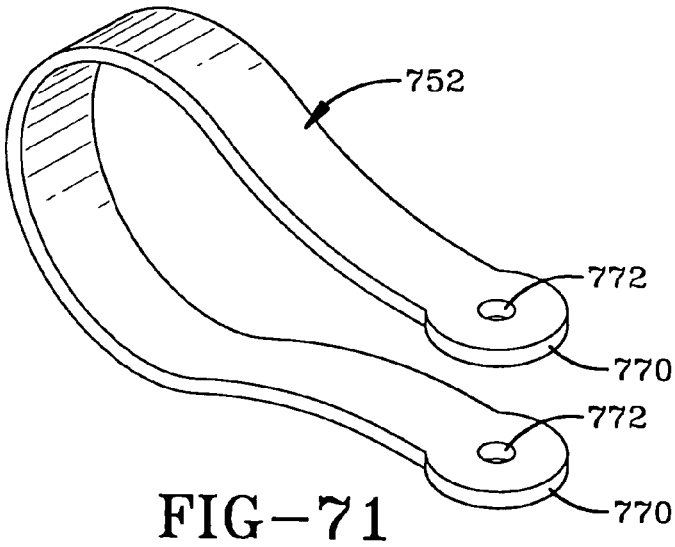
FIG. 71 is a perspective view of the lanyard shown in FIG. 70.
Figure 72:
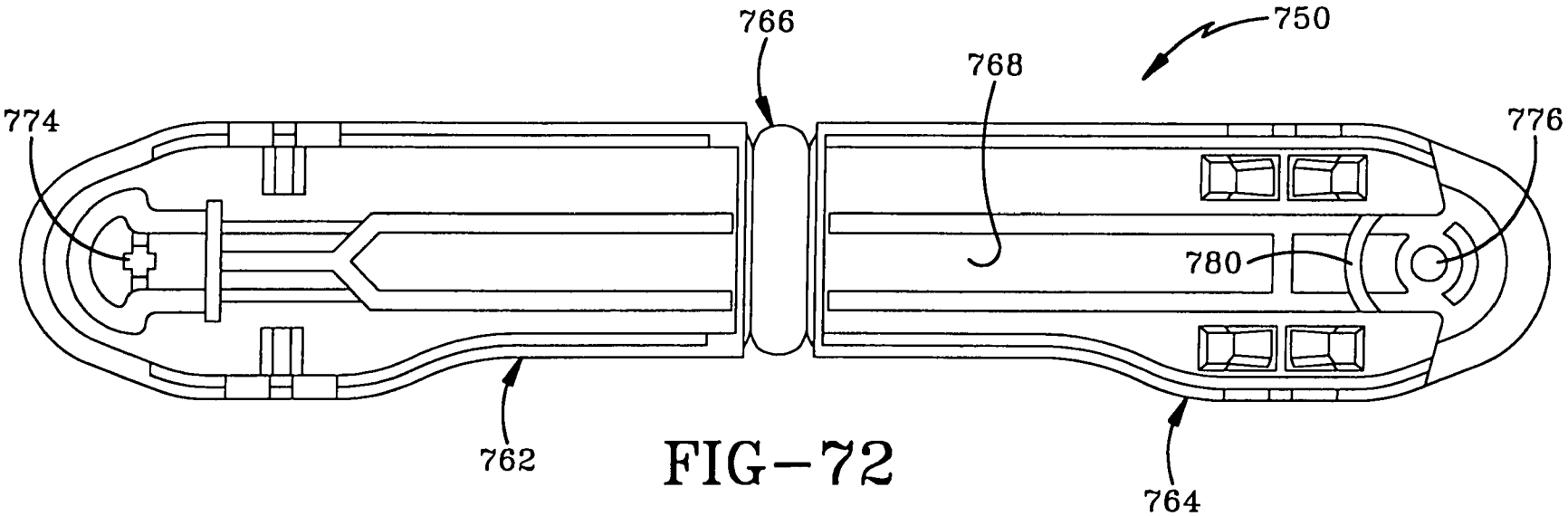
FIG. 72 is a top plan view of the holder in an open position with the lanyard detached.

Jaws 720 and 722 project out from the main body of members 712 and 714 as depicted in FIG. 67. These projections (indicated generally by the numeral 740) help the user insert holder 700 into an opening position with an opener such as those described above with respect to holder 600. Projection 740 prevent holder 700 from being inserted too far into opener 660.

A first embodiment of a slotted EAS tag holder is indicated generally by the numeral 750 in FIGS. 70–74. FIGS.

70–74 also depict a first embodiment of a lanyard 752 that allows EAS tag holder 750 to be connected to items of merchandise 754 that cannot be pierced with the pins described above or accept the clamping mechanisms described above with respect to other embodiments of the invention. Lanyard 752 may be wrapped through an opening in an item of merchandise (such as the handle of briefcase 754) to attach EAS tag holder 750 in a manner that prevents EAS tag holder 750 from being detached.

EAS tag holder 750 generally includes a first member 762 and a second member 764. Members 762 and 764 are connected together by a hinge 766 that allows members 762 and 764 to move between the open position depicted in FIG. 72 and the closed position depicted in FIG. 74. The lock mechanism that holds members 762 and 764 in the closed and locked position may be any of the locked mechanisms described above and the exemplary embodiment uses lock fingers similar to holder 600 described above. Members 762 and 764 cooperate to define an EAS tag-receiving chamber 768 that is sized to hold an EAS tag as described above.

Figure 73:
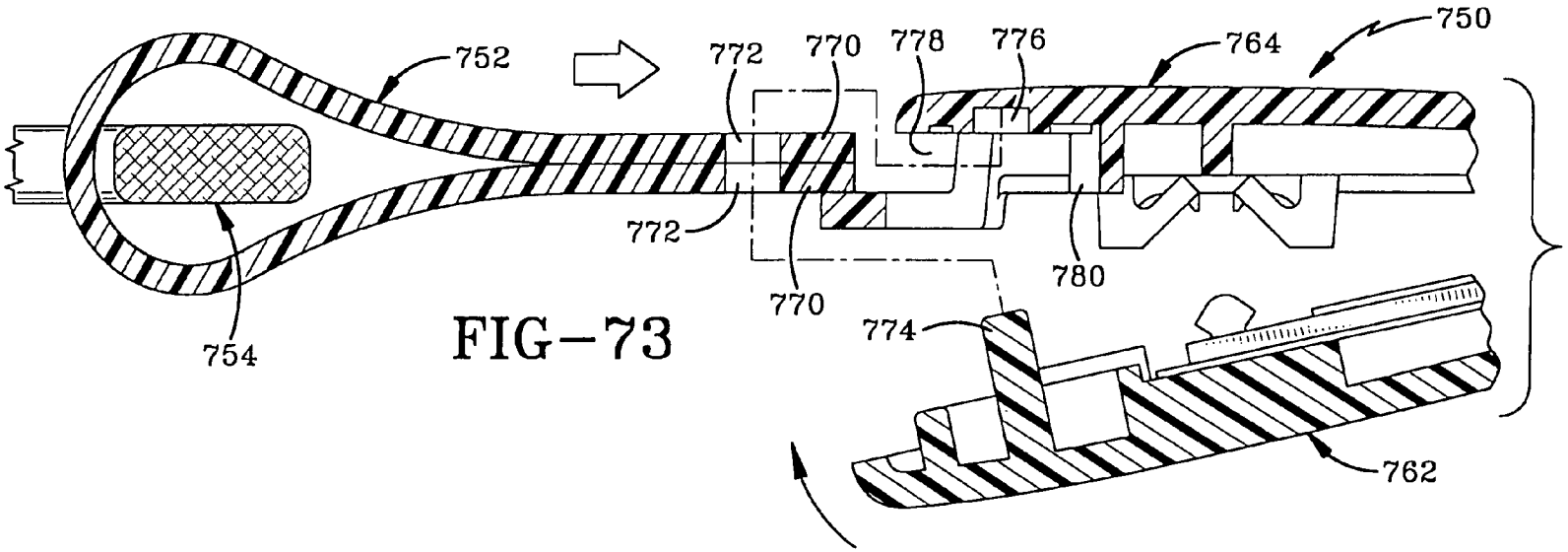
FIG. 73 is a section view of the front of the EAS tag holder of FIG. 72 and the lanyard with the lanyard being inserted through the slot in the front of the EAS tag holder.
Figure 74:
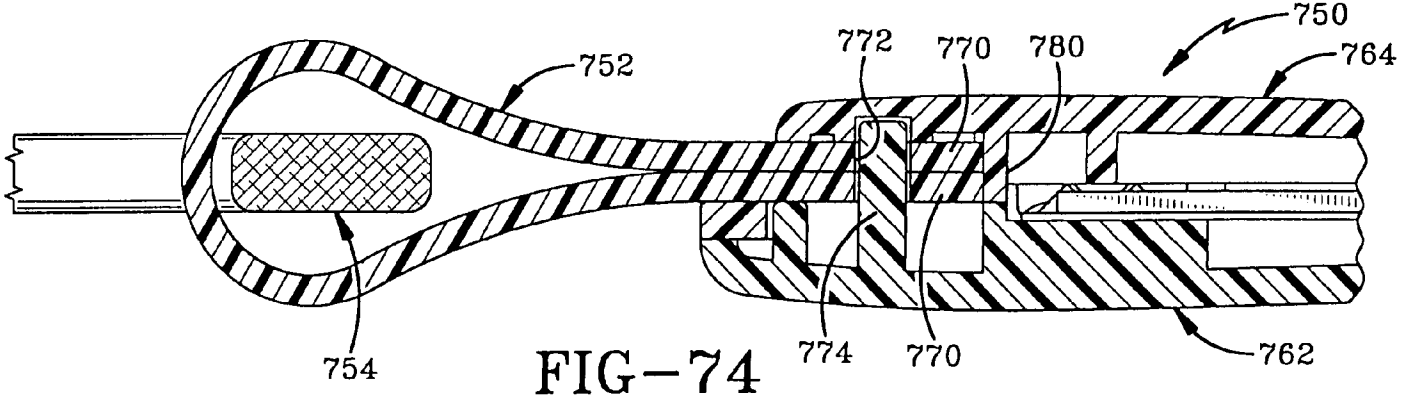
FIG. 74 is a section view similar to FIG. 73 showing how the lanyard is secured within the EAS tag holder.

Lanyard 752 includes first and second ends 770 that each define an opening 772. Ends 770 and opening 772 are used to connect members 762 and 764 with lanyard 752 in the following manner. First member 762 includes a tooth 774 that is configured to pass through openings 772. Second member 764 defines a recess 776 that receives the end of tooth 774 when members 762 and 764 are in the closed position as depicted in FIG. 74. Second member 764 also defines a slot 778 that is sized to receive ends 770 of lanyard 752 as depicted in FIGS. 73 and 74. As shown in the drawings, slot 778 is entirely defined by the front portion, or jaw, of second member 764 of holder 750. By being defined in a single member, a shoplifter cannot pry first member 762 away from second member 764 by grasping the edges of slot 778. Slot 778 is aligned with tooth 774 such that tooth 774 will pass through openings 772 when ends 770 are positioned in second member 764 and first member 762 is moved to the closed position as depicted in FIG. 73 and 74. A blocking wall 780 is provided on second member 764 to properly position ends 770 before members 762 and 764 are closed. Blocking wall 780 may be curved to match the shape of ends 770. The user thus wraps lanyard 752 around merchandise 754 and slides ends 770 into second member 764 until they contact blocking wall 780. The user then closes first member 762 such that tooth 774 passes through openings 772 to prevent lanyard 752 from being removed. The shoplifter must sever lanyard 752 or break a portion of members 762 or 764 to separate EAS tag holder 750 from merchandise 754.

In an alternative embodiment of the invention, the ends 770 of lanyard 752 are larger than the slot. The first and second members closed around the ends 770 so that the ends cannot be pulled back through the slot. In this embodiment, the tooth is not needed.

In another alternative embodiment shown in FIGS. 97–104, the ends 770 of the lanyard are latched together with a latch 782 so that the lanyard and holder may be easily connected. In this example, latch 782 snap fits ends 770 together with snap fit fingers 784 that extends from one end 770 and snap into a recess 786 in the other end 770 of the lanyard.

Figure 75:
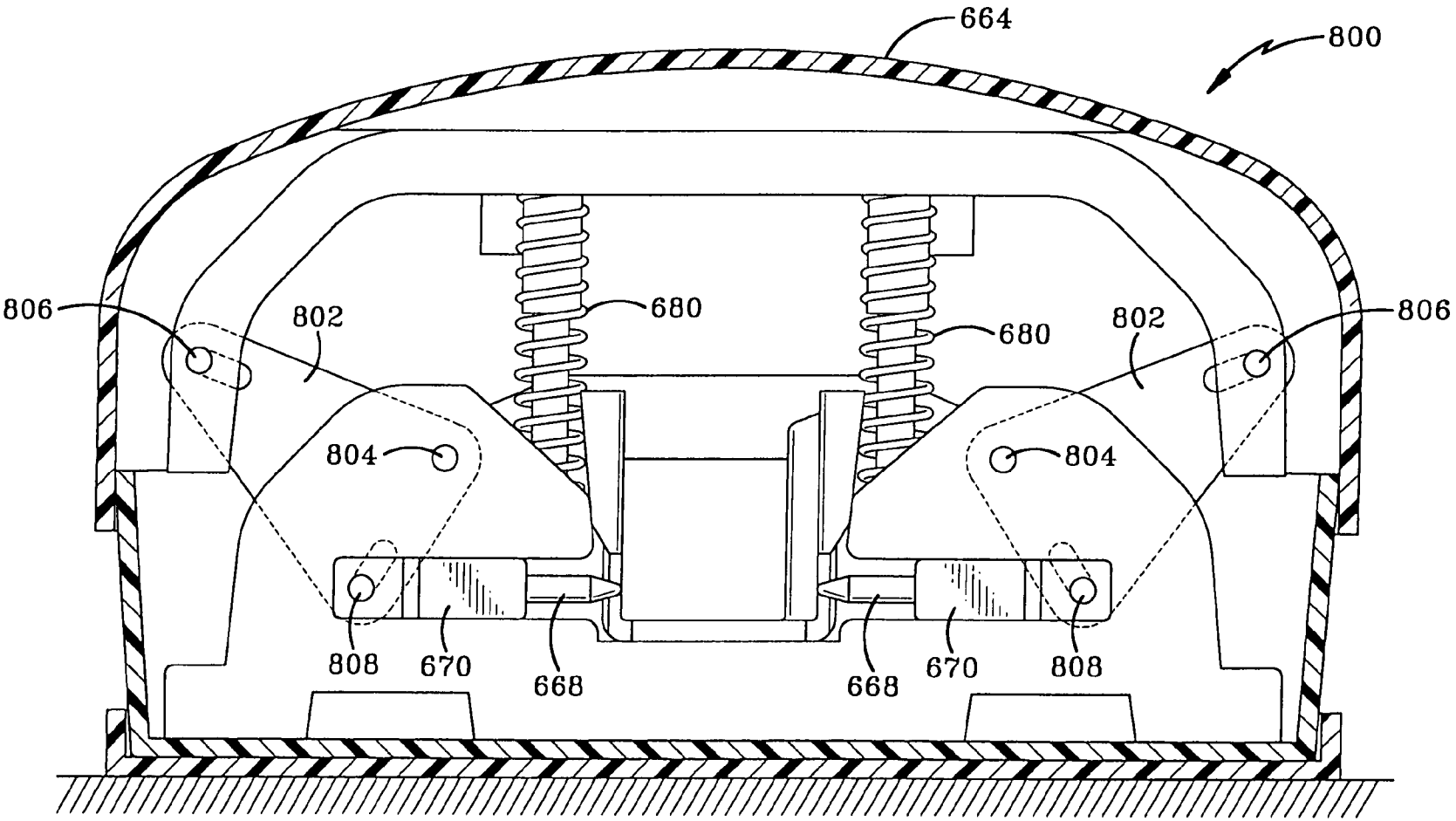
FIG. 75 is a view of an alternative key used to open multiple embodiments of the devices disclosed in this application showing the key in a resting position.
Figure 76:
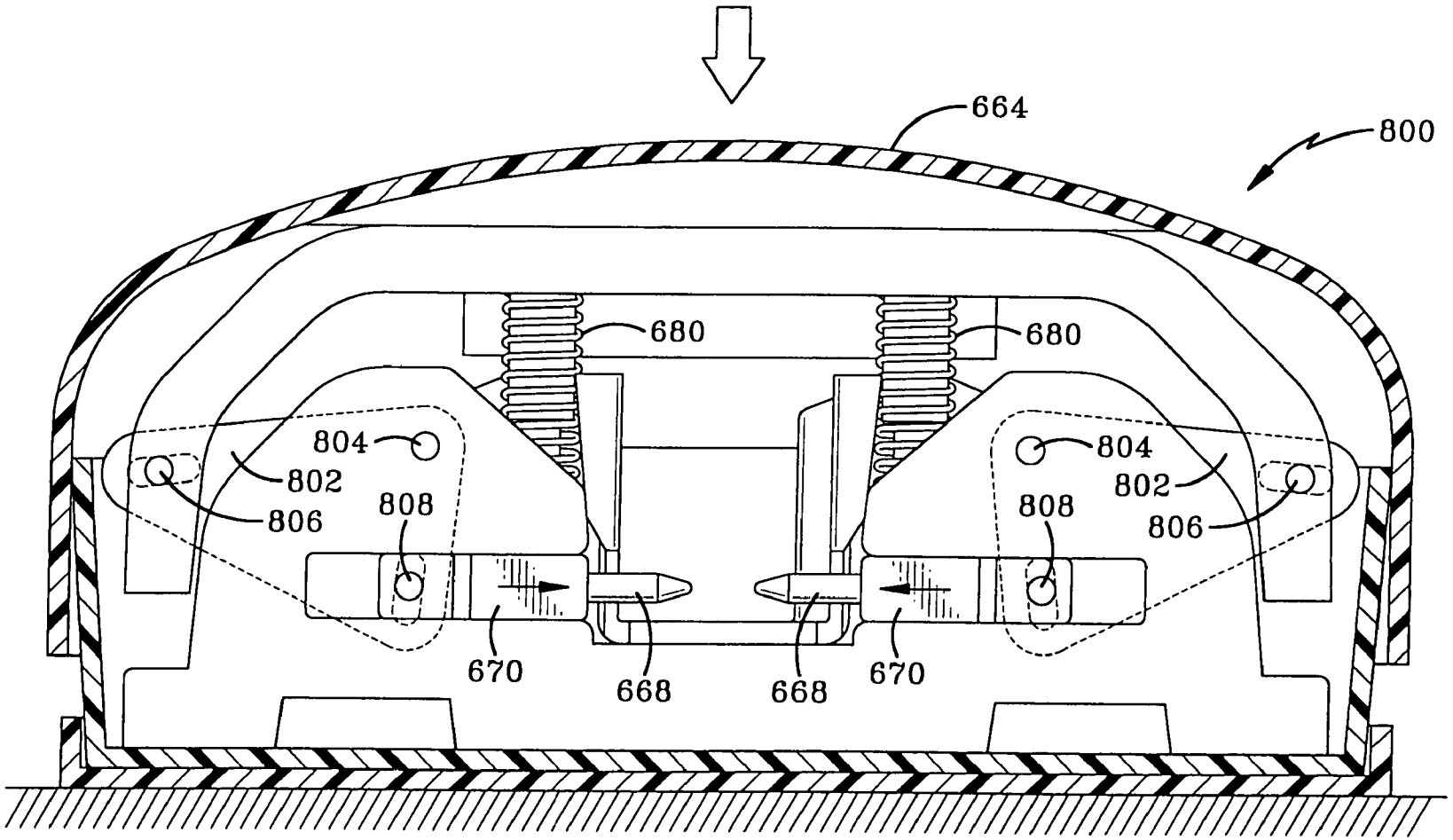
FIG. 76 is a view similar to FIG. 75 showing the key with the key pins in an unlocking position.

An alternate embodiment of a key or opener for holders having the lock mechanism described above with respect to holder 600, is indicated generally by the numeral 800 in FIG. 75 and 76. Opener 800 works substantially similarly to opener 660 described above such that it is adapted to slide key pins 668 back and forth between the resting position depicted in FIG. 75 and the unlocking position depicted in FIG. 76. In the embodiment described above, angled slides were used to move key pins 668 inwardly when plunger 664 was moved downwardly. In the embodiment depicted in FIGS. 75 and 76, triangular pushers 802 are used to provide the desired movement. A spring 680 is used to return plunger 664 to the resting position. Each pusher 802 is connected at a first fixed pivot 804 to the base of opener 800. Each pusher 802 is connected at a second pivot 806 to plunger 664. Pivot 806 includes a pivot pin disposed in a slot. Each pusher 802 is connected to blocks 670 with a third pivot 808 that also includes a pin and a slot. The pin and slot arrangements allow the movement of pushers 802 to create the inward and outward movement of blocks 670 as depicted in FIGS. 75 and 76 when plunger 664 is moved upwardly and downwardly. Other similar cam and follower arrangements may also be used to create the desired movement of key pins 668.

Figure 77:
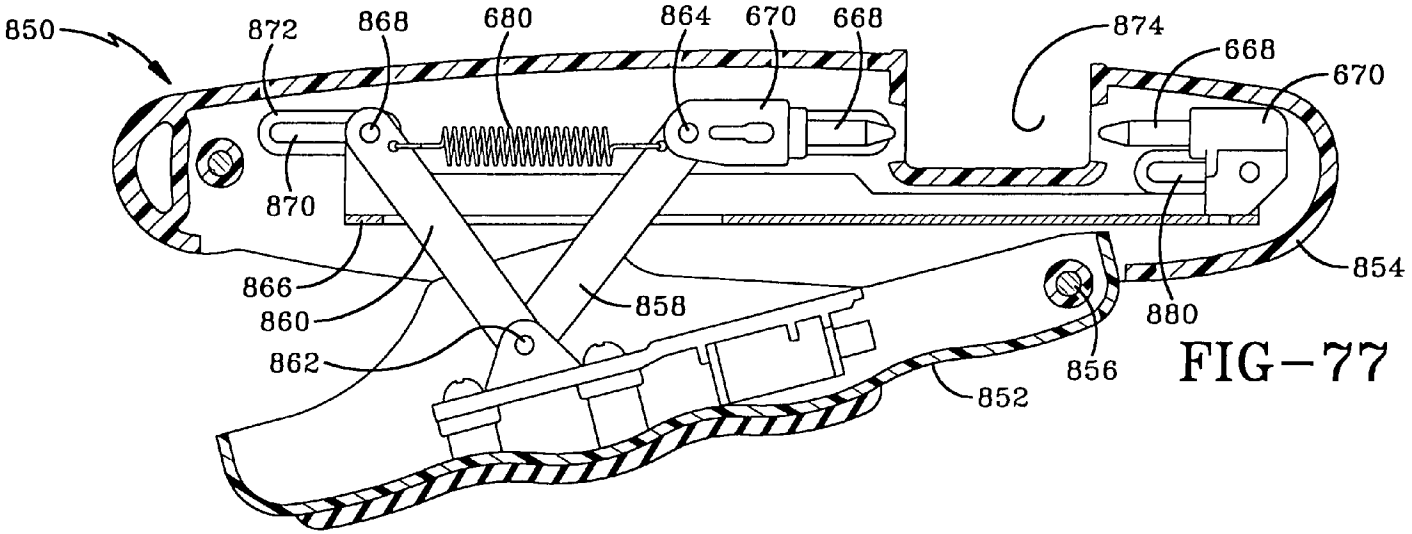
FIG. 77 is a section view of an alternative key for opening multiple embodiments of the devices disclosed in this application with the key in the resting position.
Figure 78:
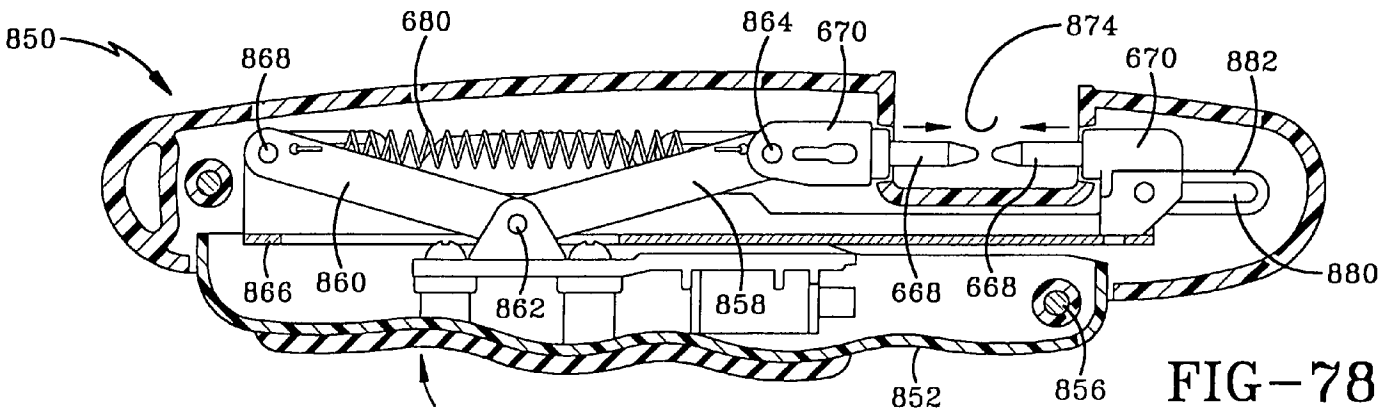
FIG. 78 is a view similar to FIG. 77 showing the key pins in an unlocking position.
Figure 79:
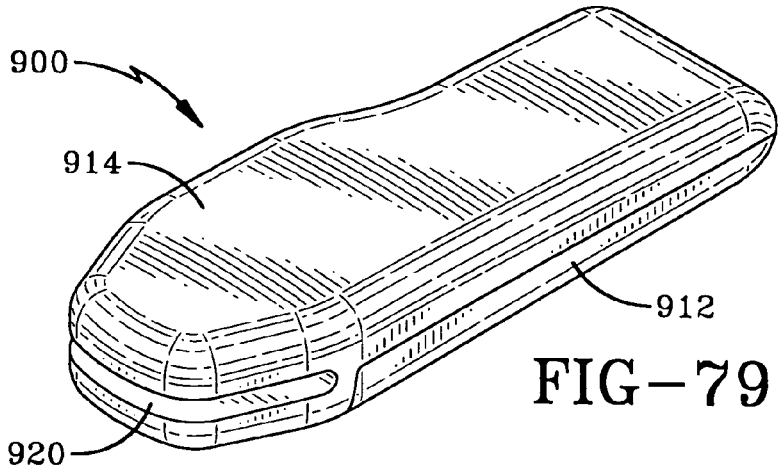
FIG. 79 is a perspective view of a second embodiment of a slotted EAS tag holder of the invention.
Figure 80:
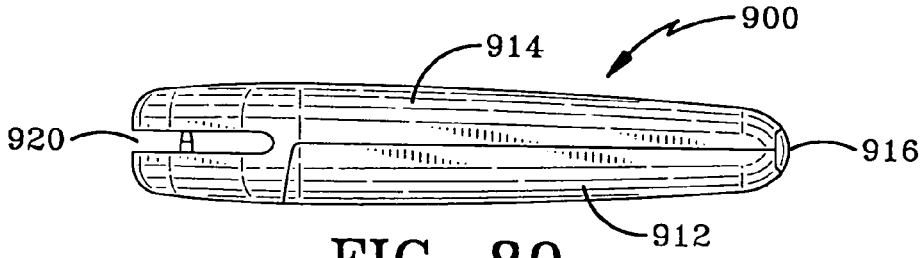
FIG. 80 is a right side elevation view of FIG. 79.
Figure 81:
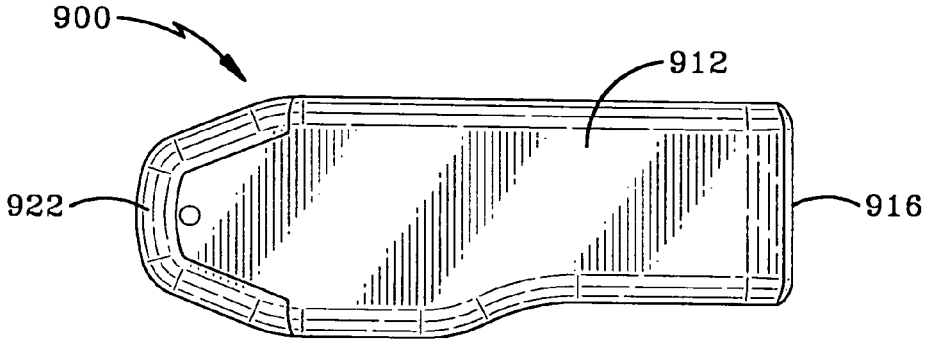
FIG. 81 is a bottom plan view of FIG. 79.
Figure 82:
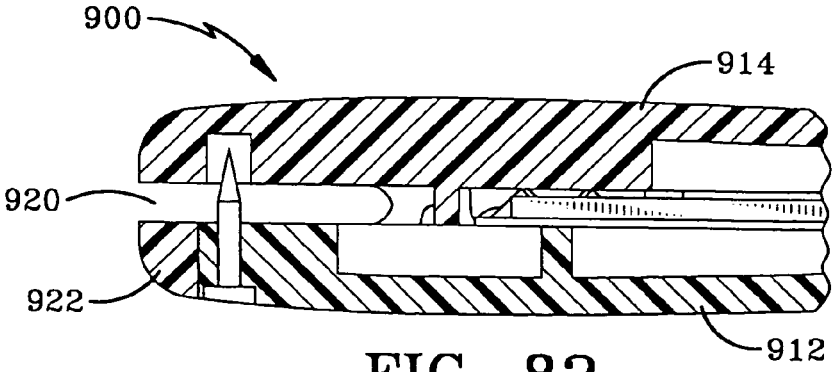
FIG. 82 is a section view taken through the jaws of the EAS tag holder shown in FIGS. 79–81.
Figure 83:
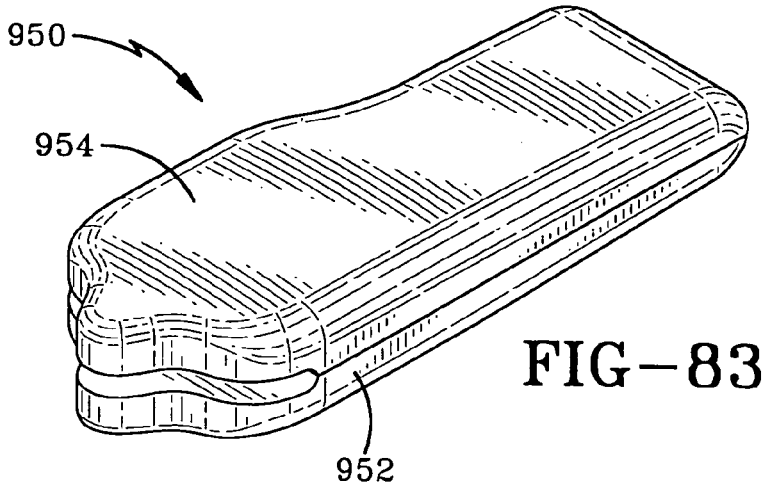
FIG. 83 is a perspective view of an alternative embodiment of the EAS tag holder of the invention.
Figure 84:
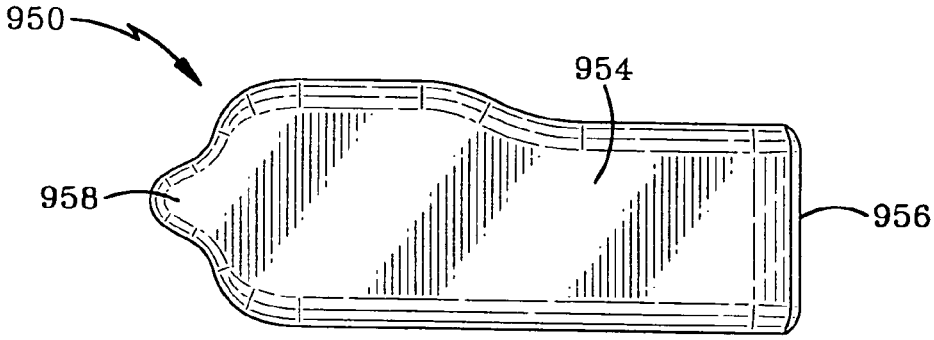
FIG. 84 is a top plan view of FIG. 83.
Figure 85:
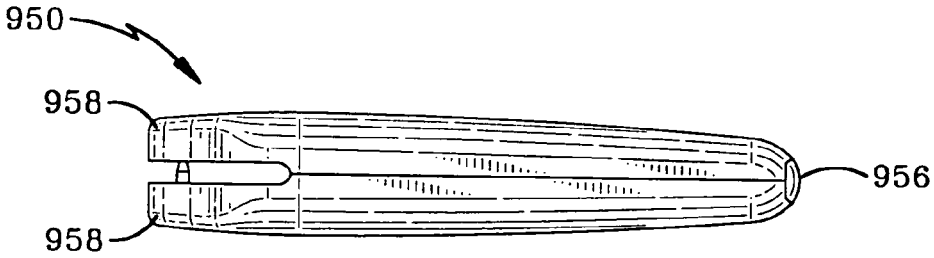
FIG. 85 is a right side elevation view of FIG. 83.
Figure 86:
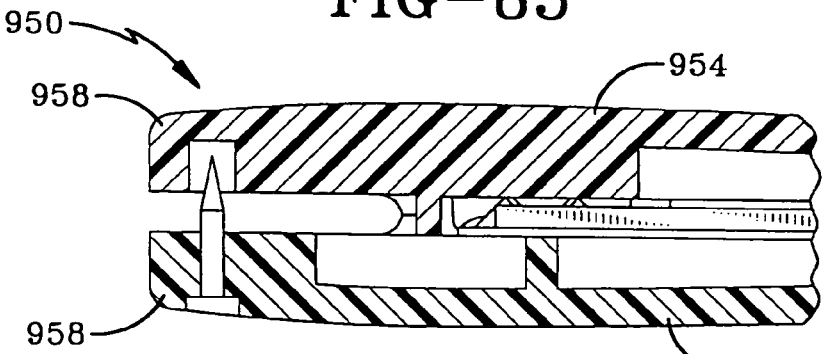
FIG. 86 is a section view taken through the jaws of the holder of FIGS. 83–86.
Figure 87:
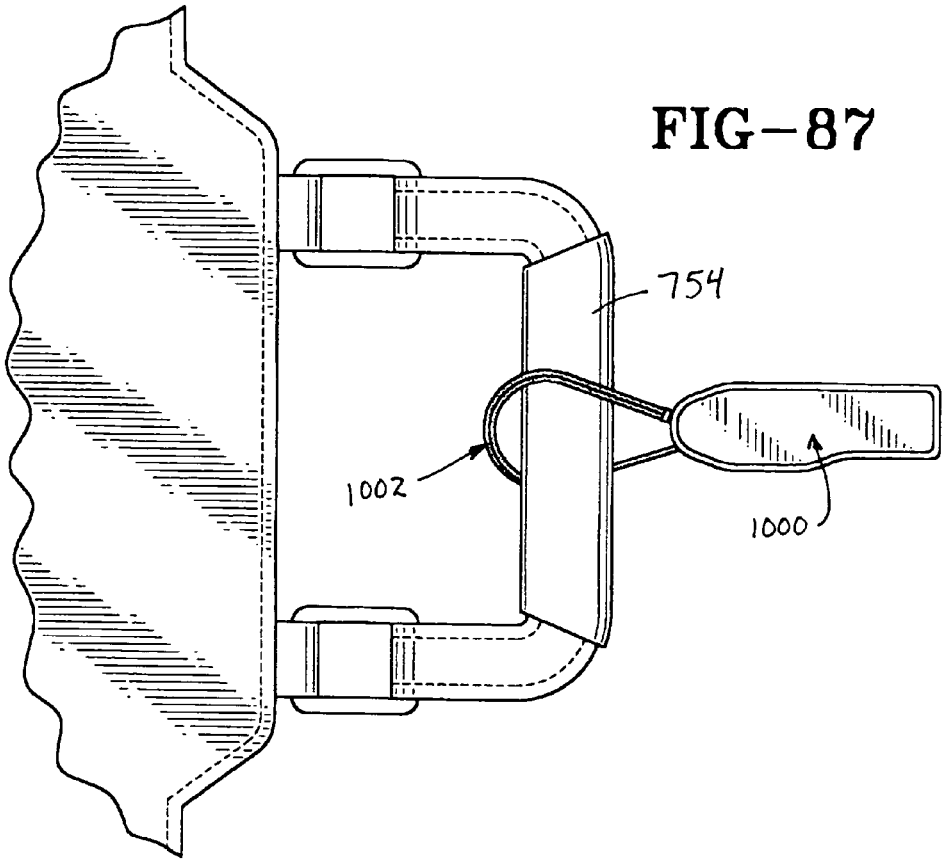
FIG. 87 is an elevation view of a third embodiment of a slotted EAS tag holder with a second embodiment of a lanyard that is used to connect the holder to an item of merchandise.
Figure 88:
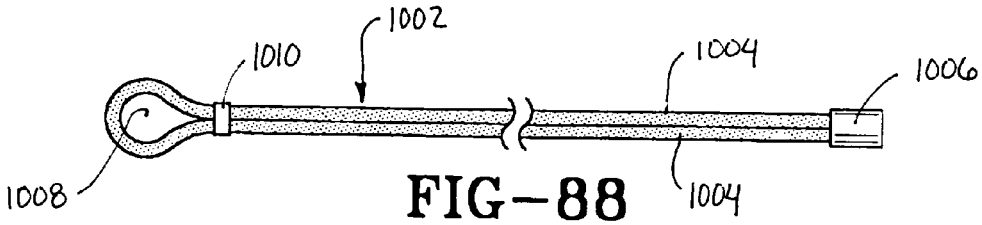
FIG. 88 is a top plan view of the second embodiment of the lanyard of the invention.
Figure 89:
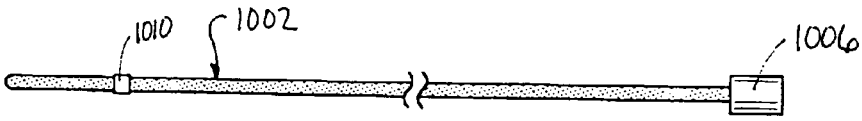
FIG. 89 is a side view of the lanyard shown in FIG. 88.
Figure 90:
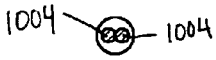
FIG. 90 is an end view of the barrel of the lanyard.
Figure 91:
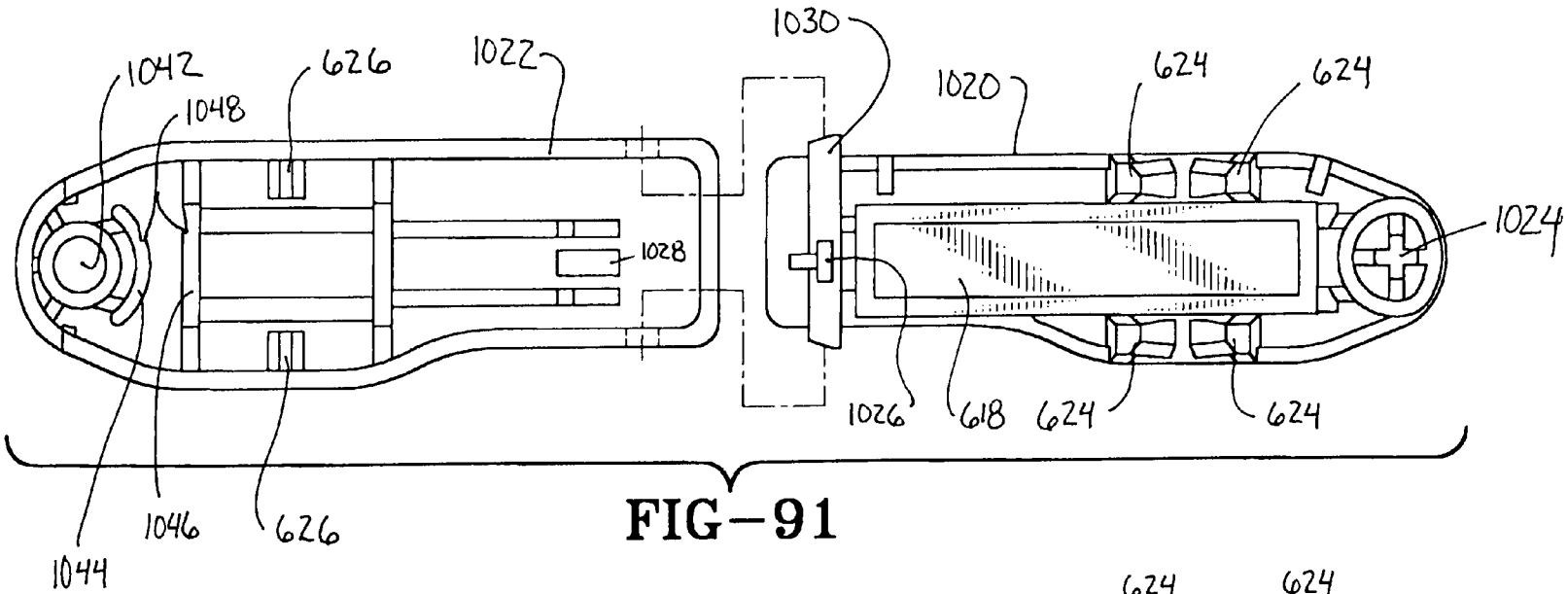
FIG. 91 is an exploded top plan view of the first and second members of the holder before they are attached together with a hinge.
Figure 92:
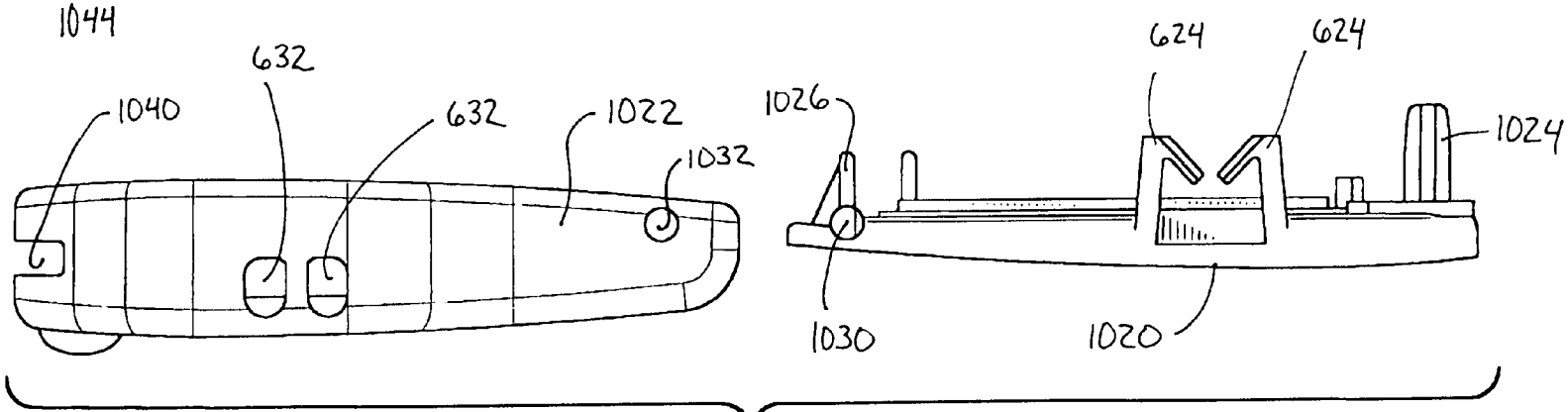
FIG. 92 is a side view of FIG. 91.
Figure 93:
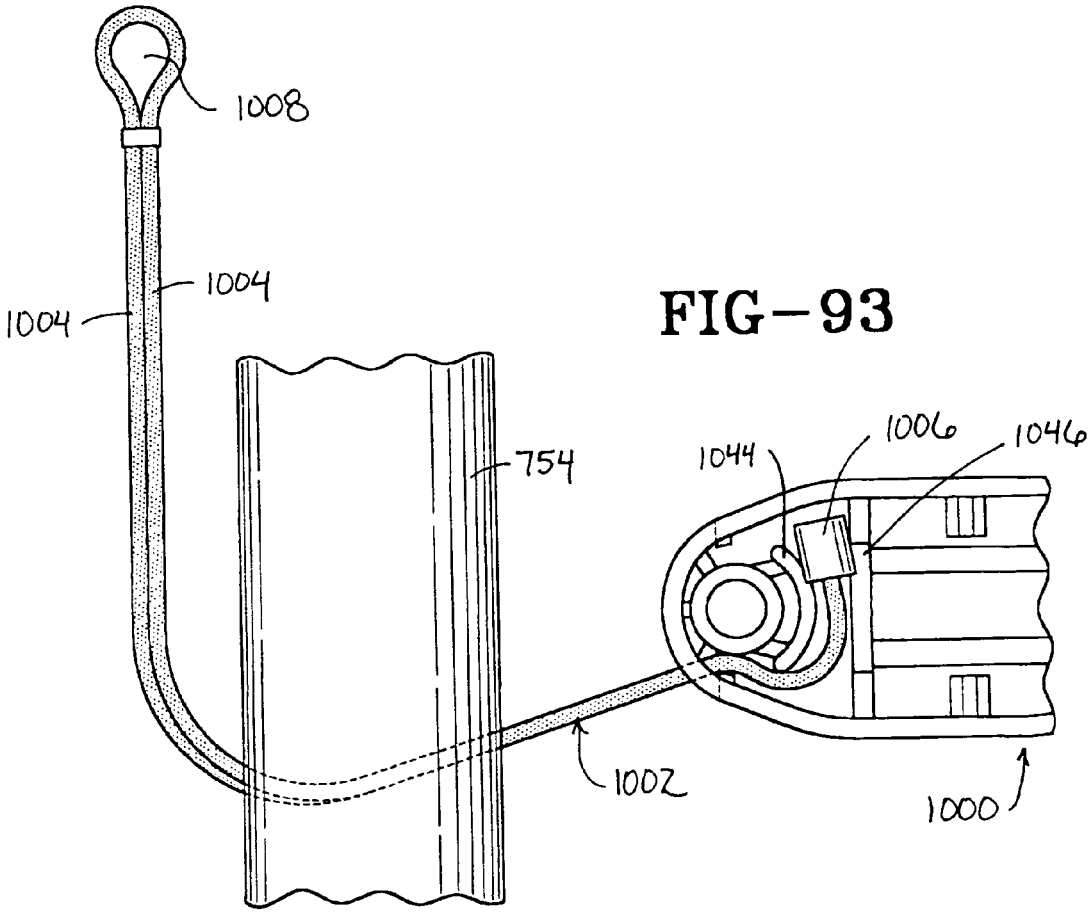
FIG. 93 is a top plan view of the front end of the third embodiment of the holder with the first end of the lanyard secured to the second member of the holder.
Figure 94:
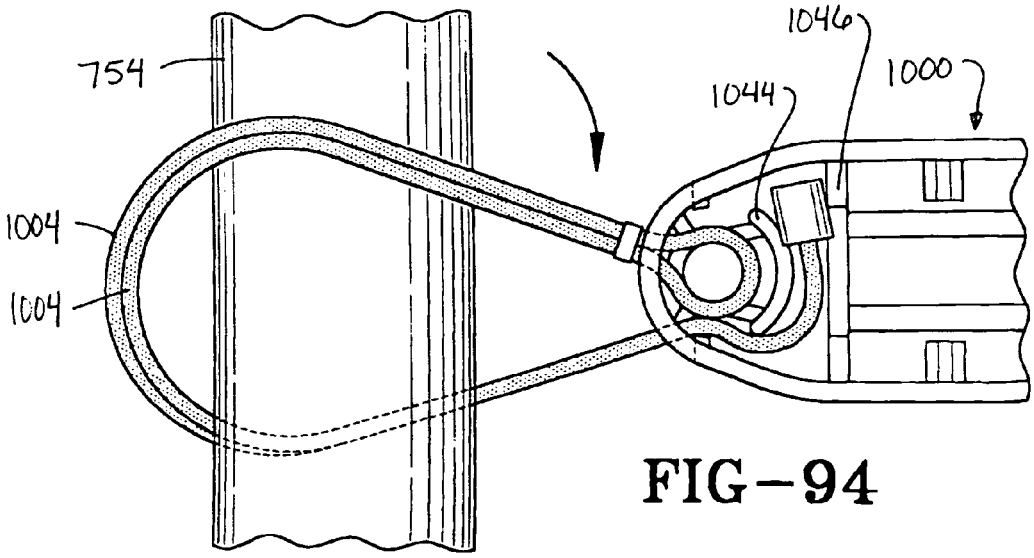
FIG. 94 is a view similar to FIG. 93 showing the second end of the lanyard passed through the slot defined by the second member of the holder and in position to be locked.

For instance, an alternative embodiment is indicated generally by the numeral 850 in FIGS. 77 and 78. In this embodiment, opener 850 is configured for hand held use. A lever 852 is pivotally connected to a base 854 at a first pivot 856. First 858 and second 860 pusher rods are pivotally connected to handle 852 at a second pivot 862. First pusher 858 is pivotally connected to block 670 at a third pivot 864. Second pusher 860 is pivotally connected to a connecting rod 866 at a fourth pivot 868. Pivot 868 includes a slot 870 defined by an appropriate member 872 that allows connector 866 to move back and forth as necessary. Spring 680 is disposed between pushers 858 and 860 to return them to the resting position.

In the resting position depicted in FIG. 77, key pins 668 are retracted inside base 854 so that an EAS tag holder may be inserted into opening 874. The user compresses handle 852 up into body 854 as depicted in FIG. 78. This movement causes pushers 858 and 860 to move away from each other. This movement drives key pins 668 out into opening 874 where they open the holder. The key pins on the left side of opening 874 in FIGS. 78 are driven directly by the engagement of first pusher 858 with block 670. The set of key pins 668 on the right side of opening 874 in FIG. 78 are driven by connector 866 which is attached to second pusher 860. These key pins 668 are connected to block 670 which slides back and forth in a slot 880 that is defined by an appropriate member 882.

The eighteenth embodiment of the EAS tag holder is indicated generally by the numeral 900 in FIGS. 79–82. EAS tag holder 900 includes a first member 912 hingedly connected to a second member 914 with a hinge 916. EAS tag holder 900 may use any of the locking mechanisms described above to hold members 912 and 914 in a closed and locked position.

This embodiment uses a member construction similar to that described above with respect to holder 750. As such, second member 914 defines a slot 920 with a bridge 922. The jaw of first member 912 that carries the tooth abuts bridge 922 in the closed position to position the tooth in slot 920. This configuration strengthens holder 900 and makes it more difficult for a potential shoplifter to pry holder 900 open because the front of slot 920 is defined by second member 914.

The nineteenth embodiment of the EAS tag holder is indicated generally by the numeral 950 in FIGS. 83–86. EAS tag holder 950 includes a first member 952 hingedly connected to a second member 954 with a hinge 956. EAS tag holder 950 may use any of the locking mechanisms described above to hold members 952 and 954 in a closed and locked position.

Holder 950 includes a nose 958 that carries the tooth. Nose 958 protrudes from the front of holder 950 so that holder 950 may be connected to smaller areas of merchandise.

A third embodiment of a slotted EAS tag holder is indicated generally by the numeral 1000 in FIGS. 87–96. Holder 1000 may be used with a second embodiment of a lanyard 1002 that is used to connect holder 1000 to item of merchandise. Lanyard 1002 includes a doubled cable 1004 with a enlarged first end 1006 and an opening 1008 formed in the second end. First end 1006 may be enlarged by crimping a barrel to the cable. Opening 1008 may be formed by separating the cables 1004 at the second end of lanyard 1002 and crimping a stop 1010 for form opening 1008. Cables 1004 are a tough material that is resistant to severing.

Figure 95:
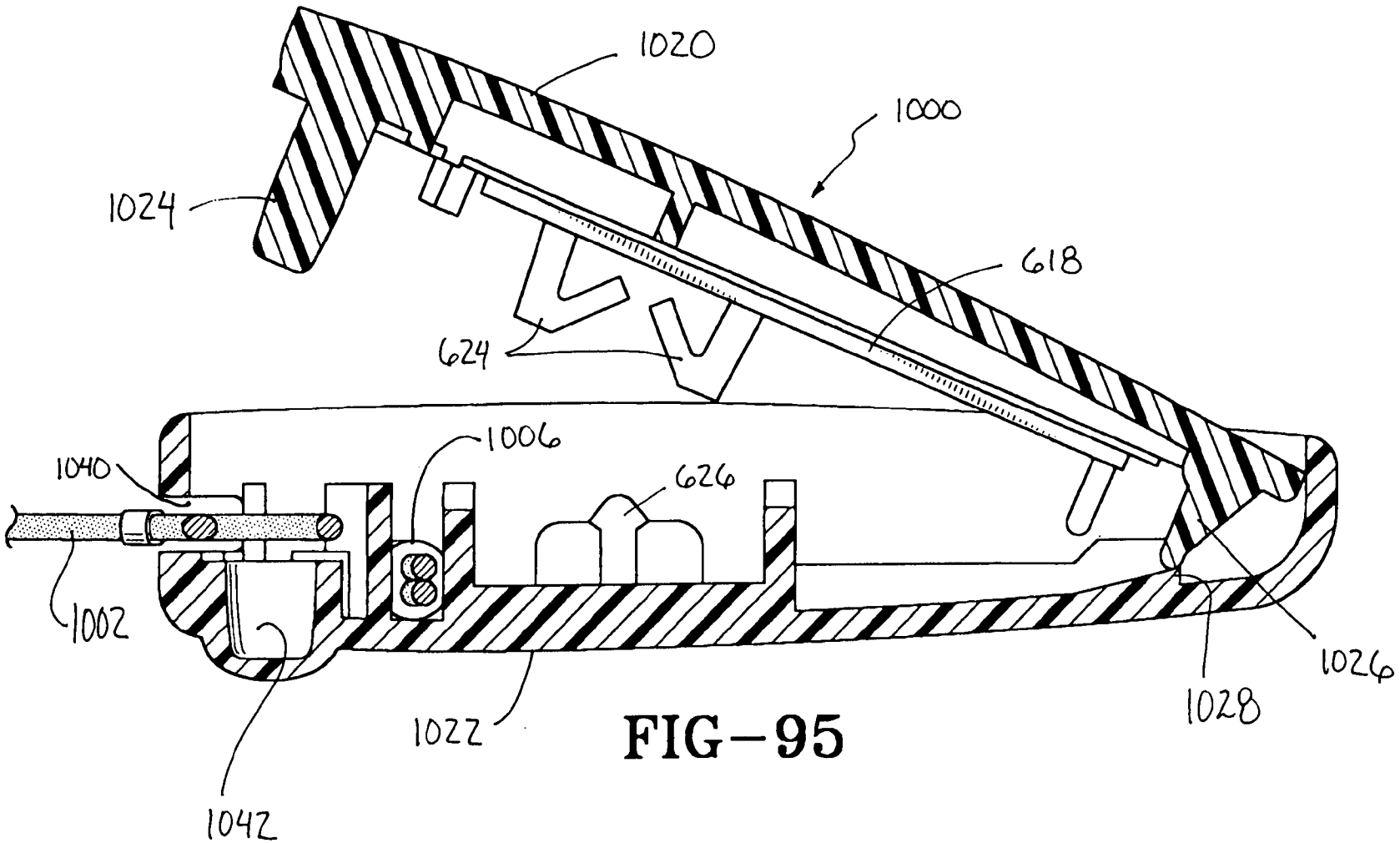
FIG. 95 is a side view of FIG. 94.

Holder 1000 includes first 1020 and second 1022 members that are connect together in a hinged fashion between unlocked (FIG. 95) and locked (FIG. 96) positions to carry EAS tag 618. First member 1020 includes a tooth 1024. FIG. 95 shows the position of a stop 1026 and a stop ledge 1028 that hold first member 1020 open until the user applies enough closing force to snap stop 1026 past ledge 1028.

First member 1020 is hingedly connected to second member 1022 with a hinge pin 1030 that fits into hinge pin openings 1032 defined by second member 1022.

Figure 96:
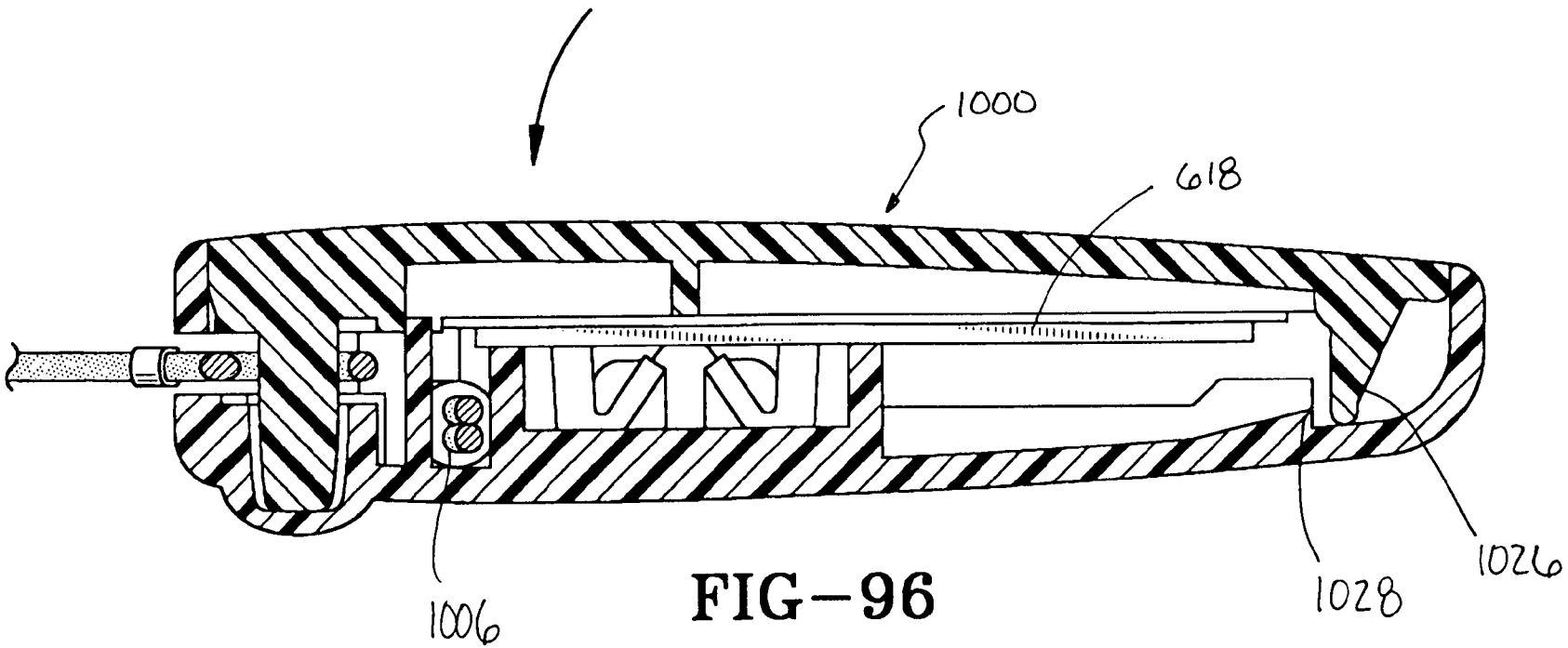
FIG. 96 is a view similar to FIG. 95 showing the first member of the holder in the locked position with the tooth locking the second end of the lanyard in position.
Figure 97:
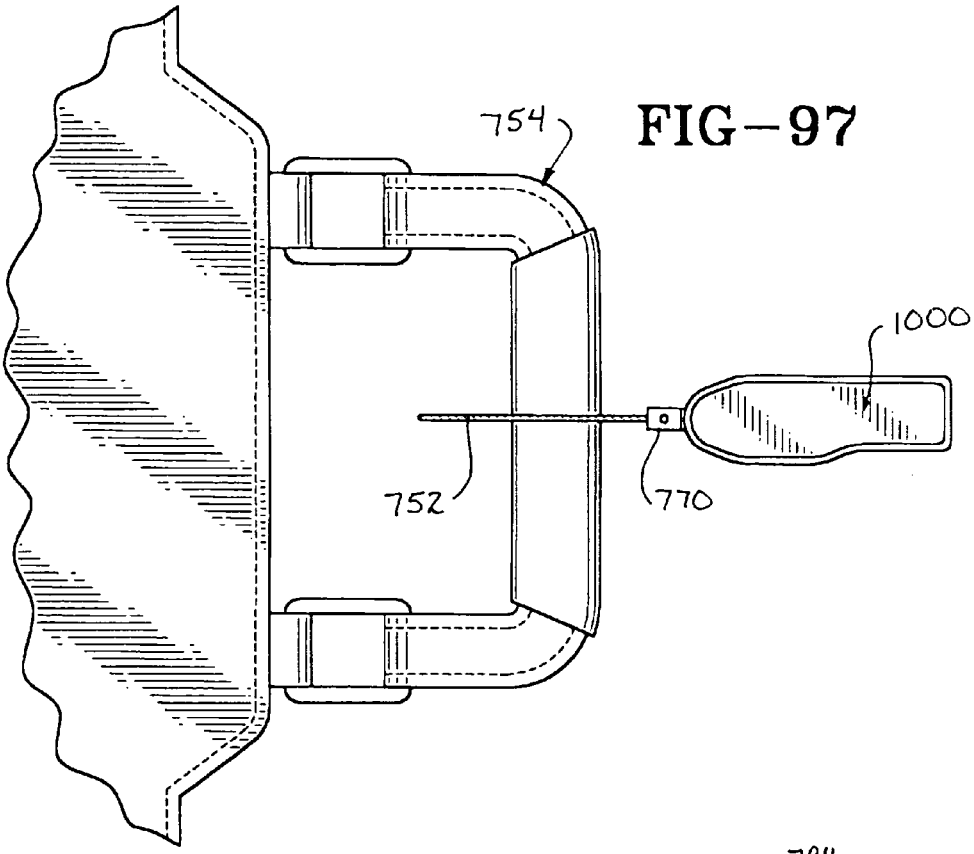
FIG. 97 is an elevation view of the third embodiment of a slotted EAS tag holder used with a third embodiment of a lanyard that is used to connect the holder to an item of merchandise.
Figure 98:
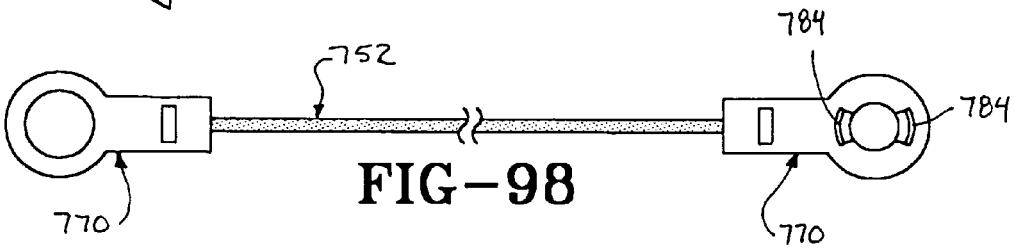
FIG. 98 is a top plan view of the third embodiment of the lanyard of the invention.
Figure 99:
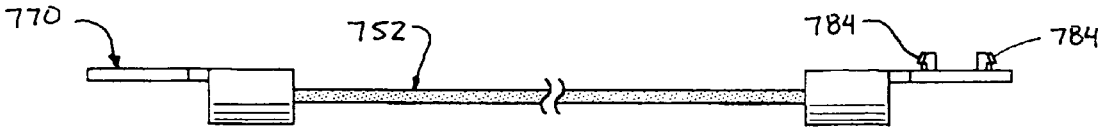
FIG. 99 is a side view of the lanyard shown in FIG. 98.
Figure 100:
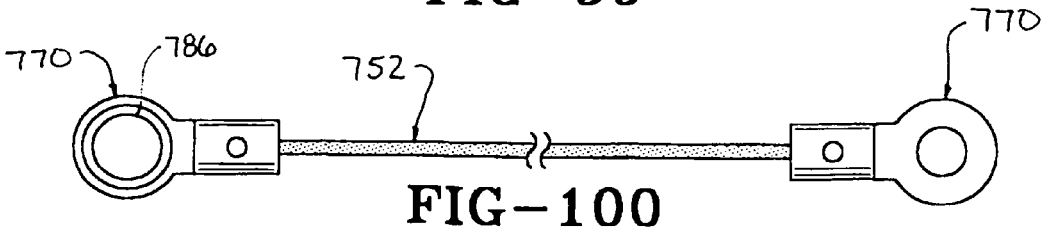
FIG. 100 is a bottom plan view of the lanyard shown in FIG. 98.
Figures 101, 102:
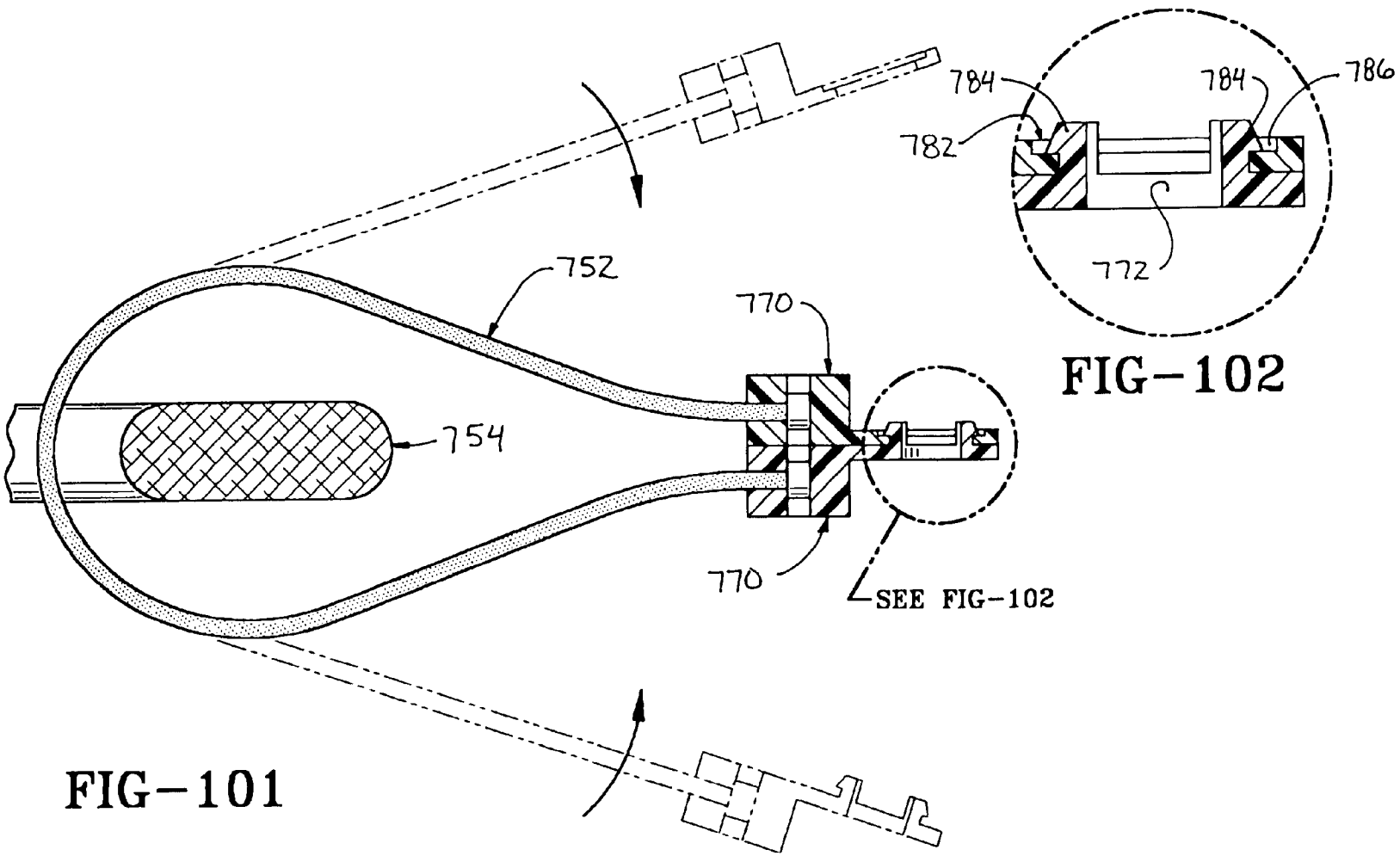
FIG. 101 is a side view, partially in section, showing the first and second ends of the lanyard being latched together with the lanyard disposed around a portion of an item of merchandise.
FIG. 102 is an enlarged view of the encircled portion of FIG. 101.
Figure 103:
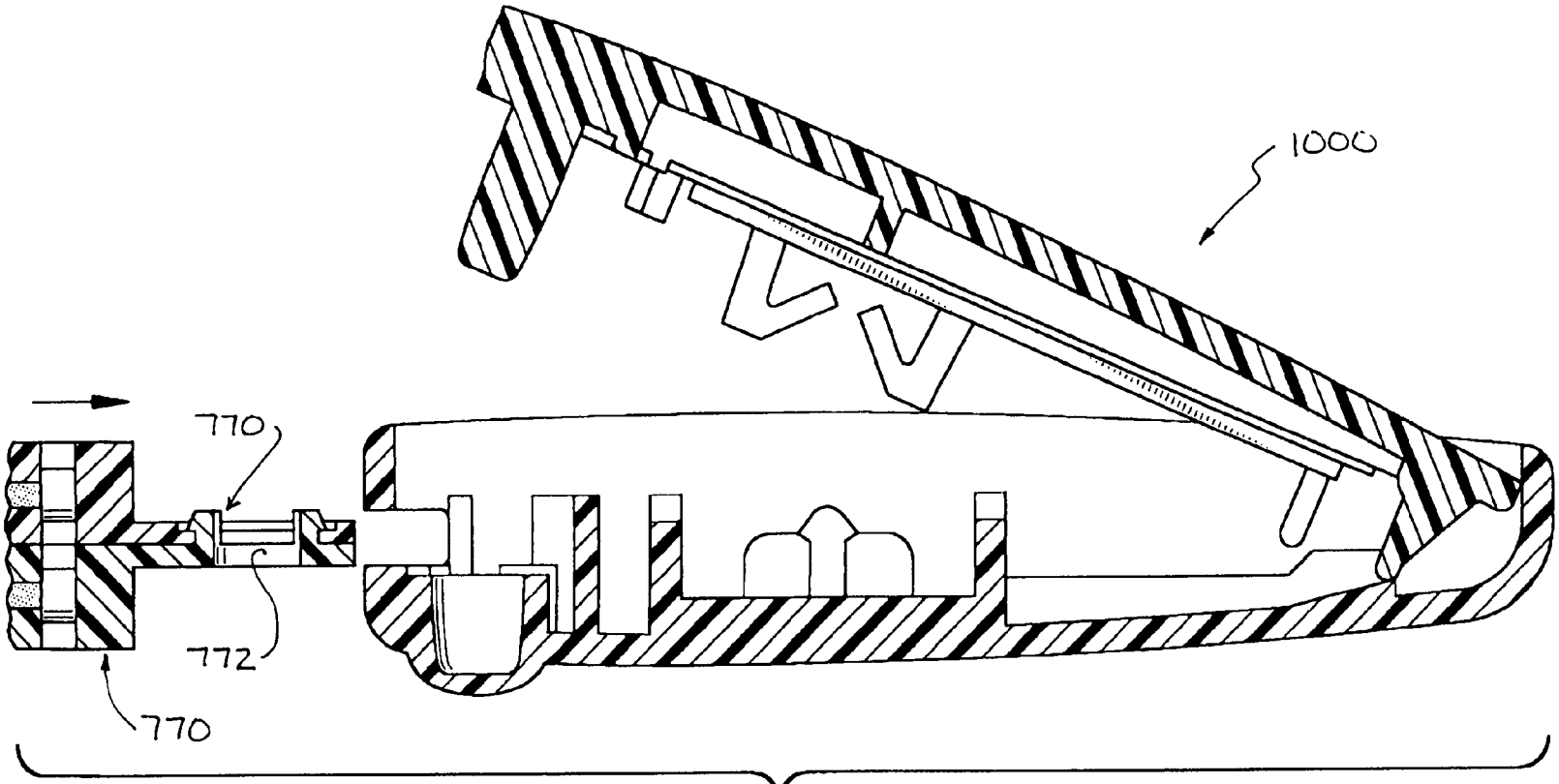
FIG. 103 is a side view in section showing the latched ends of the lanyard being inserted into the slot of the holder.
Figure 104:
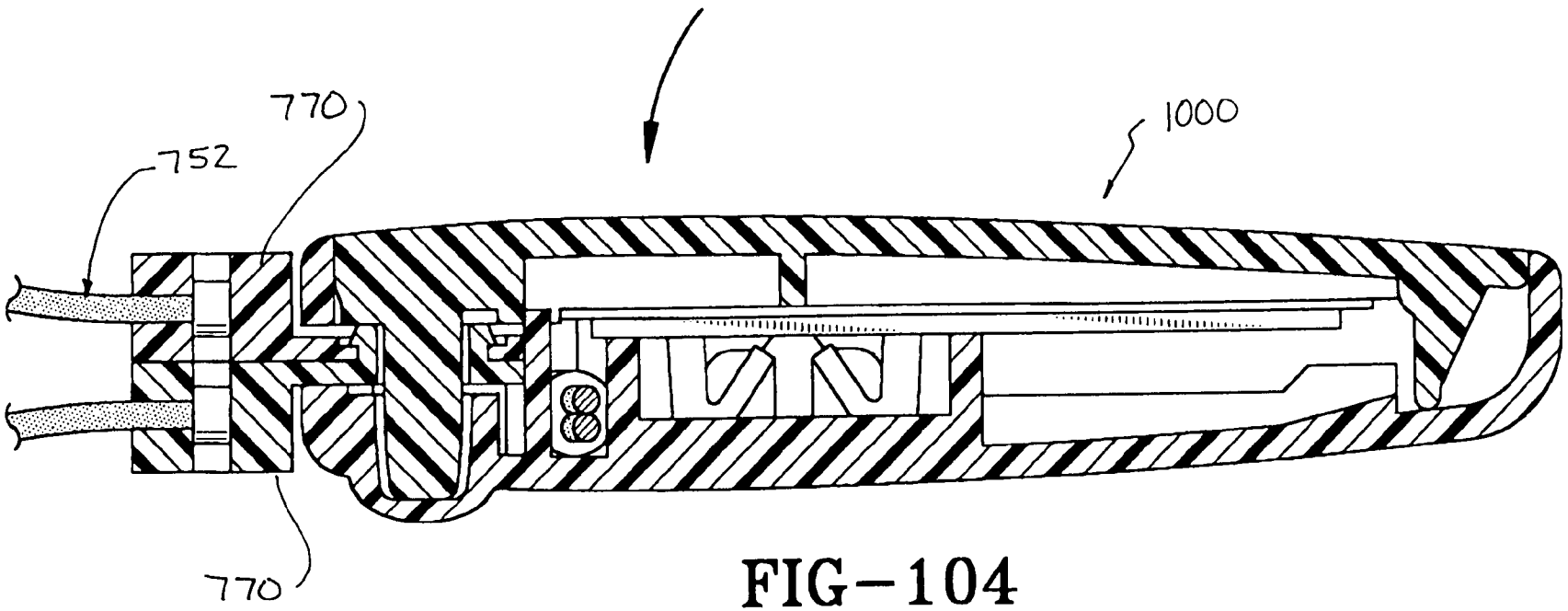
FIG. 104 is a view similar to FIG. 103 showing the holder locking the latched ends of the lanyard in place.

In order to prevent a shoplifter from prying members 1020 and 1022 apart, first member 1020 is nested within second member 1022 when first member 1020 is closed and locked as shown in FIG. 96. The outer edge of first member 1020 is thus not accessible to the shoplifter.

Second member 1022 defines a slot 1040 at one of its ends similar to the slots described above. Slot 1040 is aligned with tooth 1024 such that tooth 1024 will pass through opening 1008 when the second end of lanyard 1002 is positioned in second member 1022 and first member 1020 is moved to the closed position.

Second member 1022 defines a recess 1042 that receives the distal end of tooth 1024 when first member 1020 is locked to second member 1022. A first blocking wall 1044 is provided on second member 1022 to properly position the second end of lanyard 1002 with opening 1008 aligned with tooth 1024. First blocking wall 1044 may be curved so that its front surface seats the loop at the second end of lanyard 1002. The rear surface of first blocking wall 1044 is used to wedge enlarged end 1006 of lanyard 1002 in a removable manner that allows lanyard 1002 to be replaced if damaged or destroyed. This configuration also allows lanyards 1002 having different lengths to be exchanged with the same holder 1000. Blocking wall 1044 provides space for cables 1004 to pass around one of its ends to lead out of the slot. A second blocking wall 1046 is optionally used to wedge end 1006 in place. Walls 1044 and 1046 optionally include notches 1048 that seat enlarged end 1006.

Enlarged end 1006 is thus securely seated in place behind tooth 1024 when holder 1000 is locked. Tampering with end 1006 is thus difficult. Tooth 1024 is disposed through opening 1008 of lanyard 1002 to retain the second end of lanyard 1002.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

We claim:

1. A theft deterrent device adapted to be connected to an item of merchandise to discourage shoplifting; the device comprising:

a first member;

a second member;

the first and second members being connected together with a hinge that allows the members to move from an unlocked position to a locked position;

a lock for locking the first member to the second member in the locked position; the lock including four first locking fingers and two second locking fingers; two of the first locking fingers engaging each of the second locking fingers;

the second member defining a slot;

a lanyard having first and second ends; each of the ends defining an opening;

a portion of the lanyard being disposed in the slot defined by the second member for positioning the first and second ends adjacent the second member so that the lanyard forms a loop whereby the lanyard is adapted to loop around a portion of the article of merchandise to secure the device thereto; and the first member carrying a tooth that is adapted to pass through the openings of the ends when the first member is in the locked position.

2. The device of claim 1, wherein each of the second locking fingers has opposite sides; the first locking fingers engaging the opposite sides of the second locking finger.

3. The device of claim 2, wherein each first locking finger includes a first leg and a second leg; the second leg defining a locking surface that engages the second locking finger when the first and second members are in the locked position.

4. A theft deterrent device adapted to be connected to an item of merchandise to discourage shoplifting; the device comprising:

a first member;

a second member;

the first and second members being connected together with a hinge that allows the members to move from an unlocked position to a locked position;

a lock for locking the first member to the second member in the locked position;

the second member defining a slot;

a lanyard having first and second ends; each of the ends defining an opening; wherein the first end of the lanyard includes at least one latch; the latch adapted to connect the second end of the lanyard to the first end of the lanyard so that the openings of the ends are aligned when the ends are inserted into the slot of the second member;

a portion of the lanyard being disposed in the slot defined by the second member for positioning the first and second ends adjacent the second member so that the lanyard forms a loop whereby the lanyard is adapted to loop around a portion of the article of merchandise to secure the device thereto; and the first member carrying a tooth that is adapted to pass through the openings of the ends when the first member is in the locked position.

5. The device of claim 4, wherein the latch includes a finger that snap fits into a recess defined by the second end of the lanyard.

6. A theft deterrent device adapted to be connected to an item of merchandise to discourage shoplifting; the device comprising:

a first member;

a second member;

the first and second members being connected together with a hinge that allows the members to move from an unlocked position to a locked position;

a lock for locking the first member to the second member in the locked position;

the second member defining a slot;

a lanyard having first and second ends; each of the ends defining an opening;

a portion of the lanyard being disposed in the slot defined by the second member for positioning the first and second ends adjacent the second member so that the lanyard forms a loop whereby the lanyard is adapted to loop around a portion of the article of merchandise to secure the device thereto; and the first member carrying a tooth that is adapted to pass through the openings of the ends when the first member is in the locked position;

in combination with a key configured to unlock the device; wherein the key includes a plurality of key pins for engaging and unlocking the lock; and wherein the key pins are movable with a plunger that is movable between resting and unlocking positions.

7. The device of claim 6 wherein the first and second members define a body of the device; the body being non-symmetric so that the body may only be inserted into the key in one direction.

8. A theft deterrent device adapted to be connected to an item of merchandise to discourage shoplifting; the device comprising:

a first member;

a second member;

the first and second members being connected together with a hinge that allows the members to move from an unlocked position to a locked position;

a lock for locking the first member to the second member in the locked position;

the second member defining a slot;

a lanyard having first and second ends; each of the ends defining an opening; the lanyard including a cable which is resistant to severing;

a portion of the lanyard being disposed in the slot defined by the second member for positioning the first and second ends adjacent the second member so that the lanyard forms a loop whereby the lanyard is adapted to loop around a portion of the article of merchandise to secure the device thereto; and the first member carrying a tooth that is adapted to pass through the openings of the ends when the first member is in the locked position.

9. The device of claim 8 wherein the lanyard includes side-by-side cables.

10. The device of claim 8 wherein a portion of the lanyard adjacent the first end thereof is disposed in the slot; and wherein a portion of the lanyard adjacent the second end thereof is disposed in the slot.

11. The device of claim 8 in combination with the article of merchandise; wherein the lanyard is looped around a portion thereof to secure the device to the article when the first and second members are in the locked position.

12. A theft deterrent device adapted to be connected to an item of merchandise to discourage shoplifting; the device comprising:

a first member;

a second member;

the first and second members being connected together with a hinge that allows the members to move from an unlocked position to a locked position;

a lock for locking the first member to the second member in the locked position;

the second member defining a slot;

a lanyard having first and second ends; each of the ends defining an opening;

a portion of the lanyard being disposed in the slot defined by the second member for positioning the first and second ends adjacent the second member so that the lanyard forms a loop whereby the lanyard is adapted to loop around a portion of the article of merchandise to secure the device thereto; and the first member carrying a tooth that is adapted to pass through the openings of the ends when the first member is in the locked position;

in combination with the article of merchandise; wherein the lanyard is looped around a portion thereof to secure the device to the article when the first and second members are in the locked position.

13. The device of claim 12 in combination with a key configured to unlock the device.

14. A theft deterrent device adapted to be connected to an item of merchandise to discourage shoplifting; the device comprising:

a first member;

a second member;

the first and second members being connected together with a hinge that allows the members to move from an unlocked position to a locked position;

a lock for locking the first member to the second member in the locked position;

the second member defining a slot;

a lanyard having first and second ends; each of the ends defining an opening;

a portion of the lanyard being disposed in the slot defined by the second member for positioning the first and second ends adjacent the second member so that the lanyard forms a loop whereby the lanyard is adapted to loop around a portion of the article of merchandise to secure the device thereto;

the first member carrying a tooth that is adapted to pass through the openings of the ends when the first member is in the locked position;

wherein the device further includes an electronic article surveillance tag whereby the device is an alarm-activating device.

15. The device of claim 14 wherein the lanyard includes a cable which is resistant to severing.

16. The device of claim 14 in combination with the article of merchandise; wherein the lanyard is looped around a portion thereof to secure the device to the article when the first and second members are in the locked position.

17. A theft deterrent device adapted to be connected to an item of merchandise to discourage shoplifting; the device comprising:

a first member;

a second member;

the first and second members being connected together with a hinge that allows the members to move from an unlocked position to a locked position;

a lock for locking the first member to the second member in the locked position;

the second member defining a slot;

a lanyard having first and second ends; each of the ends defining an opening;

a portion of the lanyard being disposed in the slot defined by the second member for positioning the first and second ends adjacent the second member so that the lanyard forms a loop whereby the lanyard is adapted to loop around a portion of the article of merchandise to secure the device thereto;

the first member carrying a tooth that is adapted to pass through the openings of the ends when the first member is in the locked position; and wherein the first and second ends of the lanyard are removably connectable to one another so that when the first and second ends are connected the openings thereof are aligned to facilitate insertion of the tooth through the openings.

18. A theft deterrent device adapted to be connected to an item of merchandise to discourage shoplifting; the device comprising:

a first member;

a second member;

the first and second members being connected together with a hinge that allows the members to move from an unlocked position to a locked position;

a lock for locking the first member to the second member in the locked position;

the second member defining a slot which is formed entirely in the second member in a manner which prevents prying via the slot of the first and second members away from one another;

a lanyard having first and second ends; each of the ends defining an opening;

a portion of the lanyard being disposed in the slot defined by the second member for positioning the first and second ends adjacent the second member so that the lanyard forms a loop whereby the lanyard is adapted to loop around a portion of the article of merchandise to secure the device thereto; and the first member carrying a tooth that is adapted to pass through the openings of the ends when the first member is in the locked position.

19. The device of claim 18 wherein the first and second ends of the lanyard are insertable through the slot.

20. The device of claim 19 wherein the second member includes an alignment member which at least one of the ends of the lanyard contacts upon insertion of the first and second ends through the slot to align the openings with the tooth for the tooth to pass through the openings when the first and second members move from the unlocked position to the locked position.

21. A method comprising the steps of:

looping a lanyard having first and second ends each defining an opening around a portion of an article of merchandise;

positioning the first and second ends of the lanyard adjacent a first member which is connected to a second member via a hinge;

pivoting the first and second members via the hinge to pass a tooth carried by the second member through each of the openings in the lanyard; and locking the first and second members together to prevent removal of the ends of the lanyard from the tooth so that the first and second members are secured to the article of merchandise via the lanyard.

22. The method of claim 21 wherein the step of positioning includes the step of inserting the first and second ends of the lanyard through a first slot formed in the first member prior to the step of pivoting; and wherein the step of pivoting includes the step of moving the first member toward the second member to form a cavity therebetween in which the ends of the lanyard are disposed.

23. The method of claim 21 further including the step of unlocking the first and second members from one another with a key; and removing the tooth from at least one of the openings in the lanyard to remove the lanyard from the article of merchandise.

24. The method of claim 21 further including the step of activating an alarm by moving the article of merchandise with the first and second members secured thereto into an unauthorized area.

* * * * *